US005763152A

United States Patent [19]

Hioki et al.

[11] Patent Number: 5,763,152

[45] Date of Patent: Jun. 9, 1998

[54] SILVER HALIDE PHOTOGRAPHIC LIGHT-SENSITIVE MATERIAL

[75] Inventors: Takanori Hioki; Mikio Ihama, both of Minami-ashigara, Japan

[73] Assignee: Fuji Photo Film Co., Ltd., Kanagawa, Japan

[21] Appl. No.: 622,879

[22] Filed: Mar. 29, 1996

[30] Foreign Application Priority Data

Mar. 31, 1995 [JP] Japan ..... 7-075349

[51] Int. Cl.[6] ..... G03C 1/12; G03C 1/34

[52] U.S. Cl. ..... 430/581; 430/582; 430/583; 430/584; 430/585; 430/586; 430/587; 430/588; 430/592; 430/593; 430/594; 430/595; 430/604; 430/611

[58] Field of Search ..... 430/581, 582, 430/583, 584, 585, 586, 587, 588, 592–595, 611, 264, 604

[56] References Cited

U.S. PATENT DOCUMENTS

| | | | |
|---|---|---|---|
| 2,487,850 | 11/1949 | Carroll . | |
| 2,521,925 | 9/1950 | Lowe et al. . | |
| 4,198,240 | 4/1980 | Mikawa | 430/570 |
| 4,975,362 | 12/1990 | Parton et al. . | |
| 5,476,758 | 12/1995 | Suga et al. | 430/503 |

FOREIGN PATENT DOCUMENTS 789823 1/1958 United Kingdom .

*Primary Examiner*—Thorl Chea

*Attorney, Agent, or Firm*—Sughrue, Mion, Zinn, Macpeak & Seas, PLLC

[57] ABSTRACT

A silver halide photographic light-sensitive material is disclosed. The material comprises a substrate provided thereon with at least one silver halide emulsion layer comprising at least one compound represented by the following Formula (I):

wherein Ra and Rb each represents a hydrogen atom, an alkyl group having at least two carbon atoms or an aryl or heterocyclic group, provided that Ra and Rb do not simultaneously represent hydrogen atoms; La and Lb each represents a methylene group; $L_1$ and $L_2$ each represents a methine group; $p_1$ represents 0 or 1; $Z_1$ represents an atomic group required for forming a 5- or 6-membered nitrogen atom-containing heterocyclic ring; $M_1$ represents a counterion required for balancing the electrical charge; $m_1$ represents a numerical value of not less than 0 required for neutralizing the molecule; and Q represents a methine or polymethine group required for forming a methine dye. The light-sensitive material provides substantially low fogging, has high sensitivity and excellent storage stability and can provide images of high quality.

18 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material. More specifically, the present invention pertains to a silver halide photographic light-sensitive material which has high sensitivity to light, has less fog and is excellent in storage stability.

There has long been expended a great deal of effort to make a silver halide photographic light-sensitive material highly sensitive to light. Moreover, it has been known that the quality of the silver halide light-sensitive material is greatly affected by sensitizing dyes used for spectral sensitization. More specifically, photographic properties such as sensitivity, fog and storage stability are considerably affected by only a slight difference between the structures of sensitizing dyes used, but it has been quite difficult to predict, in advance, the influence of each individual sensitizing dye. For this reason, many research workers have made efforts for synthesizing a large number of sensitizing dyes and for examining the photographic properties thereof. For instance, as disclosed in U.S. Pat. No. 4,975,362, the photographic properties of a sensitizing dye can considerably be improved by simply adding a methylthio group thereto. There have widely been used sensitizing dyes each comprising, as a partial structure thereof, a nitrogen atom-containing heterocyclic ring carrying a sulfoalkyl group. Examples of such sulfoalkyl groups well known in the art are 2-sulfoethyl group, 3-sulfopropyl group, 4-sulfobutyl group and 3-sulfobutyl group. However, other sulfoalkyl groups have not been investigated at all and accordingly, it has presently been impossible to predict photographic properties thereof.

In addition, there has long been investigated reduction sensitization for making the silver halide photographic light-sensitive material highly sensitive to light. For instance, there have been proposed, as useful reduction-sensitizing agents, tin compounds as disclosed in U.S. Pat. No. 2,487,850; polyamine compounds as disclosed in U.S. Pat. No. 2,521,925; and thiourea dioxide type compounds as disclosed in U.K. Patent No. 789,823. Moreover, properties of silver nuclei prepared by various reduction-sensitizing methods are compared with one another in Photographic Science and Engineering, 1979, 23, p. 113, and dimethylamine borane, stannous chloride, hydrazine, high pH-ripening and low pAg-ripening methods are adopted therein. Methods for reduction sensitization are also disclosed in, for instance, U.S. Pat. Nos. 2,518,698, 3,201,254, 3,411,917, 3,779,777 and 3,930,867. Furthermore, Japanese Examined Patent Publication (hereinafter referred to as "J.P. KOKOKU") Nos. Sho 57-33572 and Sho 58-1410 disclose not only the selection of the reduction-sensitizing agents, but also a contrivance for the reduction sensitization method.

According to the studies of the inventors of this invention, however, it has become clear that when spectrally sensitizing silver halide grains, which have been subjected to reduction sensitization, by adsorbing a sensitizing dye on the grains, in particular, when spectrally sensitizing green-sensitive and red-sensitive regions, it is very difficult to achieve sufficient spectral sensitization of the grains without causing effects unfavorable for the photographic quality thereof (such as an increase in fog).

In addition, there have widely been known a method for adsorbing a sensitizing dye on silver halide grains at a high temperature (not less than 50° C. ) in order to prevent any desorption of the sensitizing dye from the silver halide grains in a light-sensitive material (which is observed, in particular, under high humidity conditions) or a method which comprises adsorbing a sensitizing dye on silver halide grains prior to the chemical sensitization thereof for making the sensitivity of silver halide grains higher. However, if these methods are adopted when adsorbing a spectral sensitizing dye, which is sensitive to light rays of a green- or red-region, on grains present in a reduction-sensitized emulsion, the resulting light-sensitive material undergoes severe fogging.

For this reason, there has been desired for the development of a technique for spectral sensitization which can impart high sensitivity to the reduction-sensitized silver halide grains and which does not have any adverse influence upon the resulting light-sensitive material such as fog.

SUMMARY OF THE INVENTION

Accordingly, a first object of the present invention is to provide a silver halide photographic light-sensitive material which has less fogging and is excellent in storage stability.

A second object of the present invention is to provide a silver halide photographic light-sensitive material which makes use of a reduction-sensitized emulsion, shows high sensitivity to light, is almost free of fog and is excellent in storage stability.

The foregoing objects of the present invention can effectively be accomplished by providing a silver halide photographic light-sensitive material which comprises a substrate provided thereon with at least one silver halide emulsion layer, wherein the emulsion layer comprises at least one compound represented by the following Formula (I):

Formula (I):

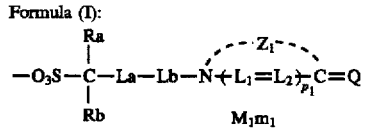

In Formula (I), Ra and Rb each represents a hydrogen atom, an alkyl group having at least two carbon atoms, an aryl group or a heterocyclic group, provided that at least one of Ra and Rb is an alkyl group having at least two carbon atoms, an aryl group or a heterocyclic group; La and Lb each represents a methylene group; $L_1$ and $L_2$ each represents a methine group; $p_1$ represents 0 or 1; $Z_1$ represents an atomic group required for forming a 5- or 6-membered nitrogen atom-containing heterocyclic ring; $M_1$ represents a counterion required for balancing the electrical charge; $m_1$ represents a numerical value of not less than 0 required for neutralizing the charge of the molecule; and Q represents a methine or polymethine group required for forming a methine dye.

In a preferred embodiment of the present invention, the compound of Formula (I) is selected from the group consisting of those represented by the following Formulae (II), (III) and (IV):

Formula (II):

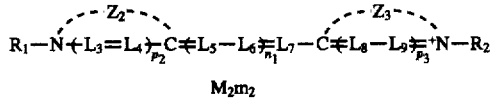

In Formula (II), $L_3$, $L_4$, $L_5$, $L_6$, $L_7$, $L_8$ and $L_9$ each represents a methine group; $p_2$ and $p_3$ each represents 0 or 1; $n_1$ represents 0, 1, 2, or 3; $Z_2$ and $Z_3$ each represents an atomic group required for forming a 5- or 6-membered nitrogen atom-containing heterocyclic ring; $M_2$ represents a counterion required for balancing the electrical charge; $m_2$ represents a numerical value of not less than 0 required for neutralizing the charge of the molecule; $R_1$ and $R_2$ each represents an alkyl group, provided that at least one of $R_1$ and $R_2$ is an alkyl group represented by the following Rz:

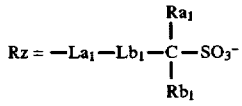

In Rz, $Ra_1$ and $Rb_1$ are identical to the foregoing substituents Ra and Rb respectively; and $La_1$ and $Lb_1$ are identical to the foregoing substituents La and Lb respectively.

Formula (III):

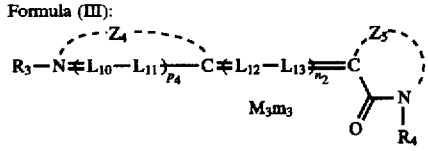

In Formula (III), $L_{10}$, $L_{11}$, $L_{12}$ and $L_{13}$ each represents a methine group; $p_4$ represents 0 or 1; $n_2$ represents 0, 1, 2, or 3; $Z_4$ and $Z_5$ each represents an atomic group required for forming a 5- or 6-membered nitrogen atom-containing heterocyclic ring; $M_3$ represents a counterion required for balancing the electrical charge; $m_3$ represents a numerical value of not less than 0 required for neutralizing the charge of the molecule; $R_3$ represents an alkyl group represented by Rz; and $R_4$ represents an alkyl group, an aryl group or a heterocyclic group.

DESCRIPTION OF THE PREFERRED EMBODIMENTS

The silver halide photographic light-sensitive material of the present invention will hereinafter be described in more detail.

The compounds used in the present invention will first be detailed below.

The compound represented by the general formula (I) can be represented by the following resonance formula when a cyanine dye is formed by Q:

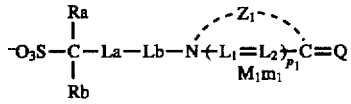

Examples of the 5- or 6-membered nitrogen atom-containing heterocyclic rings formed by $Z_1$, $Z_2$, $Z_3$, $Z_4$, $Z_6$ and $Z_8$ in Formulae (I), (II), (III) and (IV) are thiazoline nuclei, thiazole nuclei, benzothiazole nuclei, oxazoline nuclei, oxazole nuclei, benzoxazole nuclei, selenazoline nuclei, selenazole nuclei, benzoselenazole nuclei, dialkylindolenine nuclei (e.g., 3,3-dimethylindolenine nucleus), imidazoline nuclei, imidazole nuclei, benzimidazole nuclei, pyridine nuclei (e.g., 2-pyridine nuclei and 4-pyridine nuclei), quinoline nuclei (e.g., 2-quinoline nuclei and 4-quinoline nuclei), isoquinoline nuclei (e.g., 1-isoquinoline nuclei and 3-isoquinoline nuclei), imidazoquinoxaline nuclei (e.g., imidazo[4,5-b]quinoxaline nuclei), oxadiazole nuclei, thiadiazole nuclei, tetrazole nuclei and pyrimidine nuclei.

Preferred are benzoxazole nuclei, benzothiazole nuclei, benzimidazole nuclei and quinoline nuclei, with benzoxazole nuclei and benzothiazole nuclei being more preferred. The substituents $Z_2$ and $Z_3$ in the general formula (II) are particularly preferably benzoxazole nuclei.

If the substituent present on $Z_1$, $Z_2$, $Z_3$, $Z_4$, $Z_6$ and $Z_8$ is defined as V, the substituent V is not restricted to specific ones, but examples thereof include halogen atoms (such as chlorine, bromine, iodine and fluorine), mercapto groups, cyano groups, carboxyl groups, phosphate residues, sulfo groups, hydroxyl group, carbamoyl groups having 1 to 10, preferably 2 to 8 and more preferably 2 to 5 carbon atoms (such as methylcarbamoyl, ethylcarbamoyl and morpholinocarbonyl groups), sulfamoyl groups having 0 to 10, preferably 2 to 8 and more preferably 2 to 5 carbon atoms (such as methylsulfamoyl, ethylsulfamoyl and piperidinosulfonyl groups), nitro group, alkoxy groups having 1 to 20, preferably 1 to 10 and more preferably 1 to 8 carbon atoms (such as methoxy, ethoxy, 2-methoxyethoxy and 2-phenylethoxy groups), aryloxy groups having 6 to 20, preferably 6 to 12 and more preferably 6 to 10 carbon atoms (such as phenoxy, p-methylphenoxy, p-chlorophenoxy and naphthoxy groups), acyl groups having 1 to 20, preferably 2 to 12 and more preferably 2 to 8 carbon atoms (such as acetyl, benzoyl and trichloroacetyl groups), acyloxy groups having 1 to 20, preferably 2 to 12 and more preferably 2 to 8 carbon atoms Formula (IV):

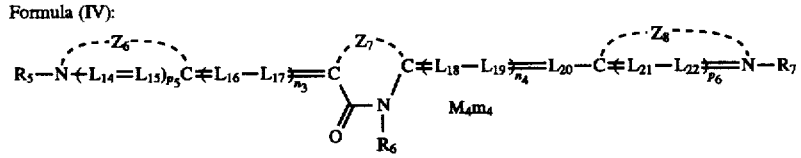

In Formula (IV), $L_{14}$, $L_{15}$, $L_{16}$, $L_{17}$, $L_{18}$, $L_{19}$, $L_{20}$, $L_{21}$ and $L_{22}$ each represents a methine group; $p_5$ and $p_6$ each represents 0 or 1; $n_3$ and $n_4$ each represents 0, 1, 2, or 3; $Z_6$, $Z_7$ and $Z_8$ each represents an atomic group required for forming a 5- or 6-membered nitrogen atom-containing heterocyclic ring; $M_4$ represents a counterion required for balancing the electrical charge; $m_4$ represents a numerical value of not less than 0 required for neutralizing the charge of the molecule; $R_5$ and $R_7$ each represents an alkyl group, provided that at least one of $R_5$, and $R_7$ is an alkyl group represented by the foregoing Rz; and $R_6$ is an alkyl group, an aryl group or a heterocyclic group.

(such as acetyloxy and benzoyloxy groups), acylamino groups having 1 to 20, preferably 2 to 12 and more preferably 2 to 8 carbon atoms (such as acetylamino group), sulfonyl groups having 1 to 20, preferably 1 to 10 and more preferably 1 to 8 carbon atoms (such as methanesulfonyl, ethanesulfonyl and benzenesulfonyl groups), sulfinyl groups having 1 to 20, preferably 1 to 10 and more preferably 1 to 8 carbon atoms (such as methanesulfinyl and benzenesulfinyl groups), sulfonylamino groups having 1 to 20, preferably 1 to 10 and more preferably 1 to 8 carbon atoms (such as methanesulfonylamino, ethanesulfonylamino and benzenesulfonylamino groups), amino group, substituted amino groups having 1 to 20, preferably 1 to 12 and more preferably 1 to 8 carbon atoms (such as methylamino, dimethylamino, benzylamino, anilino and diphenylamino groups), ammonium groups having 0 to 15, preferably 3 to 10 and more preferably 3 to 6 carbon atoms (such as trimethylammonium and triethylammonium groups), hydrazino groups having 0 to 15, preferably 1 to 10 and more preferably 1 to 6 carbon atoms (such as trimethylhydrazino group), ureido groups having 1 to 15, preferably 1 to 10 and more preferably 1 to 6 carbon atoms (such as ureido and N,N-dimethylureido groups), imido groups having 1 to 15, preferably 1 to 10 and more preferably 1 to 6 carbon atoms (such as succinimido group), alkyl- or arylthio groups having 1 to 20, preferably 1 to 12 and more preferably 1 to 8 carbon atoms (such as methylthio, ethylthio, carboxyethylthio, sulfobutylthio and phenylthio groups), alkoxycarbonyl groups having 2 to 20, preferably 2 to 12 and more preferably 2 to 8 carbon atoms (such as methoxycarbonyl, ethoxycarbonyl and benzyloxycarbonyl groups), aryloxycarbonyl groups having 6 to 20, preferably 6 to 12 and more preferably 6 to 8 carbon atoms (such as phenoxycarbonyl group), unsubstituted alkyl groups having 1 to 18, preferably 1 to 10 and more preferably 1 to 5 carbon atoms (such as methyl, ethyl, propyl and butyl groups), substituted alkyl groups having 1 to 18, preferably 1 to 10 and more preferably 1 to 5 carbon atoms (such as hydroxymethyl, trifluoromethyl, benzyl, carboxyethyl, ethoxycarbonylmethyl, acetylaminomethyl groups, provided that the substituted alkyl group is herein defined such that it also encompasses unsaturated hydrocarbon groups having 2 to 18, preferably 3 to 10 and more preferably 3 to 5 carbon atoms (such as vinyl, ethynyl, 1-cyclohexenyl, benzylidyne and benzylidene groups)), substituted or unsubstituted aryl groups having 6 to 20, preferably 6 to 15 and more preferably 6 to 10 carbon atoms (such as phenyl, naphthyl, p-carboxyphenyl, p-nitrophenyl, 3,5-dichlorophenyl, p-cyanophenyl, m-fluorophenyl and p-tolyl groups) and substituted or unsubstituted heterocyclic groups having 1 to 20, preferably 2 to 10 and more preferably 4 to 6 carbon atoms (such as pyridyl, 5-methylpyridyl, thienyl, furyl, morpholino and tetrahydrofurfuryl groups). The substituent V may be those having structures formed through condensation of benzene and/or naphthalene rings. Moreover, these substituents may further be substituted with V.

Preferred examples of the substituents for $Z_1$, $Z_2$, $Z_3$, $Z_4$, $Z_6$ and $Z_8$ are alkyl groups, aryl groups, alkoxy groups, halogen atoms, acyl groups, cyano group, sulfonyl groups and condensed benzene rings such as those listed above, with alkyl, aryl, acyl and sulfonyl groups, halogen atoms and condensed benzene rings being more preferred. Particularly preferred are methyl group, methoxy group, chlorine atom, bromine atom, iodine atom and condensed benzene rings.

The substituents Ra and Rb in the general formula (I) each represents a hydrogen atom, an alkyl group having at least two carbon atoms, an aryl group or a heterocyclic group, provided that at least one of Ra and Rb represents an alkyl group having at least two carbon atoms, an aryl group or a heterocyclic group and specific examples thereof include unsubstituted alkyl groups having 2 to 16, preferably 2 to 8 and more preferably 2 to 4 carbon atoms (such as ethyl, butyl and pentyl groups) and substituted alkyl groups having 1 to 20, preferably 3 to 10 and more preferably 3 to 7 carbon atoms (such as alkyl groups substituted with the foregoing substituents V listed above for $Z_1$ or the like and more specifically, allyl, benzyl, hydroxyethyl and carboxyethyl groups) for the alkyl group having at least two carbon atoms; unsubstituted aryl groups having 6 to 20, preferably 6 to 10 and more preferably 6 to 8 carbon atoms (such as phenyl and 1-naphthyl groups) and substituted aryl groups having 6 to 20, preferably 6 to 10 and more preferably 6 to 8 carbon atoms (such as aryl groups substituted with the foregoing substituents V listed above for $Z_1$ or the like and more specifically, p-methoxyphenyl, p-methylphenyl and p-chlorophenyl groups) for 1the aryl group; and unsubstituted heterocyclic groups having 1 to 20, preferably 3 to 10 and more preferably 4 to 8 carbon atoms (such as 2-furyl, 2-thienyl and 2-pyridyl groups) and substituted heterocyclic groups having 1 to 20, preferably 3 to 10 and more preferably 4 to 8 carbon atoms (such as heterocyclic groups substituted with the foregoing substituents V listed above for $Z_1$ or the like and more specifically, 5-methyl-2-thienyl and 4-methoxy-2-pyridyl groups) for the heterocyclic group.

Preferred examples of the alkyl groups each having at least two carbon atoms are ethyl, allyl and benzyl groups, with allyl and benzyl groups among the substituted alkyl groups being particularly preferred.

Among the foregoing alkyl, aryl and heterocyclic groups, preferred are aryl and heterocyclic groups, with those in which Ra is an aryl group or a heterocyclic group and Rb is a hydrogen atom being more preferred. Among the aryl and heterocyclic groups, preferred are aryl groups, with phenyl groups being more preferred.

The substituents $Ra_1$ and $Rb_1$ included in Rz are identical to Ra and Rb defined above in connection with Formula (I) respectively.

Examples of La and Lb include unsubstituted methylene groups or substituted methylene groups (such as those methylene groups substituted with the foregoing substituents V listed above for $Z_1$ or the like and more specifically, methylene group substituted with a methyl group, methylene group substituted with an ethyl group, methylene group substituted with a phenyl and methylene group substituted with a hydroxy group), with unsubstituted methylene group being preferred.

The substituents $La_1$ and $Lb_1$ included in Rz are identical to La and Lb defined above in connection with Formula (I) respectively.

Examples of the substituent Rz including Ra, Rb, La and Lb in the general formula (I) will be listed below. In this connection, the following examples are more preferred in the given order of $Rz_1$ to $Rz_7$, i.e., the most preferred is $Rz_7$.

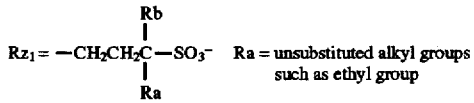

-continued

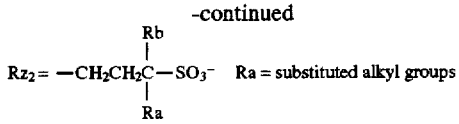

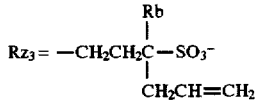

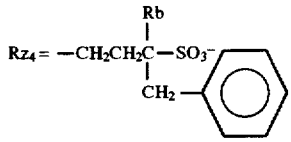

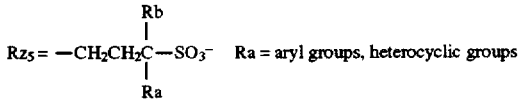

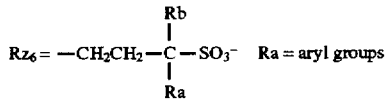

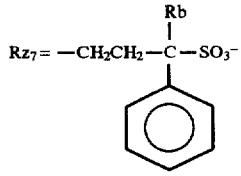

In $Rz_1$ to $Rz_7$, Rb is preferably a hydrogen atom.

The substituents $R_1$, $R_2$, $R_5$ and $R_7$ in the general formulae (II), (III) and (IV) each represents an alkyl group. Examples of such alkyl groups are unsubstituted alkyl groups having 1 to 18, preferably 1 to 7 and more preferably 1 to 4 carbon atoms (such as methyl, ethyl, propyl, isopropyl, butyl, isobutyl, hexyl, octyl, dodecyl and octadecyl groups and substituted alkyl groups having 1 to 18, preferably 1 to 7 and more preferably 1 to 4 carbon atoms (such as those substituted with the foregoing substituents V listed above for $Z_1$ or the like and preferably aralkyl groups (e.g., benzyl and 2-phenylethyl groups), unsaturated hydrocarbon groups (e.g., allyl group), hydroxyalkyl groups (e.g., 2-hydroxyethyl and 3-hydroxypropyl groups), carboxyalkyl groups (e.g., 2-carboxyethyl, 3 -carboxypropyl, 4-carboxybutyl and carboxymethyl groups), alkoxyalkyl groups (e.g., 2-methoxyethyl and 2-(2-methoxyethoxy)ethyl groups), aryloxyalkyl groups (e.g., 2-phenoxyethyl and 2-(1-naphthoxy)ethyl groups), alkoxycarbonylalkyl groups (e.g., ethoxycarbonylmethyl and 2-benzyloxycarbonylethyl groups), aryloxycarbonylalkyl groups (e.g., 3-phenoxycarbonylpropyl group), acyloxyalkyl groups (e.g., 2-acetyloxyethyl group), acylalkyl groups (e.g., 2-acetylethyl group), carbamoylalkyl groups (e.g., 2-morpholinocarbonylethyl group), sulfamoylallkyl groups (e.g., N,N-dimethylcarbamoylmethyl group), sulfoalkyl groups (e.g., 2-sulfoethyl, 3-sulfopropyl, 3-sulfobutyl, 4-sulfobutyl, 2-(3-sulfopropoxy)ethyl, 2-hydroxy-3-sulfopropyl and 3-sulfopropoxyethoxyethyl groups), sulfatoalkyl groups of $R_z$ (e.g., 3-sulfatopropyl and 4-sulfatobutyl groups), alkyl groups substituted with heterocyclic rings (e.g., 2-(pyrrolidin-2-one-1-yl)ethyl and tetrahydrofurfuryl groups) and methanesulfonylcarbamoylmethyl group).

Preferred examples of the alkyl groups represented by the substituents $R_1$, $R_2$, $R_5$ and $R_7$ are the carboxyalkyl groups, sulfoalkyl groups and $R_z$, with sulfoalkyl groups being more preferred. $R_3$ is an alkyl group represented by Rz.

$Z_5$ represents an atomic group required for forming an acidic nucleus and may be in the form of any commonly known acidic nuclei for merocyanine dyes. The term "acidic nucleus" herein used is defined in, for instance, The Theory of the Photographic Process, edited by James, 4th edition, published by Macmillan Inc., 1977, p. 198. More specifically, examples thereof are those disclosed in U.S. Pat. Nos. 3,567,719, 3,575,869, 3,804,634, 3,837,862, 4,002,480 and 4,925,777 and Japanese Un-Examined Patent Publication (hereinafter referred to as "J.P. KOKAI") No. Hei 3-167546.

The acidic nucleus is preferably in the form of a 5- or 6-membered nitrogen atom-containing heterocyclic ring comprising carbon and nitrogen atoms and chalcogen (typically, oxygen, sulfur, selenium an d tellurium) and specific examples thereof include those listed below.

Nuclei derived from 2-pyrazolin-5-one, pyrazolidin-3,5-dione, imidazolin-5-one, hydantoin, 2- or 4-thiohydantoin, 2-iminooxazolidin-4-one, 2-oxazolin-5-one, 2-thiooxazolin-2,4-dione, isooxazolin-5-one, 2-thiazol in-4-one, thiazolidin-4-one, thiazolidin-2,4-dione, rhodanine, thiazolidin-2,4-dithione, isorhodanine, indan-1,3-dione, thiophen-3-one, thiophen-3-one-1, 1-dioxide, indolin-2-one, indolin-3-one, 2-oxoindazolinium, 3-oxoindazolinium, 5,7-dioxo-6,7-dihydirothiazolo[3,2-a]pyrimidine, cyclohexan-1, 3-dione, 3,4-dihydroisoquinolin-4one, 1,3-dioxan-4,6-dione, barbituric acid, 2-thiobarbituric acid, chroman-2, 4-di one, indazolin-2-one, pyrido[2-a]pyrimidin-1,3-dione, pyrazolo[1,5]quinazolone, pyrazolo[1,5-a]3 benzimidazole, pyrazolopyridone, 1,2,3,4-tetrahydroquinolin-2,4-dione, 3-oxo-2,3-dihyerobenzoa[d]thiophen -1,1-dioxide and 3-dicyanomethin-2,3-dihydrobenzo[d]thiophen-1,1 -dioxide.

Preferred examples of the nuclei include hydantoin, 2- or 4-thiohydantoin, 2-oxazolin-5-one, 2-thiooxazolin-2,4-dione, thiazolidin-2,4-dione, rhodanine, thiazolidin-2,4-dithione, barbituric acid and 2-thiobarbituric acid, with hydantoin, 2-or 4-thiohydantoin, 2-oxazolin-5-one, rhodanine, barbituric acid and 2-thiobarbituric acid being more preferred and 2- or 4-thiohydantoin, 2-oxazolin-5-one and rhodanine being particularly preferred.

The 5- or 6-membered nitrogen atom-containing heterocyclic rings formed by the substituent $Z_7$ are those represented by the substituent $Z_5$ from which oxo or thioxo groups are omitted. Preferred examples thereof are hydantoin, 2- or 4-thiohydantoin, 2-oxazolin-5-one, 2-thiooxazolin-2,4-dione, thiazolidin-2,4-dione, rhodanine, thiazolidin-2,4-dithione, barbituric acid and 2-thiobarbituric acid from which oxo or thioxo groups are omitted, with hydaitoin, 2- or 4-thiohydantoin, 2-oxazolin-5-one, rhodanine, barbituric acid and 2-thiobarbituric acid from which oxo or thioxo groups are removed being more preferred, and 2- or 4-thiohydantoin, 2-oxazolin-5-one and rhodanine from which oxo or thioxo groups are removed being particularly preferred.

The alkyl groups as $R_4$ and $R_6$ may be, for instance, substituted and unsubstituted alkyl group listed above in connection with $R_1$ and preferred examples thereof are those listed above as preferred examples of alkyl groups for $R_1$. The aryl groups as $R_4$ and $R_6$ include be unsubstituted aryl groups having 6 to 20, preferably 6 to 10 and more preferably 6 to 8 carbon atoms (such as phenyl and 1-naphthyl groups); and substituted aryl groups having 6 to 20, preferably 6 to 10 and more preferably 6 to 8 carbon atoms (such as aryl groups substituted with the foregoing substituent:3 V listed above for $Z_1$ or the like and more specifically p-methoxyphenyl, p-methylphenyl and p-chlorophenyl groups). The heterocyclic groups as $R_4$ and $R_6$ include unsubstituted heterocyclic groups having 1 to 20, preferably 3 to 10 and more preferably 4 to 8 carbon atoms (such as 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl) and 5-tetrazolyl); and substituted heterocyclic groups having 1 to 20, preferably 3 to 10 and more preferably 4 to 8 carbon atoms (such as heterocyclic groups substituted with the foregoing substituents V listed above for $Z_1$ or the like and more specifically 5-methyl-2-thienyl and 4-methoxy-2-pyridyl groups).

Examples of preferred $R_4$ and $R_6$ are methyl, ethyl, 2-sulfoethyl, 3-sulfopropyl, 3-sulfobutyl, 4-sulfobutyl, carboxymethyl, phenyl, 2-pyridyl and 2-thiazolyl, with ethyl, 2-sulfoethyl, carboxymethyl, phenyl and 2-pyridyl being more preferred.

$L_1$ to $L_{22}$ each independently represents a methine group. The methine groups represented by $L_1$ to $L_{22}$ may have substituents and examples of such substituents are substituted or unsubstituted alkyl groups having 1 to 15, preferably 1 to 10 and more preferably 1 to 5 carbon atoms (such as methyl, ethyl, 2-carboxyethyl groups); substituted or unsubstituted aryl groups having 6 to 20, preferably 6 to 15 and more preferably 6 to 10 carbon atoms (such as phenyl and o-carboxyphenyl groups); substituted or unsubstituted heterocyclic groups having 3 to 20, preferably 4 to 15 and more preferably 6 to 10 carbon atoms (such as N,N-diethylbarbiturate group); halogen atoms (such as chlorine, bromine, fluorine and iodine atoms); alkoxy groups having 1 to 15, preferably 1 to 10 and more preferably 1 to 5 carbon atoms (such as methoxy and ethoxy groups); alkylthio groups having 1 to 15, preferably 1 to 10 and more preferably 1 to 5 carbon atoms (such as methylthio and ethylthio groups); arylthio groups having 6 to 20, preferably 6 to 15 and more preferably 6 to 10 carbon atoms (such as phenylthio group); and amino groups having 0 to 15, preferably 2 to 10 and more preferably 4 to 10 carbon atoms (such as N,N-diphenylamino, N-methyl-N-phenylamino and N-methylpiperazino groups). Moreover, the methine group may form a ring along with other methine groups or may form an auxochrome. The term "auxochrome" herein used means, for instance, heterocyclic rings formed by $Z_1$ to $Z_8$.

$n_1$, $n_2$ and $n_3$ each is preferably 0 or 1 and more preferably 1. $n_4$ is preferably 0 or 1 and more preferably 0. If the sum of $n_1$ to $n_4$ is not less than 2, methine groups are repeated, but they are not necessarily identical to one another.

$M_1$, $M_2$, $M_3$ and $M_4$ are included in the formulae to indicate the presence of cations or anions required for neutralizing the ionic charges of the dye. Examples of typical cations are inorganic cations such as a hydrogen ion (H+), alkali metal ions (for instance, sodium, potassium and lithium ions) and alkaline earth metal ions (e.g., calcium ions); and organic cations such as ammonium ions (e.g., ammonium ions, di-, tri- or tetraalkylammonium ions, pyridinium ions and ethylpyridinium ions). The anions may be inorganic or organic anions and examples thereof include halogen anions (such as fluoride ions, chloride ions and iodide ions), substituted arylsulfonate anions (such as p-toluenesulfonate ions and p-c hlorobenzenesulfonate ions), aryldisulfonate ions (such as 1,3-benzenedisulfonate ions, 1,5-naphthalenedisulfonate ions and 2,6-naphthalenedisulfonate ions), alkylsulfate ions (such as methylsulfate ions), sulfate ions, thiocyanate ions, perchlorate ions, tetrafluoroborate ions, picrate ions, acetate ions and trifluoromethanesulfonate ions. Moreover, it is also possible to use ionic polymers or other dyes carrying charges opposite to those of the foregoing dyes.

In this specification, the sulfo group is indicated by $—SO_3^-$. However, in case where $H^+$ is a counter ion, it may be indicated as $—SO_3H$.

$m_1$, $m_2$, $m_3$ and $m_4$ each represents a numerical value required for balancing the electric charges and therefore, it is 0 when a dye forms an intramolecular salt. $m_1$, $m_2$, $m_3$ and $m_4$ each is preferably 0 to 6, more preferably 0 to 4, and most preferably 0 to 1.

$P_1$, $P_2$, $P_3$, $P_4$, $P_5$ and $P_6$ each independently represents 0 or 1 and preferably 0.

Q represents a methine group or a polymethine group required for forming a methine dye.

The number of methine groups in the polymethine group is preferably 2 to 7, more preferably 2 to 5, most preferably 3.

Any methine or polymethine group can be used as Q as long as it can form a methine dye. Preferred is substituted methine or polymethine group required for forming a methine dye. The substituent on such methine or polymethine group includes an aromatic group, a heterocyclic group, a cyano group, an amino group, an alkylcarbonyl group, an alkylsulfonyl group, and an acyl group.

The aromatic group includes a substituted or unsubstituted aromatic group (e.g., 4-dimethylaminophenyl, 4-methoxyphenyl, phenyl and 4-dimethylaminonaphthyl). The heterocyclic nuclei forming the heterocyclic group include those as listed in relation to the heterocyclic nuclei formed by $Z_2$, $Z_3$, $Z_5$ and $Z_7$. The amino group includes a substituted or unsubstituted amino group (e.g., amino and dimethylamino groups). The alkoxycarbonyl group includes a substituted or unsubstituted alkoxycarbonyl group (e.g., ethoxycarbonyl group). The alkylsulfonyl group includes a substituted or unsubstituted alkylsulfonyl group (e.g., methanesulfonyl group). The acyl group includes a substituted or unsubstituted acyl group (e.g., acetyl or benzyl group).

Any methine dye can be formed by Q. Preferred methine dye includes a cyanine dye, a merocyanine dye, a rhodanine dye, a rodacyanine dye, 3-nucleus merocyanine dye, an allopolar dye, a hemicyanine dye and a styryl dye. The detailed explanation of these dyes are present, for example, in F. M. Harmer, "Heterocyclic Compounds-cyanine Dyes and Related Compounds", John Wiley & Sons Company, N.Y., London, 1964; and D. M. Sturmer, "Heterocyclic Compounds—Special Topics in Heterocyclic Chemistry", Section 18, Chapter 14, pp. 482 to 515.

The Formulae for the cyanine dye, merocyanine dye and rodacyanine dye are preferably those (XI), (XII) and (XIII) in pages 21 and 22 of U.S. Pat. No. 5,340,694.

Specific examples of the compounds represented by the general formula (I), (II), (III) and (IV) will be listed below, but the present invention is not restricted to these specific ones. In this respect, the compounds of Formulae (II), (III) and (IV) occupy subordinate positions to the compounds of Formula (I) and therefore, specific examples of the compounds of Formula (I) listed below are compounds other than those occupying the subordinate positions.

Specific Examples of Compounds of Formula (II)
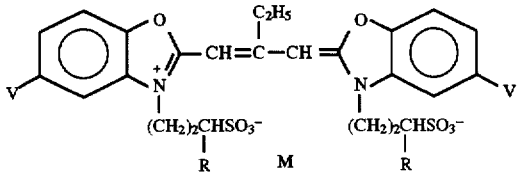
| Compound No. | R | V | M |
|---|---|---|---|
| II-1 | $C_2H_5$ | Ph | $K^+$ |
| II-2 | Ph | Ph | $Na^+$ |
| II-3 | $CH_2Ph$ | Ph | $NH(C_2H_5)_3^+$ |
| II-4 | $CH_2CH{=}CH_2$ | Ph | $K^+$ |
| II-5 | $CH_2CH{=}CH_2$ | Ph | $Na^+$ |
| II-6 | $C_2H_5$ | Br | $K^+$ |
| II-7 | Ph | Br | $Na^+$ |
| II-8 | $C_2H_5$ | I | $K^+$ |
| II-9 | Ph | I | $K^+$ |
| II-10 | $C_2H_5$ | Cl | $K^+$ |
| II-11 | Ph | Cl | $K^+$ |
| II-12 | $C_2H_5$ | $CH_3$ | $Na^+$ |
| II-13 | Ph | $CH_3$ | $Na^+$ |
| II-14 | $C_2H_5$ | $OCH_3$ | $Na^+$ |
| II-15 | Ph | $OCH_3$ | $K^+$ |
Ph: phenyl group.
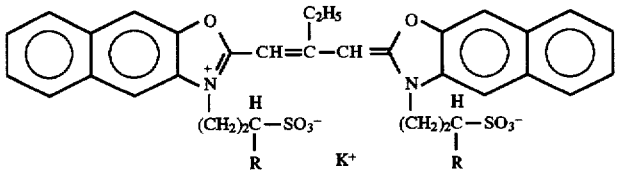
(II-16) $R = C_2H_5$
(II-17)
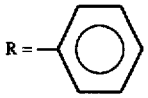
(II-18)
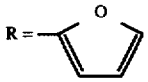
(II-19)
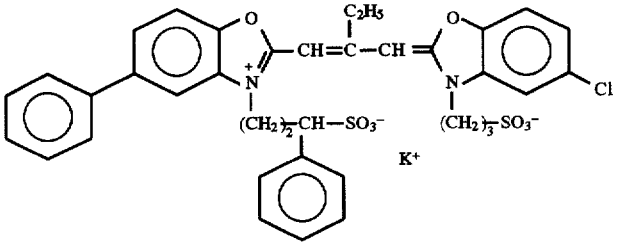
(II-20)
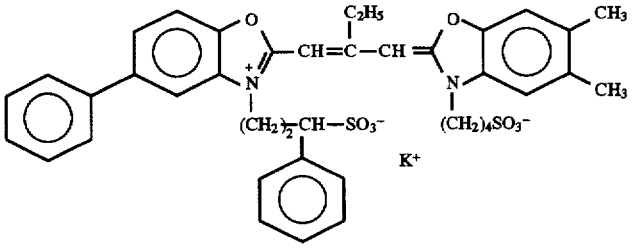

-continued
(II-21)
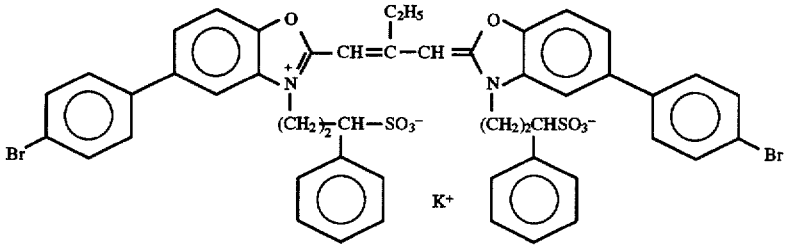
(II-22)
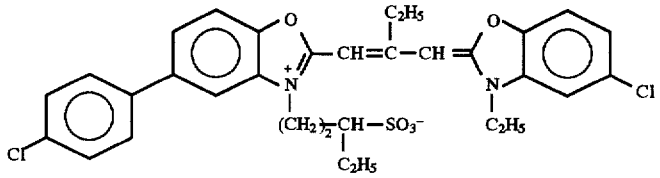
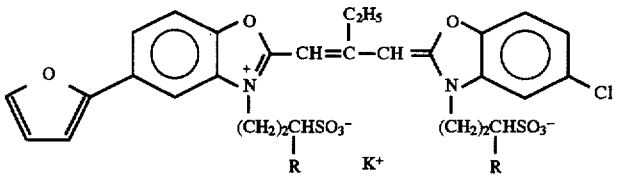
(II-23) R = $C_2H_5$
(II-24) R = $CH_2CH{=}CH_2$
(II-25)
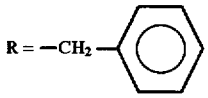
(II-26)
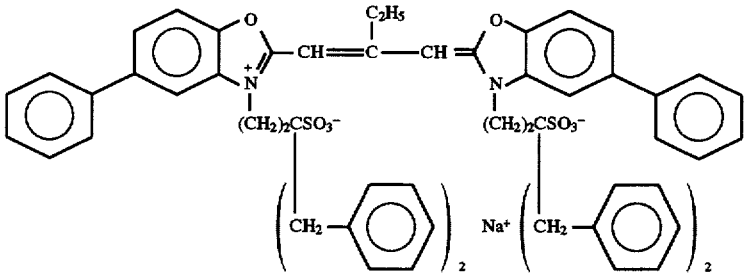
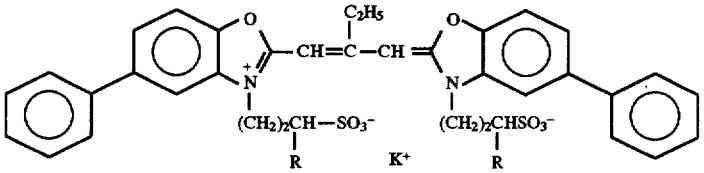
(II-27) R = $(CH_2)_3CH_3$
(II-28) R = $(CH_2)_4CH_3$
(II-29) R = $CH_2OH$
(II-30) R = $CH_2OCH_3$
(II-31)
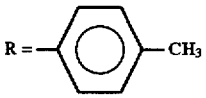
(II-32)
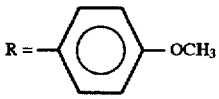

-continued
(II-33)
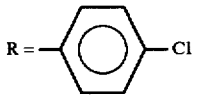
(II-34)
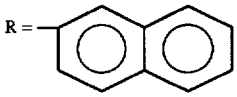
(II-35)
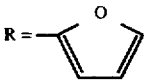
(II-36)
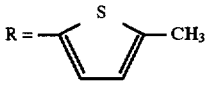
(II-37)
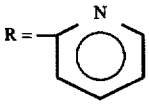
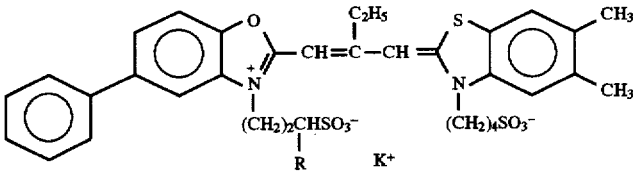
(II-38) R = $C_2H_5$
(II-39)
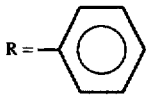
(II-40)
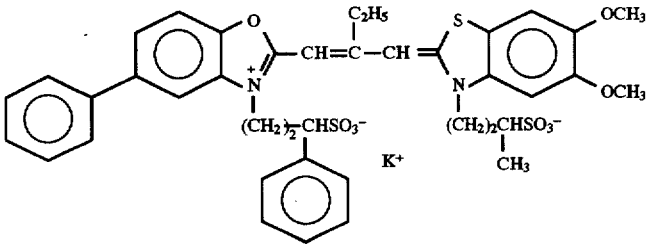
(II-41)
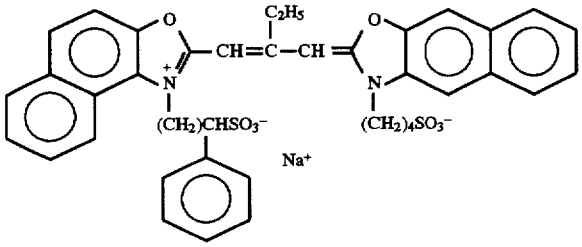
(II-42)
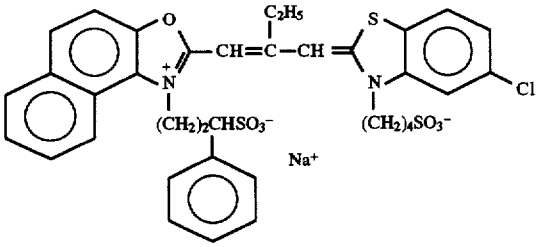

-continued
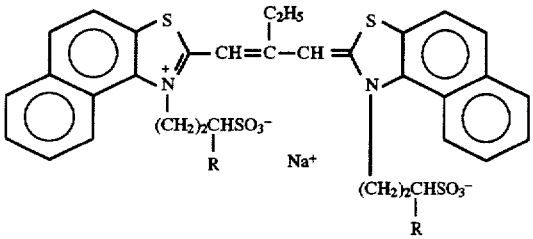
(II-43) R = $C_2H_5$
(II-44)
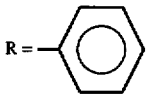
(II-45)
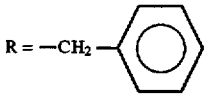
(II-46) R = $CH_2CH{=}CH_2$
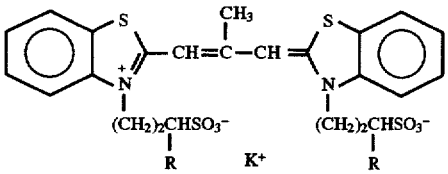
(II-47) R = $C_2H_5$
(II-48)
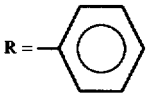
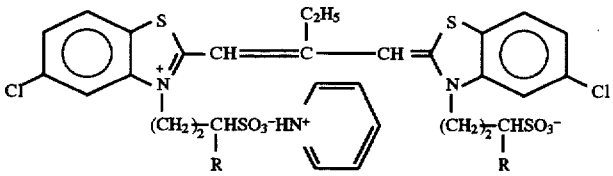
(II-49) R = $C_2H_5$
(II-50)
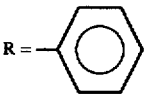
(II-51)
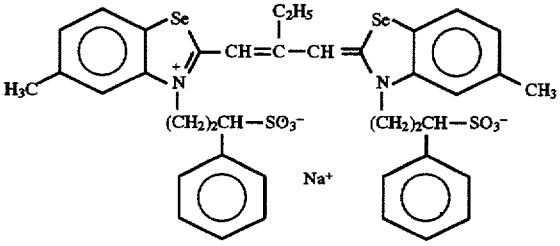

-continued
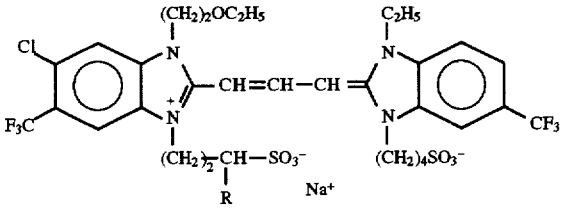
(II-52)
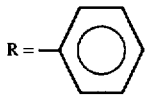
(II-53) R = $C_2H_5$
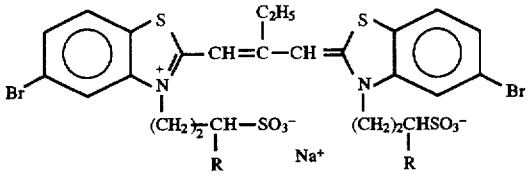
(II-54)
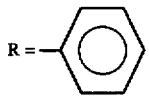
(II-55) R = $CH_2CH{=}CH_2$
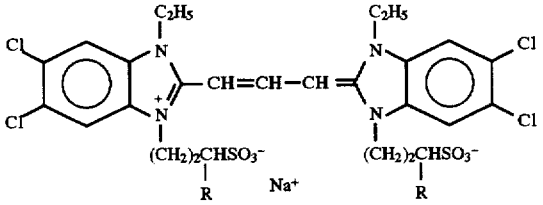
(II-56)
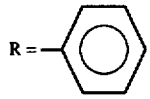
(II-57) R = $C_2H_5$
(II-58)
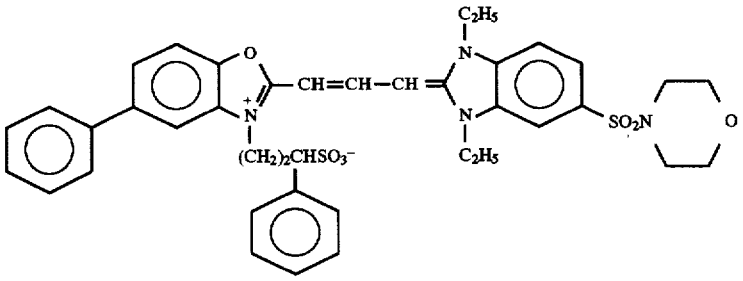
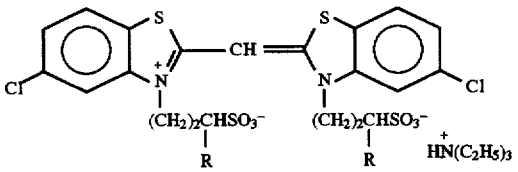
(II-59)
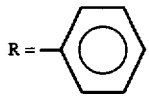

-continued
(II-60) $R = C_2H_5$
(II-61) $R = CH_2CH{=}CH_2$
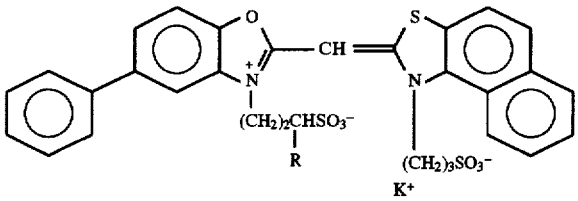
(II-62)
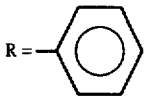
(II-63) $R = C_2H_5$
(II-64)
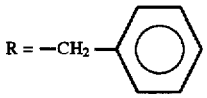
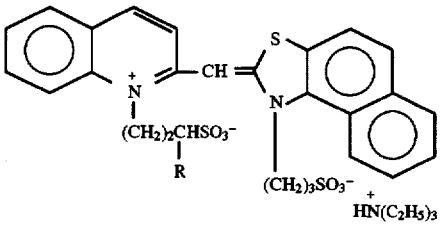
(II-65)
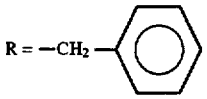
(II-66)
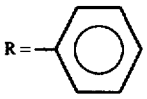
(II-67) $R = C_2H_5$
(II-68)
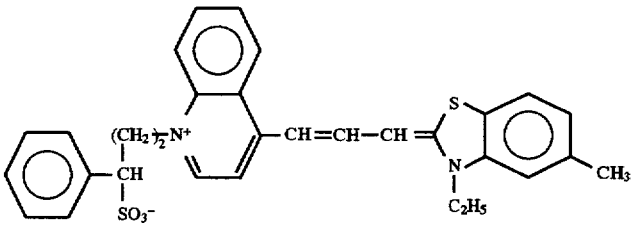
(II-69)
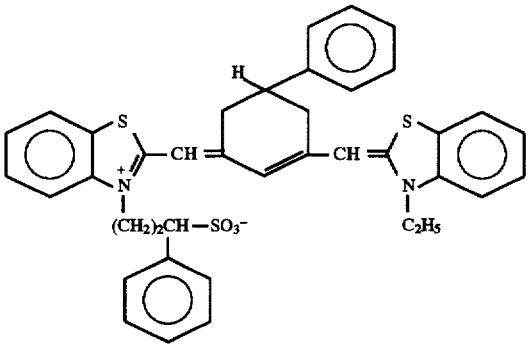

-continued
(II-70)
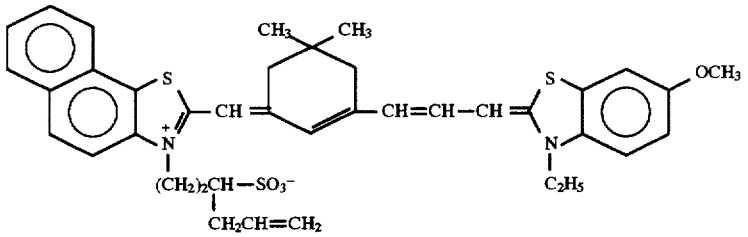
(II-71)
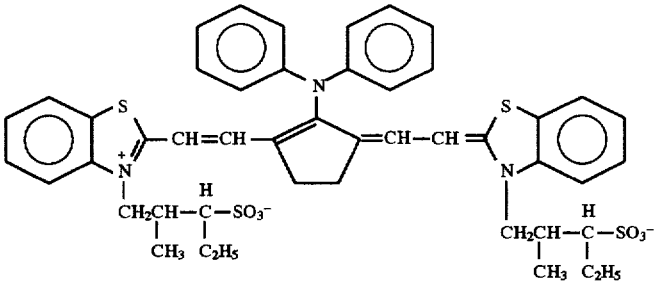
(II-72)
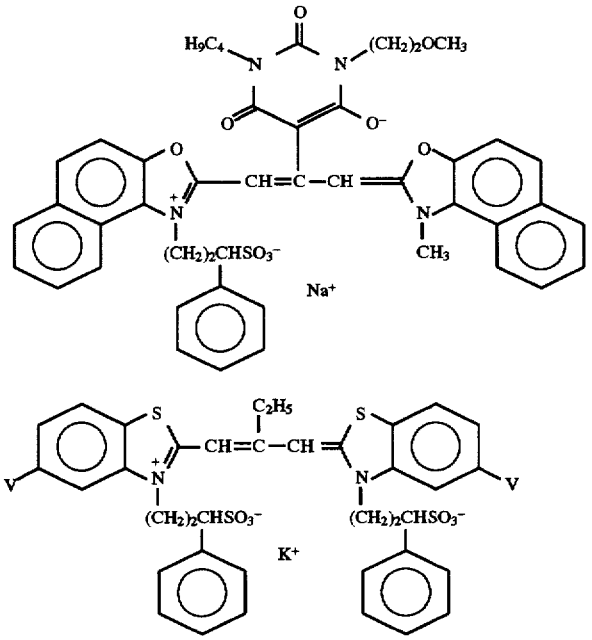
(II-73)
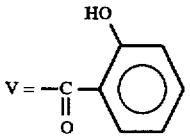
(II-74)
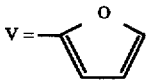
(II-75)
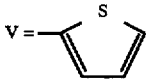
(II-76)
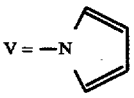

-continued
(II-77)
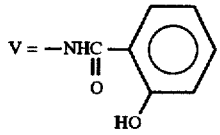
Specific Examples of Compounds of Formula (III)
(III-1)
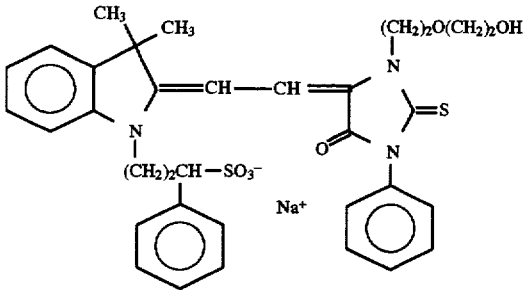
(III-2)
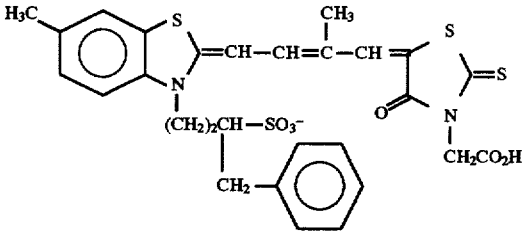
(III-3)
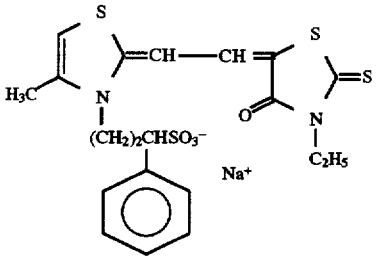
(III-4)
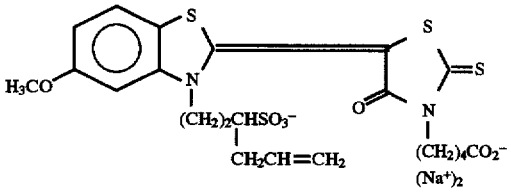
(III-5)
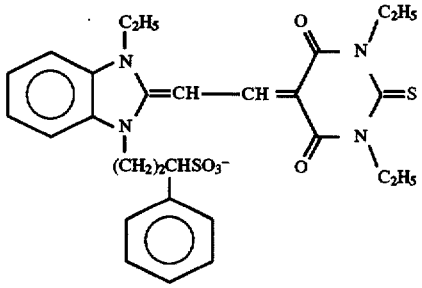

-continued
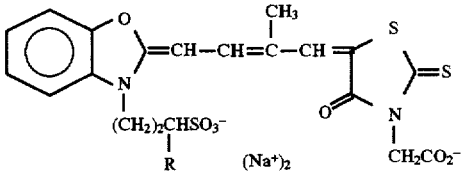
(III-6)
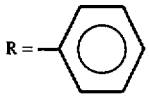
(III-7) $R = C_2H_5$
(III-8)
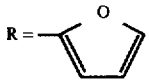
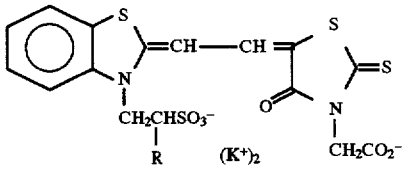
(III-9) $R = C_2H_5$
(III-10)
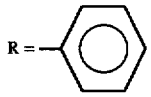
(III-11)
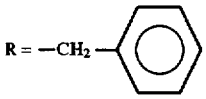
(III-12)
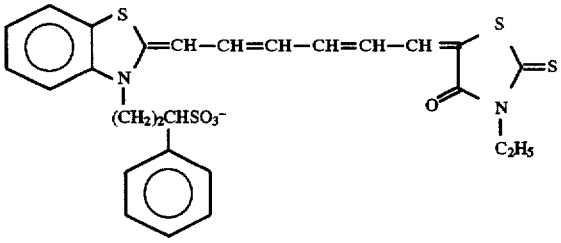
(III-13)
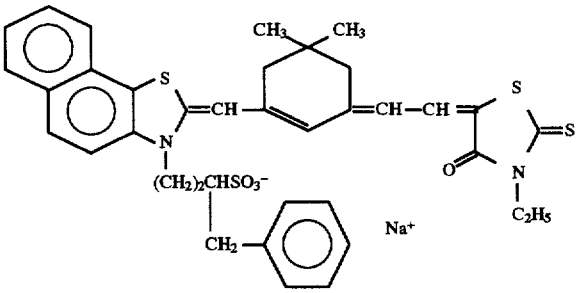

-continued
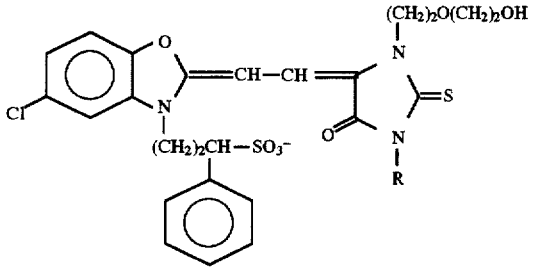
(III-14)
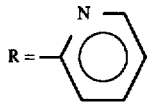
(III-15)
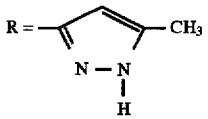
Specific Examples of Compounds of Formula (IV)
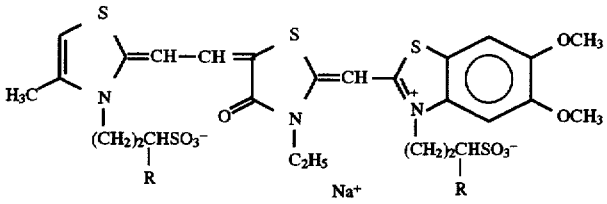
(IV-1) $R = C_2HD_5$
(IV-2)
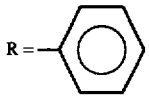
(IV-3) $R = CH_2CH{=}CH_2$
(IV-4)
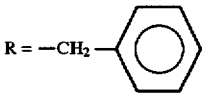
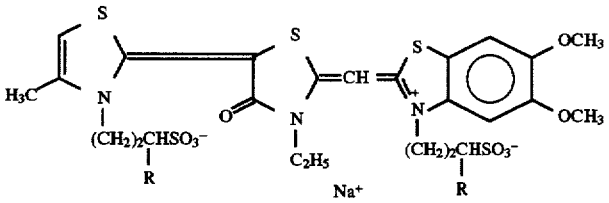
(IV-5) $R = C_2H_5$
(IV-6)
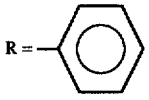
(IV-7) $R = CH_2CH{=}CH_2$
(IV-8)
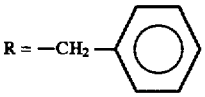

-continued
(IV-9)
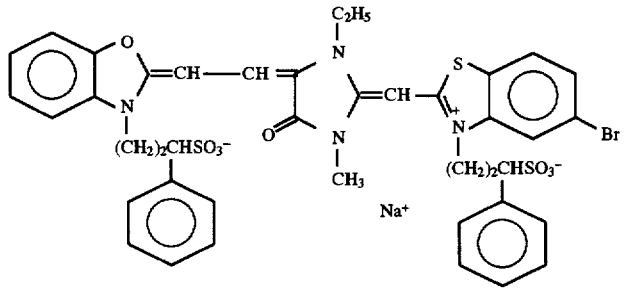
(IV-10)
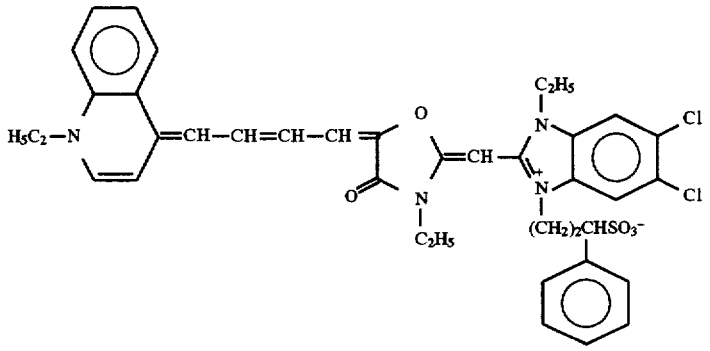
(IV-11)
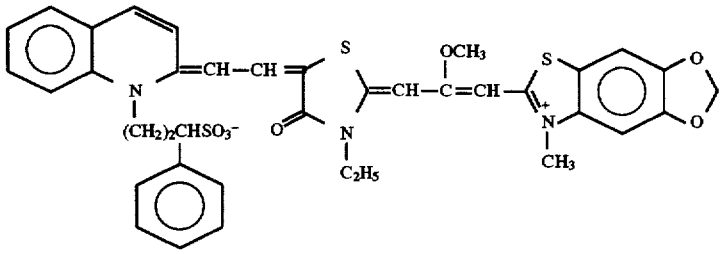
(IV-12)
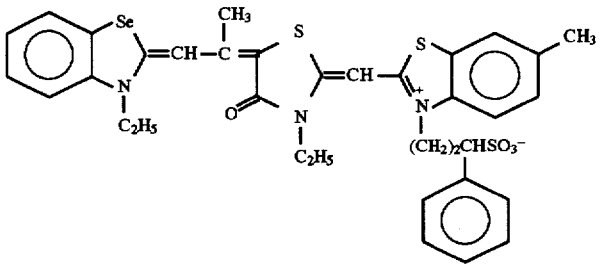
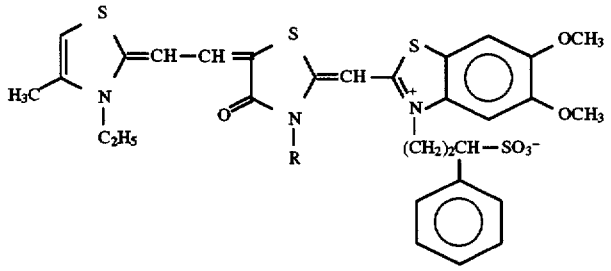
(IV-13)
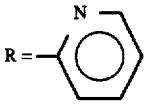

-continued (IV-14)

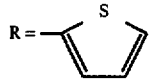

(IV-15)

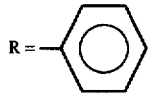

(IV-16)

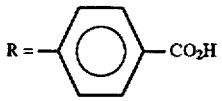

Specific Examples of Compounds of Formula (I)

(I-1)

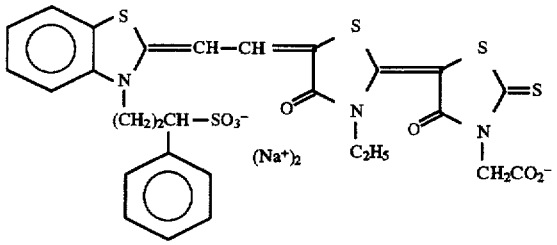

(I-2)

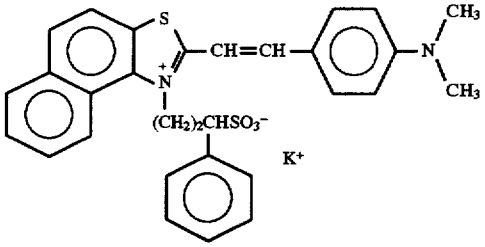

(I-3)

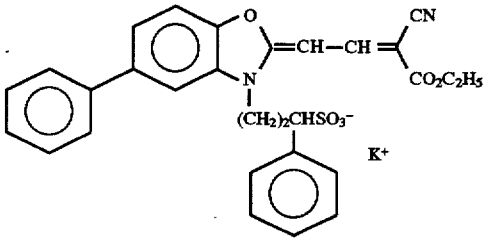

(I-4)

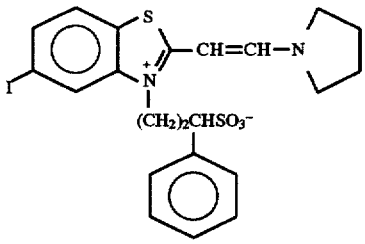

The compounds of Formula (I) according to the present invention can be prepared by methods as disclosed in, for instance, F. M. Harmer, "Heterocyclic Compounds-Cyanine Dyes and Related Compounds", John Wiley & Sons Company, N.Y., London, 1964; D. M. Sturmer, "Heterocyclic Compounds-Special Topics in Heterocyclic Chemistry", Section 18, 14th Clause, pp. 482–515, John Wiley & Sons Company, N.Y., London, 1977; and "Rodd's Chemistry of Carbon Compounds", 2nd Ed., Vol. IV, part B, 1977, 15th Section, pp. 369–422, Elsevier Science Publishing Company Inc., N.Y.

PREPARATION EXAMPLE 1

(Preparation of Compound II-1)

Compound II-1 was prepared according to the following reaction scheme:

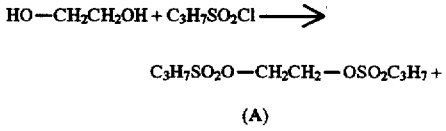

(A)

-continued

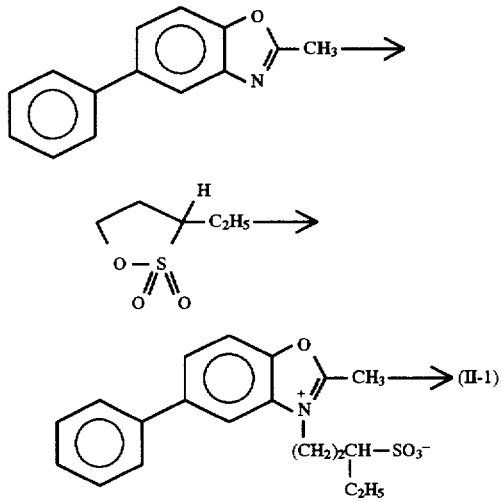

(B)

a) Preparation of 1-Ethyl-1,3-Propanesultone

A mixture of 68 g (1.09 mole) of ethylene glycol, 343.2 g (2.406 mole) of propylsulfonyl chloride and 650 ml of dichloromethane was cooled in dry ice/acetone with stirring and then 335.4 ml (2.406 mole) of triethylamine was dropwise added to the cooled mixture over 25 minutes. The temperature of the mixture was maintained at a level of not more than −10° C. After stirring at room temperature for additional 4 hours, the reaction solution was poured into 1 l of water, followed by separating the resulting dichloromethane phase, drying the phase over magnesium sulfate and removal of the solvent through distillation under reduced pressure to give 287 g (yield: 96%) of a colorless liquid (A). A mixture of 200 g (0.729 mole) of the liquid (A) and 2 l of tetrahydrofuran was cooled to −78° C. with stirring and then 464 ml (0.765 mole) of a 1.65 mole/l n-butyl lithium solution was dropwise added to the mixture over 30 minutes. Moreover, the mixture was then stirred at −15° C. for additional one hour and the reaction solution was added to a mixture of ethyl acetate/water (3 l/1.5 l) to thus separate the resulting ethyl acetate phase. The ethyl acetate phase was dried over magnesium sulfate, followed by removal of the solvent through distillation under reduced pressure and then distillation of the resulting residue under reduced pressure to give 53 g (yield: 48%) of 1-ethyl-1,3-propanesultone as a colorless liquid (having a boiling range of 115°–122° C./2 mmHg).

b) Synthesis of Quaternary Salt

A mixture of 4 g (0.019 mole) of 5-phenyl-2-methylbenzoxazole and 3.4 g (0.023 mole) of 1-ethyl-1,3-propanesultone was heated, with stirring, for 2 hours on an oil bath maintained at 150° C. Then 50 ml of ethyl acetate was added to the reaction solution with stirring, followed by separation of the resulting crystals through aspiration filtration after the temperature of the reaction solution reached room temperature and then drying the crystals to give 6.75 g (yield: 99%) of a product (B) as colorless powder (m.p. 265°–270° C.).

c) Synthesis of Compound II-1

A mixture of 6.75 g (0.019 mole) of the product (B), 17 ml (0.0845 mole) of ethyl ester of orthopropionic acid, 11 ml of acetic acid and 11 ml of pyridine was heated with stirring on an oil bath maintained at 140° C., then 7 ml (0.05 mole) of triethylamine was added to the mixture and the resulting mixture was heated for 2 hours with stirring. Then 100 ml of ethyl acetate was added to the reaction solution with stirring, followed by separation of the resulting crystals through aspiration filtration after the temperature of the reaction solution reached room temperature. The resulting crystals were dissolved in 50 ml of methanol, a solution of 0.9 g of potassium acetate in 20 ml of methanol was added to the solution and the resulting crystals were filtered off through aspiration filtration. Moreover, the crystals were dissolved in 50 ml of methanol by refluxing with heating, followed by separation through gravitational filtration, distilling off about 20 ml of the solvent present in the resulting filtrate under ordinary pressure and allowing to cool till the temperature of the filtrate reached room temperature. The crystals precipitated from the filtrate were separated through aspiration filtration and then dried to give 0.85 g (yield: 11.4%) of Compound II-1 as red powder (λmax: 502 nm; ε: 143000 (methanol); m.p. not less than 220° C. (decomposed)).

PREPARATION EXAMPLE 2

(Synthesis of Compound II-2)

Compound II-2 was prepared according to the following reaction scheme:

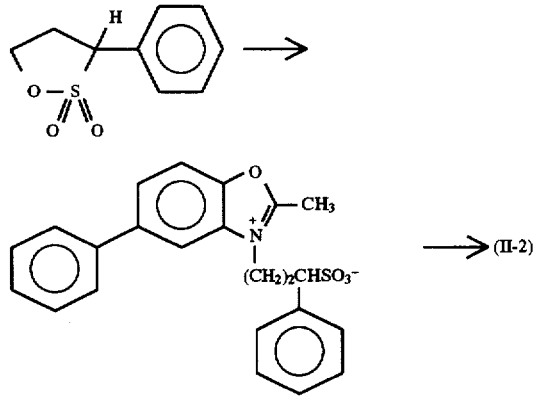

(C)

a) Preparation of 1-Phenyl-1,3-Propanesultone

The same procedures used in the step a) of Preparation Example 1 were repeated except that benzylsulfonyl chloride was substituted for the propylsulfonyl chloride to give the title compound.

b) Synthesis of Quaternary Salt

A mixture of 2.5 g (0.012 mole) of 5-phenyl-2-methylbenzoxazole and 2.6 g (0.013 mole) of 1-phenyl-1,3-propanesultone was heated, with stirring, for 4 hours on an oil bath maintained at 150° C. Then 50 ml of ethyl acetate was added to the reaction solution with stirring, followed by separation of the resulting crystals through aspiration filtration after the temperature of the reaction solution reached room temperature and then drying the crystals to give 4.84 g (yield: 100%) of a product (C) as colorless powder (m.p. not less than 300° C.).

c) Synthesis of Compound II-2

The same procedures used in the step c) of Preparation Example 1 were repeated except that the product (C) was substituted for the product (B) and that sodium acetate was substituted for the potassium acetate to give Compound II-2 (red powder; yield: 7%; λmax: 505 nm; ε: 146000 (methanol); m.p. 195°–200° C.).

In the silver halide photographic light-sensitive material of the present invention, the spectral sensitizing dye represented by the general formula (I) is preferably added to the material in an amount ranging from $0.5\times10^{-6}$ to $1.0\times10^{-2}$ mole and more preferably $1.0\times10^{-5}$ to $5.0\times10^{-3}$ mole per mole of silver halide present therein.

The sensitizing dye may be added to the material during forming the silver halide grains, during the chemical sensitization process or during coating the resulting emulsion.

In particular, the addition of the sensitizing dye during the formation of the silver halide grains can be performed while referring to the methods disclosed in U.S. Pat. Nos. 4,225,666 and 4,828,972 and J.P. KOKAI No. Sho 61-103149. Moreover, the addition of the sensitizing dye during desalinization of the silver halide emulsion can be carried out with reference to the methods disclosed in European Patent No. 291,339-A and J.P. KOKAI No. Sho 64-52137. In addition, the addition thereof during the chemical sensitization process can be carried out with reference to the method disclosed in J.P. KOKAI No. Sho 59-48756.

As methods for improving the sensitivity by the spectral sensitization through the use of sensitizing dyes, there have been known those in which a combination of at least two sensitizing dyes is used. When using a combination of at least two sensitizing dyes, the resulting spectral sensitivity may often be intermediate between those observed for the sensitizing dyes separately used or lower than those observed for these dyes, but the use of a certain specific combination may sometimes permit improvement of the spectral sensitivity, as compared with those achieved by individual sensitizing dyes used in combination. This phenomenon is in general referred to as the supersensitization effect. The supersensitization effect is detailed in, for instance, W. West & P. B. Gilman, "The Theory of the Photographic Process", 10th Section, edited by T. H. James, 4th Edition, Macmillan, N.Y., 1977.

The use of such combinations of sensitizing dyes results in spectral sensitization wavelengths intermediate between those observed for the sensitizing dyes separately used or simple combination thereof, but the spectral sensitization wavelengths may sometimes be shifted to wavelengths which cannot be predicted by the spectral sensitization properties of the individual sensitizing dyes used in combination.

There has been desired for the discovery of combinations of sensitizing dyes which can ensure spectral sensitivity substantially higher than those achieved by the individual sensitizing dyes separately used and which have sensitization wavelength regions adapted for the desired applications of the resulting photographic light-sensitive materials and this is the major problem to be solved in the spectral sensitization technique for the silver halide photographic emulsions.

Combinations of sensitizing dyes used for the achievement of the supersensitization effect require strict selectivity between the dyes to be combined. More specifically, the supersensitization effect would substantially be affected by only a slight difference between the chemical structures of the dyes to be combined and accordingly, it is difficult to predict any particular combination simply on the basis of the chemical structural formulae of sensitizing dyes used in combination.

It is also possible to use, as the supersensitizing agents, dyes which are free of the spectral sensitization effect in itself or substances which do not substantially absorb visible light rays. For instance, the light-sensitive material may comprise aminostyryl compounds replaced with nitrogen atom-containing heterocyclic groups (such as those disclosed in U.S. Pat. Nos. 2,933,390 and 3,635,721); aromatic organic acid-formaldehyde condensates (such as those disclosed in U.S. Pat. No. 3,743,510); cadmium salts and azaindene compounds. Particularly preferred are combinations as disclosed in U.S. Pat. Nos. 3,615,613, 3,615,641, 3,617,295 and 3,635,721.

The steps for the preparation of a silver halide emulsion are roughly divided into, for instance, a grain-forming step, a desalinization step and a chemical sensitization step. The grain-forming step is further divided into, for instance, a nucleation step, a ripening step and a growing step. These steps are not necessarily carried out in this order, but they may be carried out in the reversed order or certain steps may be repeatedly carried out. If a reduction sensitization preferably used in the present invention is carried out during the process for preparing a silver halide emulsion, the sensitization may basically be carried out in any step. The reduction sensitization step may be carried out during the nucleation step which is an initial step for the formation of the silver halide grains, during the physical ripening step or during growing the grains, or it may be carried out prior to or after chemical sensitization steps other than the reduction sensitization step. In this respect, if gold sensitization is simultaneously carried out, the reduction sensitization step is preferably carried out prior to the chemical sensitization steps to prevent any undesired fogging. Most preferably, the reduction sensitization is carried out during growing the silver halide grains. The term "during growing" herein used means that the reduction sensitization also includes a method in which the reduction sensitization is performed during physical ripening of the silver halide grains or during growing the grains through addition of a water-soluble silver salt and a water-soluble alkali halide and a method in which the growing of the silver halide grains is temporarily terminated, then the grains are subjected to reduction sensitization and the grains are again ripened.

The reduction sensitization preferably used in the present invention includes, for instance, a method which comprises adding a known reducing agent to the silver halide emulsion; a method comprising growing or ripening the silver halide grains in an Ag atmosphere having a low pAg ranging from 1 to 7, which is referred to as "the silver ripening"; and a method comprising growing or ripening the grains in an atmosphere having a high pH ranging from 8 to 11, which is called the high pH ripening. At least two of these methods may be used in combination.

The method for adding a reduction sensitizing agent is preferred in that the method permits any delicate control of the level of the reduction sensitization.

As the reduction sensitizing agents, there have been known, for instance, stannous salts, amines and polyamines, hydrazine derivatives, formamidinesulfinic acid, silane compounds and borane compounds. The reduction sensitizing agents used in the present invention may be selected from known compounds. Moreover, at least two of these compounds may also be used in combination. Examples of preferred reduction sensitizing agents are stannous chloride, thiourea dioxide and dimethylamine borane. More preferably, the reduction sensitizing agents may be selected from alkynylamine compounds described in U.S. Pat. No. 5,389,510. The amount of the reduction sensitizing agent may vary depending on the conditions for the preparation of the emulsion and therefore, it must be appropriately selected, but the amount thereof suitably ranges from $10^{-7}$ to $10^{-3}$ mole per mole of the silver halide.

It is also possible to use ascorbic acid and derivatives thereof as the reduction sensitizing agents used in the present invention.

Specific examples of such ascorbic acid and derivatives thereof (hereinafter referred to as "ascorbic acid compounds") are as follows:

(A-1) L-ascorbic acid
(A-2) sodium L-ascorbate
(A-3) potassium L-ascorbate
(A-4) DL-ascorbic acid
(A-5) sodium D-ascorbate
(A-6) L-ascorbic acid-6-acetate
(A-7) L-ascorbic acid-6-palmitate
(A-8) L-ascorbic acid-6-benzoate
(A-9) L-ascorbic acid-5,6-diacetate
(A-10) L-ascorbic acid-5,6-O-isopropilidene The ascorbic acid compounds used in the present invention is desirably employed in an amount greater than that of the conventional reductiuon sensitizing agent preferably used. For instance, J.P. KOKOKU No. Sho 57-33572 discloses that "in general, the amount of the reduction sensitizing agent does not exceed $0.75\times10^{-2}$ meq. per gram of silver ions ($8\times10^{-4}$ mole/mole of AgX) and in most of cases, the reduction sensitizing agent is effectively used in an amount ranging from 0.1 to 10 mg per kg of silver halide ($10^{-7}$ to $10^{-5}$ mole/mole of AgX as expressed in terms of the amount of ascorbic acid)"(the reduced amounts are calculated by the inventors). Moreover, U.S. Pat. No. 2,487,850 discloses that "when using a tin compound as a reduction sensitizing agent, it can be used in an amount ranging from $1\times10^{-7}$ to $44\times10^{-6}$ mole". I n addition, J.P. KOKAI No. Sho 57-179835 discloses that the amount of thiourea dioxide suitably ranges from about 0.01 to about 2 mg per mole of silver halide and that of stannous chloride suitably ranges from about 0.01 to about 3 mg per mole of silver halide. The preferred amount of the ascorbic acid compound used in the present invention varies depending on various factors such as the particle size of the silver halide emulsion, the halogen composition of the grains, the temperature adopted for preparing the emulsion, pH and pAg, but preferably ranges from $5\times10^{-5}$ to $1\times10^{-1}$ mole per mole of silver halide. More preferably, it ranges from $5\times10^{-4}$ to $1\times10^{-2}$ mole, in particular, $1\times10^{-3}$ to $1\times10^{-2}$ mole per mole of silver halide.

The reduction sensitizing agent may be dissolved in a solvent such as water, an alcohol, a glycol, a ketone, an ester or an amide and then added to the emulsion during forming silver halide grains or prior to or after chemical sensitization. The reduction sensitizing agent may be added thereto in any step for the emulsion-producing process, but it is most preferably added during growing the silver halide grains. It may be added to a reaction container in advance, but it is preferably added at a proper time during the formation of silver halide grains. It is also possible to add, in advance, the reduction sensitizing agent to an aqueous solution of a water-soluble silver salt or a water-soluble alkali halide and then the silver halide grains may be formed using these aqueous solutions. Moreover, the solution of the reduction sensitizing agent may be added in several portions as the silver halide grains are formed or may continuously be added over a long period of time.

An agent for oxidizing silver is preferably used during the process for preparing the emulsion of the present invention. The agent for oxidizing silver herein means a compound which can act on elemental silver to convert it into silver ions. In particularly, effectively used herein is a compound which can convert, into silver ions, very fine elemental silver particles simultaneously formed during the step for forming silver halide grains and during the chemical sensitization step. The silver ions thus formed may be in the form of a silver salt hardly soluble in water such as silver halides, silver sulfide and silver selenide, or may form a silver salt easily soluble in water such as silver nitrate. The agent for oxidizing silver may be an inorganic or organic compound. Examples of inorganic silver-oxidizing agents are ozone, hydrogen peroxide and adducts thereof (such as $NaBO_2.H_2O_2.3H_2O$, $2Na_2CO_3.H_2O_2.Na_4P_2O_7.2H_2O_2$ and $2Na_2SO_4.H_2O_2.2H_2O$); oxyacid salts, for instance, salts of peroxy acids (such as $K_2S_2O_8$, $K_2C_2O_6$ and $K_2P_2O_8$), peroxy complex compounds (such as $K_2(Ti(O_2)C_2O_4).3H_2O$, $4K_2SO_4$. $Ti(O_2)OH.SO_4.2H_2O$ and $Na_3(VO(O_2)(C_2H_4)_2.6H_2O)$, perchromates (such as $KMnO_4$), chromates (such as $K_2Cr_2O_7$); elemental halogens such as iodine and bromine; perhalogeno-acid salts (such as potassium periodate); salts of metals having high valencies (such as potassium hexacyanoferrate); and thiosulfonic acid salts. On the other hand, examples of organic silver-oxidizing agents include quinones such as p-quinone, organic peracids such as peracetic acid and perbenzoic acid, and compounds capable of releasing active halogen atoms (such as N-bromosuccinimide, Chloramine T and Chloramine B).

Preferred examples of the silver-oxidizing agents further include disulfide compounds as disclosed in EP0627657A2.

Furthermore, examples of oxidizing agents preferably used in the present invention are ozone, hydrogen peroxide and adducts thereof, elemental halogens, inorganic oxides of thiosulfonic acid and organic oxidizing agents such as quinones. It is preferred to simultaneously use the foregoing reduction sensitizing agent and the silver-oxidizing agent, in the present invention. These agents may be used by a method in which the oxidizing agent is used prior to the reduction sensitization, a method which comprises using the reduction sensitizing agent prior to the use of the oxidizing agent or a method in which these agents are simultaneously used. These methods may likewise be properly selected and used in either the silver halide grain-forming step or the chemical sensitization step.

The silver halide photographic light-sensitive material of the present invention preferably comprises at least one member selected from the group consisting of compounds represented by the following general formulae (XX), (XXI) and (XXII):

$$R_{101}—SO_2S—M_{101} \quad \text{[General Formula (XX)]}$$

$$R_{101}—SO_2S—R_{102} \quad \text{[General Formula (XXI)]}$$

$$R_{101}—SO_2S—(E)_aSSO_2—R_{103} \quad \text{[General Formula (XXII)]}$$

In these formulae, $R_{101}$, $R_{102}$ and $R_{103}$ each represents an aliphatic group, an armatic group or a heterocyclic group; $M_{101}$ represents a cationic ion, E represents a divalent coupling group and a is 0 or 1.

The compounds represented by the general formulae (XX), (XXI) and (XXII) will further be detailed below. If $R_{101}$, $R_{102}$ and $R_{103}$ each represents an aliphatic group, the aliphatic group is preferably an alkyl group having 1 to 22 carbon atoms or an alkenyl or alkynyl group having 2 to 22 carbon atoms, which may have substituents. Examples of alkyl groups are methyl, ethyl, propyl, butyl, pentyl, hexyl, octyl, 2-ethylhexyl, decyl, dodecyl, hexadecyl, octadecyl, cyclohexyl, isopropyl and t-butyl groups.

Examples of alkenyl groups include allyl and butenyl groups.

Examples of alkynyl groups include propargyl and butynyl groups.

If $R_{101}$, $R_{102}$ and $R_{103}$ each represents an aromatic group, the aromatic group is preferably selected from those having 6 to 20 carbon atoms such as phenyl and naphthyl groups. These aromatic groups may have substituents.

The heterocyclic groups represented by $R_{101}$, $R_{102}$ and $R_{103}$ are 3- to 15-membered rings each having at least one element selected from the group consisting of nitrogen, oxygen, sulfur, selenium and tellurium atoms such as pyrrolidine rings, piperidine rings, pyridine rings, tetrahydrofuran rings, thiophene rings, oxazole rings, thiazole rings, imidazole rings, benzothiazole rings, benzoxazole rings, benzimidazole rings, selenazole rings, benzoselenazole rings, tellurazole rings, triazole rings, benzotriazole rings, tetrazole rings, oxadiazole rings and thiadiazole rings.

Examples of substituents for $R_{101}$, $R_{102}$ and $R_{103}$ are alkyl groups such as methyl, ethyl and hexyl groups; alkoxy groups such as methoxy, ethoxy and octyloxy groups; aryl groups such as phenyl, naphthyl and tolyl groups; hydroxyl group; halogen atoms such as fluorine, chlorine, bromine and iodine atoms; aryloxy groups such as phenoxy group; alkylthio groups such as methylthio and butylthio groups; arylthio groups such as phenylthio group; acyl groups such as acetyl, propionyl, butyryl and valeryl groups; sulfonyl groups such as methylsulfonyl and phenylsulfonyl groups; acylamino groups such as acetylamino and benzamino groups; sulfonylamino groups such as methanesulfonylamino and benzenesulfonylamino groups; acyloxy groups such as acetoxy and benzoxy groups; carboxyl groups; cyano groups; sulfo groups; and amino groups.

Examples of E's are preferably divalent aliphatic groups and divalent aromatic groups. Specific examples of divalent aliphatic groups are $-(CH_2)_n-$(n=1 to 12), $-CH_2-CH=CH-CH_2-$, $CH_2-C\equiv C-CH_2-$, a group represented by the following formula:

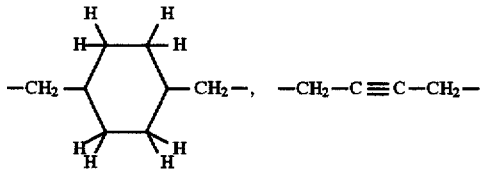

and xylylene group. Examples of divalent aromatic groups represented by E are phenylene and naphthylene groups.

These substituents may further be substituted with substituents such as those represented by V as has already been described above.

Examples of preferred $M_{101}$'s are metal ions and organic cations. Specific examples of metal ions are lithium, sodium and potassium ions, while specific examples of organic cations are ammonium ions (such as ammonium, tetramethylammonium and 10 tetrabutylammonium ions), phosphonium ions (such as tetraphenylphosphonium ion) and guanidine group.

Specific examples of the compounds represented by the general formulae (XX), (XXI) and (XXII) are as follows, but the present invention is not restricted to these specific examples.

$CH_3SO_2SNa$ (XX-1)

$C_2H_5SO_2SNa$ (XX-2)

$C_3H_7SO_2SK$ (XX-3)

$C_4H_9SO_2SLi$ (XX-4)

$C_6H_{13}SO_2SNa$ (XX-5)

$C_8H_{17}SO_2SNa$ (XX-6)

-continued $CH_3(CH_2)_3CH(C_2H_5)CH_2SO_2S.NH_4$ (XX-7)

$C_{10}H_{21}SO_2SNa$ (XX-8)

$C_{12}H_{25}SO_2SNa$ (XX-9)

$C_{16}H_{33}SO_2SNa$ (XX-10)

$(CH_3)_2CH-SO_2SK$ (XX-11)

$t\text{-}C_4H_9SO_2SNa$ (XX-12)

$CH_3OCH_2CH_2SO_2S.Na$ (XX-13)

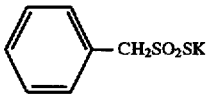

(XX-14)

$CH_2=CHCH_2SO_2SNa$ (XX-15)

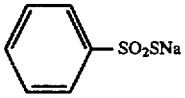

(XX-16)

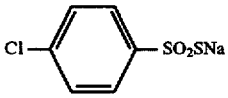

(XX-17)

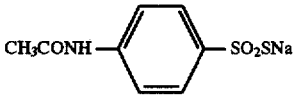

(XX-18)

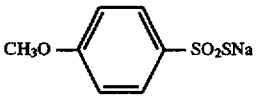

(XX-19)

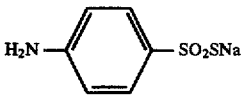

(XX-20)

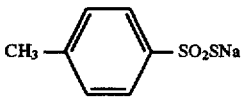

(XX-21)

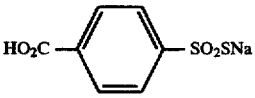

(XX-22)

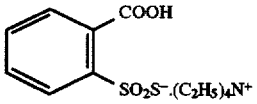

(XX-23)

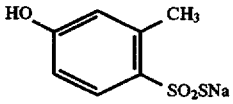

(XX-24)

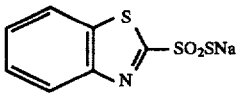

(XX-25)

-continued
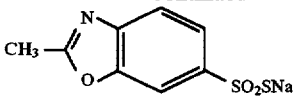
(XX-26)
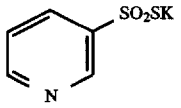
(XX-27)
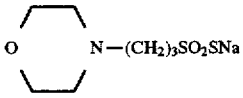
(XX-28)
$KSSO_2(CH_2)_2SO_2SK$ (XX-29)
$NaSSO_2(CH_2)_4SO_2SNa$ (XX-30)
$NaSSO_2(CH_2)_4S(CH_2)_4SO_2SNa$ (XX-31)
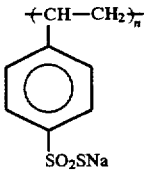
(XX-32)
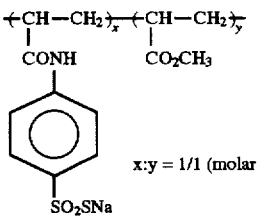
x:y = 1/1 (molar ratio)
(XX-33)
$C_2H_5SO_2S-CH_3$ (XXI-1)
$C_8H_{17}SO_2SCH_2CH_3$ (XXI-2)
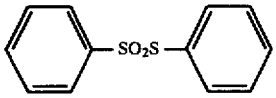
(XXI-3)
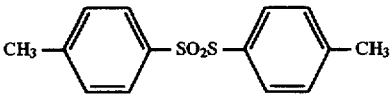
(XXI-4)
$C_2H_5SO_2SCH_2CH_2CN$ (XXI-5)
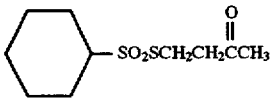
(XXI-6)
$C_4H_9SO_2SCHCH_2CN$ (XXI-7)
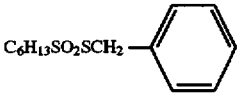
(XXI-8)
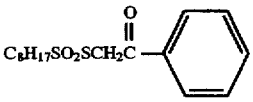
(XXI-9)
-continued
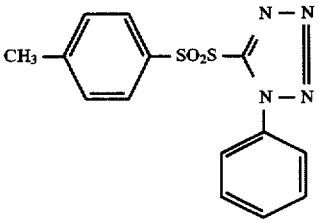
(XXI-10)
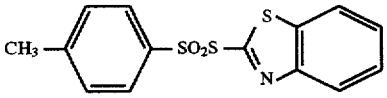
(XXI-11)
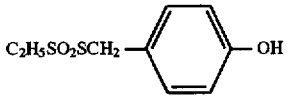
(XXI-12)
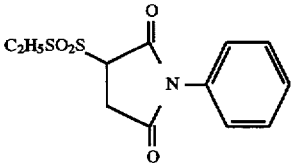
(XXI-13)
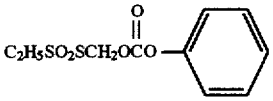
(XXI-14)
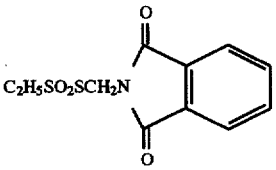
(XXI-15)
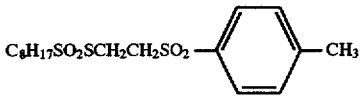
(XXI-16)
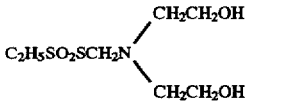
(XXI-17)
$C_2H_5SO_2SCH_2CH_2CH_2CH_2OH$ (XXI-18)
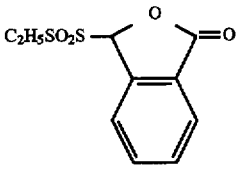
(XXI-19)
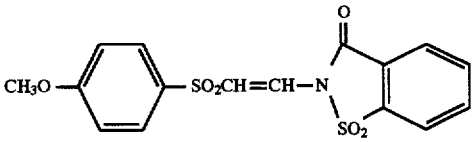
(XXI-20)
$CH_3SSO_2(CH_2)_4SO_2SCH_3$ (XXI-21)
$CH_3SSO_2(CH_2)_2SO_2SCH_3$ (XXI-22)

-continued

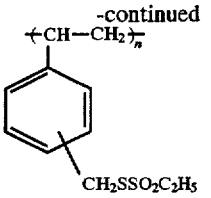

(XXI-23)

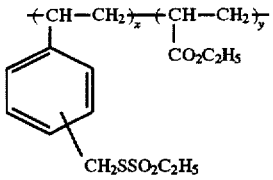

(XXI-24)

x:y = 2/1 (molar ratio)

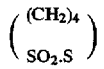

(XXI-25)

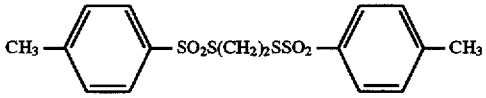

(XXII-1)

$C_2H_5SO_2SCH_2CH_2SO_2CH_2CH_2SSO_2C_2H_5$ (XXII-2)

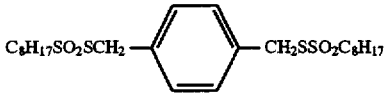

(XXII-3)

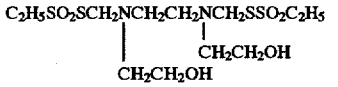

(XXII-4)

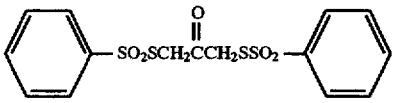

(XXII-5)

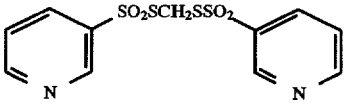

(XXII-6)

$C_2H_5SO_2SSSO_2C_2H_5$ (XXII-7)

$(n)C_3H_7SO_2SSSO_2C_3H_7(n)$ (XXII-8)

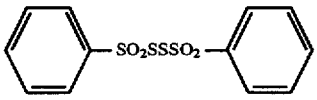

(XXII-8)

The compounds represented by Formula (XX) can easily be prepared by the methods disclosed in J.P. KOKAI No. Sho 54-1019 and U.K. Patent No. 972,211.

The compound represented by Formula (XX), (XXI) or (XXII) is preferably added to the silver halide emulsion in an amount ranging from $10^{-7}$ to $10^{-1}$ mole, more preferably $10^{-6}$ to $10^{-2}$ mole and particularly preferably $10^{-5}$ to $10^{-3}$ mole per mole of silver halide.

The addition of the compounds represented by Formulae (XX), (XXI) and (XXII) to the emulsion during production thereof can be carried out according to the methods usually adopted when additives are incorporated into a photographic emulsion. For instance, water-soluble compounds are dissolved in water to give aqueous solutions each having an appropriate concentration or compounds insoluble or hardly soluble in water are dissolved in an appropriate water-miscible organic solvent such as alcohols, glycols, ketones, esters or amides which do not adversely affect photographic properties of the resulting emulsion to give organic solutions and the resulting solutions are then added to the emulsion.

The compounds of Formula (XX), (XXI) or (XXII) may be added to the emulsion in any production stage during forming the silver halide grains present in the emulsion or prior to or after the chemical sensitization. Preferably, the compound is added prior to or during the reduction sensitization. Particularly preferably, it is added to the emulsion during growing the silver halide grains.

The compound may be added to a reaction container in advance, but it is preferably added at a proper time during the formation of silver halide grains. It is also possible to add, in advance, the compounds of Formula (XX), (XXI) or (XXII) to an aqueous solution of a water-soluble silver salt or a water-soluble alkali halide and then the silver halide grains may be formed using these aqueous solutions. Moreover, the solution of the compounds of Formula (XX), (XXI) or (XXII) may be added in several portions as the silver halide grains are formed or may continuously be added over a long period of time.

Among the compounds represented by Formulae (XX), (XXI) and (XXII), most preferably used in the present invention are those represented by Formula (XX).

The light-sensitive material of the present invention is not restricted to any specific one and may be, for instance, color negative materials, color positive materials, monochromatic light-sensitive materials, and negative and positive films for motion pictures. More specifically, it is sufficient that the light-sensitive material comprises a substrate provided thereon with at least one light-sensitive layer. Typical examples of the light-sensitive materials are silver halide photographic light-sensitive materials each comprising a substrate provided thereon with at least one light-sensitive layer which comprises a plurality of silver halide emulsion layers whose color sensitivities are substantially identical to one another and whose light-sensitivities are different from one another. The light-sensitive layer is a unit light-sensitive layer having color sensitivity to either of blue, green and red light rays. In the multilayered silver halide color photographic light-sensitive material, the unit light-sensitive layers are arranged in such a manner that the red-sensitive, green-sensitive and blue-sensitive layers are formed on the substrate in this order from the side of the substrate. Alternatively, these layers may be arranged in the reverse order or may be arranged in such an order that light-sensitive layers having the same color sensitivity sandwich a light-sensitive layer having different light-sensitivity. Light-insensitive layers may be formed between the foregoing silver halide light-sensitive layers and as the uppermost and lowermost layers. These layers may comprise, for instance, couplers, DIR compounds and color mixing inhibitors as will be detailed below. In a plurality of silver halide emulsion layers which constitute each unit light-sensitive layer, it is preferred that two layers, i.e., a high sensitive emulsion layer and a low sensitive emulsion layer are arranged in the order of decreasing light sensitivity towards the substrate as disclosed in DE 1,121,470 or GB 923,045. Moreover, it is also possible to locate the low sensitive emulsion layer far away from the substrate and to locate the high sensitive emulsion layer near the substrate as disclosed in J.P. KOKAI Nos. Sho 57-112751, Sho 62-200350, Sho 62-206541 and Sho 62-206543.

Specific examples are those comprising, in the order from the side most distant from the substrate, low sensitive blue-sensitive layer (BL)/high sensitive blue-sensitive layer (BH)/high sensitive green-sensitive layer (GH)/low sensitive green-senitive layer (GL)/high sensitive red-sensitive layer (RH) /low sensitive red-sensitive layer (RL); BH/BL/GL/GH/RH/RL; or BH/BL/GH/GL/RL/RH.

In addition, these layers may be arranged in the order of blue-sensitive layer/GH/RH/GL/RL from the side most distant from the substrate as disclosed in J.P. KOKOKU No. Sho 55-34932. Alternatively, it is also possible to arrange these layers in the order of blue-sensitive layer/GL/RL/GH/RH from the side most distant from the substrate as disclosed in J.P. KOKAI Nos. Sho 56-25738 and Sho 62-63936.

Moreover, specific examples thereof also include those comprising 3 layers having different light sensitivities which are gradually reduced towards the substrate, i.e., those comprising a silver halide emulsion layer having the highest light sensitivity as the uppermost layer, a silver halide emulsion layer having a light sensitivity lower than that of the uppermost layer as the intermediate layer and a silver halide emulsion layer having a light sensitivity lower than that of the intermediate layer as the lowermost layer, as disclosed in J.P. KOKOKU No. Sho 49-15495. In case of a light-sensitive material comprising such 3 layers having different light sensitivities, a medium sensitive emulsion layer/high sensitive emulsion layer/low sensitive emulsion layer may be arranged in this order from the side distant apart from the substrate in the same color sensitive layer as disclosed in J.P. KOKAI No. Sho 59-202464.

Alternatively, they may be arranged in the order of high sensitive emulsion layer/low sensitive emulsion layer/medium sensitive emulsion layer, or low sensitive emulsion layer/medium sensitive emulsion layer/high sensitive emulsion layer. In case of a light-sensitive material comprising not less than 4 layers, the arrangement thereof may be changed in the manner similar to that described above.

It is preferred to arrange a donor layer (CL) having the interlayer effect and whose spectral sensitivity distribution differs from that of a principal light-sensitive layer such as BL, GL and RL adjacent to or in the proximity to the latter, in order to improve the color reproduction, as disclosed in U.S. Pat. Nos. 4,663,271, 4,705,744 and 4,707,436 and J.P. KOKAI Nos. Sho 62-160448 and Sho 63-89850.

The silver halide preferably used in the present invention is silver iodobromide, silver iodochloride or silver iodochlorobromide which comprises not more than about 30 mole % of silver iodide. Particularly preferred is silver iodobromide or silver iodochlorobromide comprising silver iodide in an amount ranging from about 2 to about 10 mole %.

The silver halide grains present in the photographic emulsion may be those having regular crystal forms such as cubic, octahedral and tetradecahedral forms; those having irregular crystal forms such as spherical and plate-like forms; those having crystalline defects such as twin crystal planes; or those having composite forms thereof.

The silver halide grains may be fine particles having a grain size of not more than about 0.2 μm or grains of a large grain size having a diameter on the projected area of up to about 10 μm, or the silver halide grains may be in the form of a multidisperse emulsion or monodisperse emulsion.

The silver halide photographic emulsion used in the present invention can be prepared using methods as disclosed in, for instance, Research Disclosure (hereinafter referred to as "RD"), No. 17643 (1978, Dec.), pp. 22-23, in the section entitled "I. Emulsion Preparation and Types", RD, No. 18716 (1979, Nov.), p. 648 and RD, No. 307105 (1989, Nov.), pp. 863–865; P. Glafkides, Chemie et Phisique Photographique, Paul Montel, 1967; G. F. Duffin, Photographic Emulsion Chemistry, Focal Press, 1966; V. L. Zelikman et al., Making and Coating Photographic Emulsion, Focal Press, 1964.

It is also preferred to use monodisperse emulsions disclosed in U.S. Pat. Nos. 3,574,628 and 3,655,394 and U.K. Patent No. 1,413,748.

Moreover, plate-like grains having an aspect ratio of not less than about 3 may likewise be used in the present invention. Such plate-like grains can easily be prepared by the methods disclosed in Gutoff, Photographic Science and Engineering, 1970, 14, pp. 248–257; U.S. Pat. Nos. 4,434,226, 4,414,310, 4,433,048 and 4,439,520 and U.K. Patent No. 2,112,157.

The silver halide grains may have uniform crystal structures, those in which the inner part has a halogen composition different from that of the outer part or those having lamellar structure. The silver halide grains may be those comprising silver halide grains having different compositions which are joined together through epitaxial junction. For instance, the silver halide grains may be joined to compounds other than silver halides such as silver rhodanate and lead oxide. Moreover, a mixture of a variety of grains having various crystal forms may also be used in the present invention.

The foregoing emulsion may be either the superficially latent image-forming type one in which latent images are mainly formed on the surface or the internally latent image-forming type one in which latent images are mainly formed within silver halide grains, but should be a negative-working emulsion. The internally latent image-forming type emulsion may be a core/shell internally latent image-forming type one disclosed in J.P. KOKAI No. Sho 63-264740, which can be prepared by the method disclosed in J.P. KOKAI No. Sho 59-133542. The thickness of the shell of the emulsion varies depending on the kinds of development treatments, but preferably ranges from 3 to 40 nm, in particular, 5 to 20 nm.

The silver halide emulsion is generally used after subjecting to physical ripening, chemical ripening and spectral sensitization. Additives used in such processes are disclosed in, for instance, RD, Nos. 17643, 18716 and 307105 and the related parts of these references are summarized in the Table 1 given later.

The light-sensitive material of the present invention may comprise, in the same layer, at least two kinds of the foregoing emulsions, in combination, which differ in at least one characteristic properties such as the grain size, grain size distribution, halogen composition, shapes of grains and sensitivity of the light-sensitive silver halide emulsions.

It is preferred to use the silver halide grains whose surface is fogged as disclosed in U.S. Pat. No. 4,082,553; the silver halide grains internal portion of which is fogged as disclosed in U.S. Pat. No. 4,626,498 and J.P. KOKAI No. Sho 59-214852; and colloidal silver in light-sensitive silver halide emulsion layers and/or substantially light-insensitive hydrophilic colloidal layers. The term "silver halide grains whose surface or internal portion is fogged" herein used means silver halide grains which permit uniform (non-imagewise) development of a light-sensitive material irrespective of whether it is exposed to light or not and methods for preparing the grains are disclosed in, for instance, U.S. Pat. No. 4,626,498 and J.P. KOKAI No. Sho 59-214852. The silver halide, which forms the internal nuclei of internally fogged core-shell type silver halide grains, may have a silver halide composition different between the core and the shell. Silver halides used for forming internally or superficially fogged grains may be silver chloride, silver chlorobromide, silver iodobromide or silver chloroiodobromide. The average gain size of these fogged silver halide grains ranges from 0.01 to 0.75 μm and particularly preferably 0.05 to 0.6 μm.

The silver halide grains may have regular shapes or the silver halide emulsion may be multi-dispersed ones, but the emulsion is preferably a monodisperse one (at least 95% of the weight or number of the silver halide grains have a grain size falling within the average grain size±40%).

In the present invention, light-insensitive fine silver halide grains are preferably used. The term "light-insensitive fine silver halide grains" herein means fine silver halide grains, which are insensitive to light during imagewise exposure to light for obtaining dye images and are not substantially developed during the development treatment, and they are preferably unfogged in advance. The fine silver halide grains have a silver bromide content ranging from 0 to 100 mole % and may, if necessary, comprise silver chloride and/or silver iodide and they preferably comprise silver iodide in an amount ranging from 0.5 to 10 mole %. The silver halide fine grains preferably have an average gain size (the averaged diameter of projected areas approximated to corresponding circles) ranging preferably from 0.01 to 0.5 μm and more preferably 0.02 to 0.2 μm.

The fine silver halide grains can be prepared by a method similar to those for preparing usual light-sensitive silver halide grains. The surface of the silver halide grains must not be optically sensitized or are not necessarily spectrally sensitized. In this respect, however, it is preferred to add, in advance, a known stabilizer such as a triazole, azaindene, benzothiazolium or mercapto type compound or a zinc compound prior to the addition of the silver halide fine grains to a coating liquid. The fine silver halide grain-containing layer may comprise colloidal silver.

In the light-sensitive material of the present invention, the amount of silver to be coated is preferably not more than 6.0 $g/m^2$ and most preferably not more than 4.5 $g/m^2$.

Additives for photographs usable in the present invention are also disclosed in RD's, the related passages of which are listed in the following Table 1.

TABLE 1

| Kind of Additives | RD 17643 (12/1978) | RD 18716 (11/1979) | RD 307105 (11/1989) |
|---|---|---|---|
| 1. Chemical Sensitizers | p.23 | right col. on p.648 | p.866 |
| 2. Sensitivity Improvers | | right col. on p.648 | |
| 3. Spectral Sensitizers and Super-sensitizers | p.23–24 | right col. on p.648 to right col. on p.649 | p.866–868 |
| 4. Whitening Agents | p.24 | right on p.647 | p.868 |
| 5. Antifoggants, Stabilizers | p.24–25 | right col. on p.649 | p.868–870 |
| 6. Light Absorbers, Filter Dyes, UV Absorbers | p.25–26 | right col. on p.649 to left col. on p.650 | p.873 |
| 7. Stain-Inhibitors | right col. on p.25 | left to right col. on p.650 | p.872 |
| 8. Dye Image-Stabilizers | p.25 | left col. on p.650 | p.872 |
| 9. Film-Hardening Agents | p.26 | left col. on p.651 | p.874–875 |
| 10. Binders | p.26 | left col. on p.651 | p.873–874 |
| 11. Plasticizers, Lubricants | p.27 | right col. on p.650 | p.876 |
| 12. Coating aids, Surfactants | p.26–27 | right col. on p.650 | p.875–876 |
| 13. Antistatic Agents | p.27 | right col. on p.650 | p.876–877 |
| 14. Matting Agents | | | p.878–879 |

In the light-sensitive material of the present invention, various kinds of dye-forming couplers may be used, but particularly preferred are as follows:

Yellow Couplers: couplers represented by Formulae (I) and (II) disclosed in EP 502,424A; couplers represented by Formulae (1) and (2) disclosed in EP 513,496A (in particular, Y-28 disclosed on page 18); couplers represented by Formula (I) disclosed in claim 1 of EP 568,037A; couplers represented by the general formula (I) disclosed in the 1st column, lines 45 to 55 of U.S. Pat. No. 5,066,576; couplers represented by Formula (I) appearing in the paragraph 0008 of J.P. KOKAI No. Hei 4-274425; couplers disclosed in claim 1 of EP 498,381A1, on page 40 (in particular, D-35 disclosed on page 18); couplers represented by Formula (Y) disclosed on page 4 of EP 447,969A1, on page 40 (in particular, Y-1 and Y-54 disclosed on pages 17 and 41, respectively); and couplers represented by Formulae (II) to (IV) appearing in the 7th column, lines 36 to 58 of U.S. Pat. No. 4,476,219 (in particular, II-17, 19 (in the 17th column) and II-24 (in the 19th column)).

Magenta Couplers: those disclosed in J.P. KOKAI No. Hei 3-39737 (L-57 (right lower part on page 11), L-68 (right lower part on page 12) and L-77 (right lower part on page 13)); EP 456,257 ([A-4]-63 (on page 134) and [A-41]-73 and 75 (on page 139)); EP 486,965 (M-4, -6 (on page 6) and M-7 (on page 27)); EP 571,959A (M-45 (on page 19)); J.P. KOKAI No. Hei 5-204106 [(M-1) (on page 6)]; and J.P. KOKAI No. Hei 4-362631 (M-22 in the paragraph 0237).

Cyan Couplers: CX-1, 3, 4, 5, 11, 12, 14 and 15 (on pages 14 to 16) disclosed in J.P. KOKAI No. Hei 4-204843; C-7, -10 (on page 35), -34, -35 (on page 37), (I-1), (I-17) (on pages 42 to 43) disclosed in J.P. KOKAI No. Hei 4-43345; and those represented by Formula (Ia) or (Ib) disclosed in claim 1 of J.P. KOKAI No. Hei 6-67385.

Polymer Couplers: P-1 and P-5 (on page 11) disclosed in J.P. KOKAI No. Hei 2-44345.

Examples of couplers whose color-developing dyes have appropriate diffusibility are preferably those disclosed in U.S. Pat No. 4,366,237; GB 2,125,570; EP 96,873B; and DE 3,234,533.

Examples of couplers for correcting or eliminating unnecessary absorption of color-developing dyes are preferably yellow-colored cyan couplers represented by Formulas (CI), (CII), (CIII) and (CIV) disclosed in EP 456,257A1 (in particular, YC-86 on page 84); yellow-colored magenta couplers ExM-7 (on page 202), EX-1 (on page 246) and EX-7 (on page 251) disclosed in EP 456,257A1; magenta-colored cyan couplers CC-9 (in the 8th column), CC-13 (in the 10th column) disclosed in U.S. Pat. No. 4,833,069; the coupler (2) (in the 8th column) disclosed in U.S. Pat. No. 4,837,136; and colorless masking couplers represented by Formula (A) disclosed in claim 1 of WO 92/11575 (in particular, compounds illustrated on pages 36 to 45).

Examples of compounds (including couplers) which can release photographically useful residues of compounds through reactions with oxidized forms of developers are as follows: development inhibitor-releasing compounds such as those represented by Formulae (I), (II), (III) and (IV) disclosed in page 11 of EP 378,236A1 (in particular, T-101 (page 30), T-104 (page 31), T-113 (page 36), T-131 (page 45), T-144 (page 51) and T-158 (page 58)), compounds represented by Formula (I) disclosed on page 7 of EP 436,938A2 (in particular, D-49 (page 51)), compounds represented by Formula (I) disclosed in EP 568,037A (in particular, Compound (23) (page 11)) and compounds represented by Formulae (I), (II) and (III) disclosed in pages 5 to 6 of EP 440,195A2 (in particular, Compound I-(1) (page 29)); bleach accelerator-releasing compounds such as those represented by Formulae (I) and (II) disclosed on page 5 of EP 310,125A2 (in particular, Compounds (60) and (61) on page 61)) and compounds represented by Formula (I) disclosed in claim 1 of J.P. KOKAI No. Hei 6-59411 (in particular, Compound (7) on page 7); ligand-releasing compounds such as those represented by LIG-X disclosed in claim 1 of U.S. Pat. No. 4,555,478 (in particular, compounds listed in the 12th column, lines 21 to 41); leuco dye-releasing compounds such as Compounds 1 to 6 listed in the 3rd to 8th columns of U.S. Pat. No. 4,749,641; fluorescent dye-releasing compounds such as those represented by COUP-DYE disclosed in claim 1 of U.S. Pat. No. 4,774,181 (in particular, Compounds 1 to 11 listed in the 7th to 10th columns); development accelerator- or fogging agent-releasing compounds such as those represented by Formulae (1), (2) and (3) disclosed in the 3rd column of U.S. Pat. No. 4,656,123 (in particular, Compound (I-22) disclosed in the 25th column) and ExZK-2 disclosed, on page 75, lines 36 to 38, in EP 450,637A2; compounds capable of releasing groups which do not serve as dyes until they are released from the compounds; and compounds represented by Formula (I) disclosed in claim 1 of U.S. Pat. No. 4,857,447 (in particular, Compounds Y-1 to Y-19 listed in the 25th to 36th columns).

Preferred examples of additives other than couplers are as follows:

Dispersion Media for Oil-Soluble Organic Compounds: P-3, -5, -16, -19, -25, -30, -42, -49, -54, -55, -66, -81, -85, -86 and -93 (listed on pages 140 to 144).

Latexes for Impregnating Oil-Soluble Organic Compounds: latexes disclosed in U.S. Pat. No. 4,199,363.

Scavengers for Oxidized Forms of Developers: compounds represented by Formula (I) disclosed in the 2nd column, lines 54 to 62 of U.S. Pat. No. 4,978,606 (in particular, I-(1), -(2), -(6) and -(12) listed in the 4th to 5th columns), compounds represented by the formula disclosed in the 2nd column, lines 5 to 10 of U.S. Pat. No. 4,923,787 (in particular, Compound 1 listed in the 3rd column).

Stain-Inhibitory Agents: compounds represented by Formulae (I) to (III) disclosed, on page 4, lines 30 to 33, in EP 298,321A (in particular, I-47, I-72, III-1 and III-27 listed on pages 24 to 48).

Antidiscoloration Agents: Compounds A-6, -7, -20, -21, -23, -24, -25, -26, -30, -37, -40, -42, -48, -63, -90, -92, -94 and -164 listed on pages 69 to 118) disclosed in EP 298,321A and Compounds II-1 to III-23 listed in the 25th to 38th columns of U.S. Pat. No. 5,122,444 (in particular, Compound III-10), Compounds I-1 to III-4 disclosed, on pages 8 to 12, in EP 471,347A (in particular, Compound II-2) and Compounds A-1 to A-48 disclosed in the 32th to 40th columns of U.S. Pat. No. 5,139,931 (in particular, Compounds A-39 and A-42).

Materials for Reducing the Amount of Color Development Enhancer or Color Mixing Inhibitor: Compounds I-1 to II-15, in particular, Compound I-46 listed, on pages 5 to 24, in EP 411,324A.

Formalin Scavengers: Compounds SCV-1 to 28 disclosed, on pages 24 to 29, in EP 477,932A, in particular, Compound SCV-8.

Film-Hardening Agents: Compounds H-1, -4, -6, -8 and -14 disclosed, on page 17, in J.P. KOKAI No. Hei 1-214845; Compounds represented by Formulae (VII) to (XII) (H-1 to H-54) listed in the 13th to 23th columns of U.S. Pat. No. 4,618,573; Compounds represented by Formula (6) (H-1 to H-76) disclosed in the lower right column on page 8 of J.P. KOKAI No. Hei 2-214852, in particular, Compound H-14; Compounds disclosed in claim 1 of U.S. Pat. No. 3,325,287.

Precursors for Development Inhibitors: Compounds P-24, -37 and -39 disclosed in J.P. KOKAI No. Sho 62-168139 (pages 6 to 7) and Compounds disclosed in claim 1 of U.S. Pat. No. 5,019,492, in particular, Compounds 28 and 29 in the 7th column.

Antiseptics, Antifungal Agents: Compounds I-1 to III-43 listed in the 3rd to 15th columns of U.S. Pat. No. 4,923,790, in particular Compounds II-1, -9, -10 and -18 and III-25.

Stabilizers, Antifoggants: Compounds I-1 to (14) listed in the 6th to 16th columns of U.S. Pat. No. 4,923,793, in particular, Compounds I-1, -60, (2) and (13); Compounds 1 to 65 listed in the 25th to 32th columns of U.S. Pat. No. 4,952,483, in particular, Compound 63.

Chemical Sensitizers: triphenylphosphine selenide; Compound 50 disclosed in J.P. KOKAI No. Hei 5-40324.

Dyes: Dyes a-1to b-20, in particular, a-1, -12, -18, -27, -35, -36, b-5 (on pages 15 to 18), Dyes V-1 to V-23, in particular, V-1 (on pages 27 to 29) disclosed in J.P. KOKAI No. Hei 3-156450; Dyes F-I-1 to F-II-43, in particular, F-I-11 and F-II-8 disclosed in EP 445,627A (on pages 33 to 55); Dyes III-1 to III-36, in particular, III-1 and III-3 disclosed in EP 457,153A (on pages 17 to 28); fine particle dispersions of Dye-1 to Dye-124 disclosed in WO 88/04794 (on pages 8 to 26); Compounds 1 to 22, in particular, Compound 1 disclosed in EP 319,999A (on pages 6 to 11); Compounds D-1 to D-87 represented by Formulae (1) to (3) disclosed in EP 519,306A (on pages 3 to 28); Compounds 1 to 22 represented by Formula (I) disclosed in U.S. Pat. No. 4,268,622 (in the 3rd to 10th columns); and Compounds (1) to (31) represented by Formula (I) of U.S. Pat. No. 4,923,788 (in the 2nd to 9th columns).

UV Absorbers: Compounds (18b) to (18r), 101 to 427 represented by Formula (I) disclosed in J.P. KOKAI No. Sho 46-3335 (on pages 6 to 9); Compounds (3) to (66) represented by Formula (I) (on pages 10 to 44) and Compounds HBT-1 to 10 represented by Formula (III) (on page 14) disclosed in EP 520,938A; and Compounds (1) to (31) represented by Formula (1) disclosed in EP 521,823A (in the 2nd to 9th columns).

Substrates usable in the present invention are disclosed in, for instance, the foregoing RD No. 17643 (on page 28), RD No. 18716 (from the right column on page 647 to the left column on page 648), and RD No. 307105 (on page 879).

In the light-sensitive material of the present invention, the overall thickness of the whole hydrophilic colloidal layers formed on the side of the substrate carrying the emulsion layers is preferably not more than 28 μm, more preferably not more than 23 μm, still more preferably not more than 18 μm and particularly preferably not more than 16 μm. In addition, the film-swelling rate: $T_{1/2}$ thereof is preferably not more than 30 seconds and more preferably not more than 20 seconds. The term "$T_{1/2}$" is herein defined to be a time required till the film thickness arrives at a half of the saturation thickness which is, in turn, defined to be 90% of the maximum thickness of the swollen film observed when the film is treated at 30° C. for 3 minutes and 15 seconds in a color developing solution. The term "film thickness" herein means that determined under controlled conditions of a temperature of 25° C. and a relative humidity of 55% (for 2 days) and the value of $T_{1/2}$ can be determined using Swellometer (device for determining degree of swelling) of the type disclosed in A. Green et al., Photogr. Sci. Eng., Vol. 19, 2, pp. 124–129. The value of $T_{1/2}$ may be controlled by addition of a film-hardening agent to gelatin as a binder or by adjusting the conditions for allowing the layers to stand after coating. Moreover, the rate of swelling preferably ranges from 150 to 400%. The term "rate of swelling" used herein may be calculated from the following relation using the maximum thickness of a swollen film defined above: (maximum thickness of a swollen film–film thickness)/(film thickness).

The light-sensitive material of the present invention is preferably provided with hydrophilic colloidal layers (backing layers) having an overall thickness, as determined after drying, ranging from 2 to 20 μm. The backing layer preferably comprises a light absorber, a filter dye, a UV absorber, an antistatic agent, a film-hardening agent, a binder, a plasticizer, a lubricant, a coating aid and/or a surfactant such as those listed above. The rate of swelling of the backing layer preferably ranges from 150 to 500%.

The light-sensitive material of the present invention can be developed by the usual method such as those disclosed in the aforementioned RD No. 17643, pp. 28–29, RD No. 18716 (from the left column to the right column on page 651) and No. 307105, pp. 880–881.

The color developing solution used for developing the light-sensitive material of the present invention is preferably an alkaline aqueous solution comprising, as a principal component, an aromatic primary amine type color developer. Aminophenolic compounds are also useful as the color developers, but preferably used are p-phenylenediamine type compounds whose representative and preferred examples are those disclosed in EP 556,700A (page 28, lines 43 to 52). These compounds may be used in combination depending on purposes.

In general, the color developing solution comprises, for instance, a pH buffering agent such as a carbonate, a borate or a phosphate of an alkali metal; and/or a development inhibitor or an antifoggant such as chlorides, bromides, iodides, benzimidazoles, benzothiazoles or mercapto compounds in addition to the color developer. Moreover, the color developing solution comprises, if necessary, hydroxylamine, diethyl hydroxylamine, sulfites, hydrazines such as N,N-biscarboxymethyl hydrazine, various kinds of preservatives such as phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, auxiliary developing agents such as dye-forming couplers, competing couplers and 1-phenyl-3-pyrazolidone, viscosity-imparting agents, various kinds of chelating agents represented by poly (aminocarboxylic acids), poly(aminophosphonic acids), alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di-(o-hydroxyphenylacetic acid) and salts thereof.

Moreover, if a reversal treatment is carried out, the color development of the light-sensitive material is usually performed after the monochromatic development thereof. The monochromatic developer may comprise known monochromatic developing agents, for instance, dihydroxybenzenes such as hydroquinone, 3-pyrazolidones such as 1-phenyl-3-pyrazolidone or aminophenols such as N-methyl-p-aminophenol, which may be used alone or in combination. In general, these color and monochromatic developers have a pH ranging from 9 to 12. Moreover, the amount of these developers to be supplemented varies depending on color photographic light-sensitive materials to be processed, but is in general not more than 3 l per 1 $m^2$ of the light-sensitive material and it can be reduced even to not more than 500 ml if the bromide ion concentration of the replenisher is reduced in advance. If the amount of the replenisher is reduced, it is preferred to prevent any evaporation and oxidation, with the air, of the developer solution by reducing the contact area between the processing bath and the air.

The effect of the contact between the processing solution in the processing bath and the air on photographs thus processed can be evaluated on the basis of the opening rate of the bath (defined by the formula: [the contact area between the processing solution and the air, expressed in $cm^2$]÷[the volume of the processing solution, expressed in $cm^3$]). The opening rate is preferably not more than 0.1 and more preferably 0.001 to 0.05. The opening rate can be reduced by, for instance, the use of a shield such as a floating cover, or a movable cover as disclosed in J.P. KOKAI No. Hei 1-82033, or by the slit-developing method as disclosed in J.P. KOKAI Sho 63-216050. The opening rate is preferably reduced to a desired level not only in both steps for color development and monochromatic development, but also in all of the subsequent steps such as bleaching, bleach-fixing, fixing, water-washing and stabilization steps. In addition, the amount of the replenisher to be supplemented can be reduced by the use of a means for inhibiting any accumulation of the bromide ions in the developer solution.

The time for the color development is in general set to the range of from 2 to 5 minutes, but it can further be reduced by using a color developing solution having a high color developer concentration and a high pH at a high temperature.

The photographic emulsion layer after the color development is usually bleached. The bleaching treatment may be carried out simultaneously with a fixing treatment (bleach-fixing treatment) or these treatments may be separately be carried out. Moreover, the emulsion layer may be subjected to bleaching and then to bleach-fixing in order to ensure a rapid treatment. Furthermore, the emulsion layer may continuously be treated in succesive two bleach-fixing baths, may be fixed before bleach-fixing, or may be bleached after bleach-fixing, depending on the purposes. Examples of bleaching agents are compounds of polyvalent metals such as iron (III), peracids, quinones and nitro compounds. Typical bleaching agents are, for instance, organic complex salts of iron (III) such as complex salts of aminopolycarboxylic acids, for instance, ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, citric acid, tartaric acid and malic acid. Among these, preferred are iron (III) complex salts of aminopolycarboxylic acids represented by iron (III) complex salt of ethylenediaminetetraacetate and iron (III) complex salt of 1,3-diaminopropanetetraacetate from the viewpoint of ensuring a rapid treatment and prevention of environmental pollution. The iron (III) complex salts of aminopolycarboxylic acids are particularly useful in both bleaching solutions and bleach-fixing solutions. The pH values of these bleaching and bleach-fixing solutions each in general ranges from 4.0 to 8, but the treatments may be carried out at a lower pH for ensuring rapid treatments.

The bleaching and bleach-fixing solutions and pretreatment baths thereof may, if necessary, comprise bleach-accelerating agents. Specific examples of useful bleach-accelerating agents are, for instance, as follows: compounds each carrying a mercapto or disulfide group such as those disclosed in U.S. Pat. No. 3,893,858, DE Nos. 1,290,812 and 2,059,988, J.P. KOKAI Nos. Sho 53-32736, Sho 53-57831, Sho 53-37418, Sho 53-72623, Sho 53-95630, Sho 53-95631, Sho 53-104232, Sho 53-124424, Sho 53-141623 and Sho 53-28426 and RD No. 17129 (July, 1978); thiazoline derivatives disclosed in J.P. KOKAI No. Sho 50-140129; thiourea derivatives disclosed in J.P. KOKOKU No. Sho 45-8506, J.P. KOKAI Nos. Sho 52-20832 and Sho 53-32735 and U.S. Pat. No. 3,706,561; iodides disclosed in DE 1,127,715 and J.P. KOKAI No. Sho 58-16235; polyoxyethylene compounds disclosed in DE Nos. 966,410 and 2,748,430; polyamine compounds disclosed in J.P. KOKOKU No. Sho 45-8836; compounds disclosed in J.P. KOKAI Nos. Sho 49-40943, Sho 49-59644, Sho 53-94927, Sho 54-35727, Sho 55-26506 and Sho 58-163940; and bromide ions. Among these, preferred are compounds each carrying a mercapto or disulfide group from the viewpoint of high bleach-accelerating effect, in particular, those disclosed in U.S. Pat. No. 3,893,858, DE 1,290,812 and J.P. KOKAI No. Sho 53-95630. In addition, the compounds disclosed in U.S. Pat. No. 4,552,834 are also preferably used. These bleach-accelerating agents may be incorporated into the light-sensitive material. These bleach-accelerating agents are particularly useful when color light-sensitive materials for photographing are bleach-fixed.

The bleaching and bleach-fixing solutions preferably comprise organic acids in addition to the foregoing compounds in order to prevent stains due to bleaching. Particularly preferred organic acids are compounds each having an acid dissociation constant (pKa) ranging from 2 to 5 and specific examples thereof preferably used are acetic acid, propionic acid and hydroxyacetic acid.

Examples of fixing agents used in the fixing and bleach-fixing solutions are thiosulfates, thiocyanates, thioether compounds, thioureas and iodides (used in a large amount), but commonly used are thiosulfates and ammonium thiosulfate can most widely be used. In addition, it is also preferred to use combinations of thiosulfates with thioether compounds or thioureas. Preservatives used in the fixing and bleach-fixing solutions are preferably sulfites, bisulfites, carbonyl-bisulfite adducts and sulfinic acid compounds disclosed in EP 294,769A. Moreover, the fixing and bleach-fixing solutions preferably comprise aminopolycarboxylic acids and/or organic phosphonic acids to stabilize the solutions.

In the present invention, it is preferred to add, to the fixing and bleach-fixing solutions, compounds having a pKa ranging from 6.0 to 9.0, preferably an imidazole such as imidazole, 1-methylimidazole, 1-ethylimidazole or 2-methylimidazole in an amount ranging from 0.1 to 10 moles/l for adjusting the pH value thereof.

The overall time required for the desilvering process is preferably as short as possible inasmuch as the light-sensitive material is not insufficiently desilvered. The overall time preferably ranges from 1 to 3 minutes and more preferably 1 to 2 minutes. In addition, the temperature for the desilvering treatment ranges from 25° to 50° C. and preferably 35° to 45° C. When the temperature falls within the preferred range, the rate of desilvering is improved and the formation of stains after the treatment can effectively be prevented.

The desilvering step is preferably carried out under vigorous stirring. Specific methods for vigorous stirring of the processing system include, for instance, the method disclosed in J.P. KOKAI No. Sho 62-183460 in which a processing solution in the form of a jet stream is sprayed on the light-sensitive material, i.e., on the surface of the emulsion layer thereof; the method disclosed in J.P. KOKAI No. Sho 62-183461 in which the stirring effect is enhanced by using a rotating means; a method in which the stirring effect is improved by moving the light-sensitive material while the surface of the emulsion layer is brought into contact with a wiper blade positioned within the processing solution to thus generate a turbulent flow on the emulsion layer surface; and a method in which the overall flow rate of the processing solution circulated within the processing system is increased. Such means for improving the stirring effect are also effectively used in the treatments with bleaching, bleach-fixing and fixing solutions. It is believed that these means for improving the stirring effect can accelerate the supply of the bleaching and/or fixing agents to the emulsion film and can in turn improve the desilvering rate. Moreover, the means for improving the stirring effect is particularly effective when a bleach-accelerating agent is used. More specifically, they can substantially improve the bleach-accelerating effect and can eliminate the fixing-inhibitory effect of the bleach-accelerating agent.

Automatic developing machines used for processing the light-sensitive material of the present invention are preferably equipped with a means for conveying the light-sensitive material as disclosed in J.P. KOKAI No. Sho 60-191257, Sho 60-191258 or Sho 60-191259. The use of such a light-sensitive material-conveying means can considerably restrict the amount of a processing solution carried over from a bath to the bath subsequent thereto, can effectively prevent the deterioration of the processing solution and is also effective for reducing the processing time required for each process and for reducing the amount of the replenisher to be supplemented.

After the desilvering step, the light-sensitive material of the present invention is in general subjected to water-washing and/or stabilization steps. The amount of water used in the water-washing step may widely vary depending on various factors such as characteristic properties of the light-sensitive material to be processed (which are influenced by, for instance, the kinds of couplers used), applications thereof, the temperature of the washing water, the number of water-washing tanks (number of washing steps), methods for supplementation such as forward flow feed or countercurrent flow feed system, or other various conditions. In this respect, the relation between the number of water-washing tanks and the amount of water used in the multi-stage countercurrent flow system can be determined according to the method disclosed in Journal of the Society of Motion Picture and Television Engineers, Vol. 64, pp. 248–253 (May, 1955). The multi-stage countercurrent flow system disclosed in this article permits substantial reduction in the amount of the required washing water. However, the system suffers from problems in that the residence time of water in the tank increases, that this results in the proliferation of bacteria and that floating matter thus formed would be adhered to the processed light-senitive material. A quite effective means of solving the foregoing problems is a method for reducing the amounts of calcium and/or magnesium ions as disclosed in J.P. KOKAI No. Sho 62-288838. These problems can be solved by the use of isothiazolone compounds and thiabendazoles as disclosed in J.P. KOKAI No. Sho 57-8542, and chlorine atom-containing antimicrobials such as sodium chlorinated isocyanurate as well as benzotriazoles and antimicrobials such as those disclosed in Hiroshi HORIGUCHI, "BOKIN BOBAIZAI NO KAGAKU (Chemistry of Antibacterial and Antifungal Agents)", (1986), Published by Sankyo Publishing Company, "BISEIBUTSU NO MEKKIN, SAKKIN, BOBAI GIJUTSU (Sterilizing, Pasteurizing, Antifungal Techniques for Microorganisms)", (1982), edited by Hygienic Engineering Society, Kogyo Gijutsu Kai, and "BOKIN BOBAIZAI JITEN (Encyclopaedia of Antibacterial and Antifungal Agents)", (1986), edited by Society of Antibacterial, Antifungal Agents of Japan.

In the processing of the light-sensitive material of the present invention, the pH value of the washing water used therein ranges from 4 to 9 and preferably 5 to 8. The water-washing temperature and time can be set to desired ranges respectively while taking into consideration characteristic properties and applications of the light-sensitive materials, but the water-washing step can in general be carried out at a temperature ranging from 15° to 45° C. for 20 seconds to 10 minutes, preferably 25° to 40° C. for 30 seconds to 5 minutes. Alternatively, the light-sensitive material of the present invention may directly be treated with a stabilization solution instead of the water-washing step. Such a stabilization treatment can be carried out according to a known method such as those disclosed in J.P. KOKAI No. Sho 57-8543, Sho 58-14834 and Sho 60-220345.

Moreover, the light-sensitive material is sometimes subjected to stabilization subsequent to the foregoing water-washing. An example of such treatment is to use a stabilization bath comprising a dye stabilizer and a surfactant, which is generally used as the final bath for processing a color light-sensitive material for photographing. Examples of such dye stabilizers are aldehydes such as formalin and glutaraldehyde, N-methylol compounds, hexamethylenetetramine and aldehyde-sulfurous acid adduct. This stabilization bath may comprise various kinds of chelating agents and antifungal agents.

The overflow generated due to the supplementation of the foregoing washing water and/or stabilization solution may be reused in other steps such as the desilvering step.

When the foregoing various processing solutions are concentrated through evaporation during the treatment in an automatic developing machine, the concentrations thereof are preferably corrected by addition of water.

The light-sensitive material of the present invention may be provided with a built-in color developing agent for simplifying and speeding up the treatment thereof. To this end, it is preferred to use a precursor for the color developing agent, such as indoaniline compounds disclosed in U.S. Pat. No. 3,342,597, Schiff base compounds disclosed in U.S. Pat. No. 3,342,599 and Research Disclosure Nos. 14850 and 15159; aldol compounds disclosed in Research Disclosure No. 13924, metal salt complexes disclosed in U.S. Pat. No. 3,719,492, and urethane compounds disclosed in J.P. KOKAI No. Sho 53-135628.

The light-sensitive material of the present invention may, if necessary, be provided with a variety of built-in 1-phenyl-3-pyrazolidones for promoting the color development. Typical examples thereof are disclosed in J.P. KOKAI Nos. Sho 56-64339, Sho 57-144547 and Sho 58-115438.

The processing solutions for treating the light-sensitive material of the present invention are used at a temperature ranging from 10° to 50° C. In general, the standard treating temperature ranges from 33° to 38° C., but the temperature can be increased to promote the treatment and to reduce the processing time, while it may be reduced to improve the quality of images and to improve the stability of processing solutions.

The present invention can be applied to a silver halide photographic light-sensitive material having a transparent magnetic recording layer. The light-sensitive material provided with a magnetic recording layer used in the present invention can be prepared by heat-treating (annealing) a polyester thin substrate, which has been heat-treated in advance, such as a polyethylene aromatic dicarboxylate type polyester substrate at a temperature of not less than 40° C. and not more than the glass transition temperature thereof for 1 to 1500 hours, then subjecting the substrate to a surface-treatment, applying an undercoat thereto (as disclosed in U.S. Pat. No. 5,326,689) and an optional subbing layer (as disclosed in U.S. Pat. No. 2,761,791) and finally applying a layer of ferromagnetic particles. Examples of polyester thin substrates usable herein are disclosed in J.P. KOKAI Nos. Hei 6-35118 and Hei 6-17528 and KOKAI-GIRO 94-6023 (HATSUMEI KYOKAI) and the substrate has a thickness ranging from 50 to 300 μm, preferably 50 to 200 μm, more preferably 80 to 115 μm and particularly preferably 85 to 105 μm. Moreover, the surface-treatment may be, for instance, is irradiation with UV light rays disclosed in J.P. KOKOKU Nos. Sho 43-2603, Sho 43-2604 and Sho 45-3828; corona discharge treatments disclosed in J.P. KOKOKU NO. Sho 46-5043 and J.P. KOKAI No. Sho 51-131576; and glow discharge treatments disclosed in J.P. KOKOKU Nos. Sho 35-7578 and Sho 46-43480. In addition, the ferromagnetic particles usable herein are, for instance, disclosed in J.P. KOKAI Nos. Sho 59-23505, Hei 4-195726 and Hei 6-59357.

The foregoing magnetic recording layer may be applied in a striped pattern as disclosed in J.P. KOKAI Nos. Hei 4-124642 and Hei 4-124645.

Further the product obtained above is, if necessary, subjected to an antistatic treatment disclosed in J.P. KOKAI No. Hei 4-62543 and finally a silver halide emulsion is applied thereto to complete the light-sensitive material having a magnetic recording layer. The silver halide emulsions used herein are, for instance, those disclosed in J.P. KOKAI Nos. Hei 4-166932, Hei 3-41436 and Hei 3-41437.

The foregoing light-sensitive material having a magnetic recording layer is preferably prepared by the preparation and control method disclosed in J.P. KOKOKU No. Hei 4-86817 and the production data are preferably recorded on the light-sensitive material by the method disclosed in J.P. KOKOKU No. Hei 4-87146. Before or after the recording of the production data, the light-sensitive material is cut into films having a width narrower than that of the conventional film of 135 size by the method disclosed in J.P. KOKAI No. Hei 4-125560 and each film is perforated, on each side, at a rate of 2 holes per image plane of a small format so as to be in agreement with an image plane of a format smaller than that of the conventional ones.

The film thus produced is accommodated in a cartridge type package disclosed in J.P. KOKAI No. Hei 4-157459, a cartridge disclosed in described in FIG. 9 illustrating an Example of J.P. KOKAI No. Hei 5-210202, Film Patrone disclosed in U.S. Pat. No. 4,221,479, or cartridges disclosed in U.S. Pat. Nos. 4,834,306, 4,834,366, 5,226,613 and 4,846,418, prior to practical use.

The film cartridges or film patrones used herein are preferably designed in such a manner that they can accommodate bellows therein, such as those disclosed in U.S. Pat. Nos. 4,848,693 and 5,317,355 from the viewpoint of their light-shielding properties.

Moreover, preferred examples thereof also include cartridges disclosed in U.S. Pat. No. 5,296,886 which are provided with a locking mechanism, cartridges disclosed in U.S. Pat. No. 5,347,334 which can display the use conditions thereof and cartridges provided with double exposure-inhibitory functions.

In addition, it is also possible to use a cartridge, disclosed in J.P. KOKAI No. Hei 6-85128, which can easily be fitted with a film by simply inserting the film into the cartridge.

The film cartridge thus produced can be used for various photographic pleasure by photographing and developing the film through the use of cameras, developing machines and laboratory machinery and tools, as will be detailed below, depending on the purposes.

Sufficient functions of these film cartridges (or patrones) can be ensured if they are fitted to, for instance, one-touch fittable camera disclosed in J.P. KOKAI Nos. Hei 6-8886 and Hei 6-99908; automatically film-winding type cameras disclosed in J.P. KOKAI Nos. Hei 6-57398 and Hei 6-101135; cameras disclosed in J.P. KOKAI No. Hei 6-205690 which permits exchange of films in the course of photographing operations; those capable of magnetic recording, on the film, of information such as panoramic exposure, high vision exposure, usual exposure (the magnetic recording permits the selection of the aspect ratio during printing), as disclosed in J.P. KOKAI Nos. Hei 5-293138 and 5-283382; cameras provided with a double exposure-inhibitory function as disclosed in J.P. KOKAI No. Hei 6-101194; and cameras provided with a function for displaying use conditions of, for instance, films as disclosed in J.P. KOKAI No. Hei 5-150577.

The film thus photographed is processed by an automatic developing machine such as those disclosed in J.P. KOKAI Nos. Hei 6-222514 and Hei 6-222545, or it is possible to use the method for making use of magnetic recording on the film as disclosed in J.P. KOKAI Nos. Hei 6-95265 and Hei 4-123054 before, during or after the development processing, or it is also possible to use the aspect ratio-selecting function as disclosed in J.P. KOKAI No. Hei 5-19364.

If the development treatment is the cine type development, the film is processed after splicing according to the method disclosed in J.P. KOKAI No. Hei 5-119461.

The film is subjected to attaching/detatching treatments disclosed in J.P. KOKAI No. Hei 6-148805 during or after the development treatment thereof.

After thus treating the film, the film information may be transferred to the print through the back printing and front printing onto a color paper using the method disclosed in J.P. KOKAI Nos. Hei 2-184835, Hei 4-186335 and Hei 6-79968.

Moreover, the index prints and sent-back cartridge may be returned to a customer as disclosed in J.P. KOKAI Nos. Hei 5-11353 and Hei 5-232594.

The present invention will hereinafter be described in more detail with reference to the following working Examples, but the present invention is not restricted to these specific Examples.

EXAMPLE 1

(1) Preparation of Emulsion

Potassium bromide (6 g) and inert gelatin having an average molecular weight of 15000 (30 g) were dissolved in 3.7 l of distilled water to give an aqueous solution and then a 14% potassium bromide aqueous solution and a 20% aqueous silver nitrate solution were added to the resulting aqueous solution by the double jet method at 55° C., a constant flow rate and a pBr of 1.0 for one minute with sufficient stirring (2.4% of the total amount of silver was consumed during this addition).

An aqueous gelatin solution (17%, 300 cc) was added to the resulting mixture, followed by stirring at 55° C. and addition of a 20% aqueous solution of silver nitrate at a constant flow rate till the pBr reached 1.4 (5.0% of the total amount of silver was consumed during this addition). Then thiourea dioxide was added to the mixture in an amount of $1.2\times10^{-5}$ mole per mole of silver, followed by addition of a 20% potassium iodide solution ($KBr_{1-x}I_x$:x=0.04) and a 33% aqueous solution of silver nitrate over 43 minutes by the double jet method (50% of the total amount of silver was consumed during this addition). At this stage, an aqueous solution containing 8.3 g of potassium iodide was added, followed by addition of 14.5 ml of a 0.001% by weight $K_3IrCl_6$ aqueous solution and then addition of a 20% potassium bromide solution and a 33% silver nitrate aqueous solution by the double jet method over 39 minutes (42.6% of the total amount of silver was consumed during this addition). The overall amount of silver nitrate used for the preparation of this emulsion was 425 g. Then desalting was performed by the usual flocculation method, the pAg and pH of the emulsion were adjusted to 8.2 and 5.8 respectively, at a temperature of 40° C . As a result, there was prepared a plate-like silver iodobromide emulsion (Em-1) having an average aspect ratio of 6.5, a coefficient of variation of 18% and a diameter of the corresponding sphere of 0.8 μm. When the emulsion was observed by a 200 kV transmission electron microscope at the temperature of liquid nitrogen, it was found that the plate-like grains had not less than 50 dislocation lines per grain near the outer periphery thereof.

After adding, to the emulsion Em-1 thus prepared, sensitizing dyes listed in the following Table 3 in amounts likewise listed in Table 3, the emulsion was subjected to optimum gold-selenium-sulfur sensitization using sodium thiosulfate, chloroauric acid, N,N-dimethylselenourea and potassium thiocyanate to give emulsion Nos. 151 to 175. Separately, sensitizing dyes listed in Table 2 were added to a plate-like silver iodobromide emulsion (Em-2) prepared by the same procedures used above except for the step for the addition of thiourea dioxide to give emulsion Nos. 101 to 125.

An emulsion layer and a protective layer were applied onto a triacetyl cellulose substrate to which an underlying layer had been applied in coated amounts detailed in the following Table 4 to give Sample Nos. 1001 to 1075.

TABLE 2

Emulsions Prepared

| Emulsion No. | Sensitizing Dye | Remark (non-reduced) |
|---|---|---|
| 101 | (SD-1) ($4.6\times10^{-4}$ mole/mole Ag(M/M Ag)) | Comp. |
| 102 | (II-1) ($4.6\times10^{-4}$ M/M Ag) | Pres.Inv. |
| 103 | (II-26) ($4.6\times10^{-4}$ M/M Ag) | Pres.Inv. |
| 104 | (II-4) ($4.6\times10^{-4}$ M/M Ag) | Pres.Inv. |
| 105 | (II-3) ($4.6\times10^{-4}$ M/M Ag) | Pres.Inv. |
| 106 | (II-2) ($4.6\times10^{-4}$ M/M Ag) | Pres.Inv. |
| 107 | (SD-2) ($4.6\times10^{-4}$ M/M Ag) | Comp. |
| 108 | (II-8) ($4.6\times10^{-4}$ M/M Ag) | Pres.Inv. |
| 109 | (II-9) ($4.6\times10^{-4}$ M/M Ag) | Pres.Inv. |
| 110 | (SD-3) ($4.6\times10^{-4}$ M/M Ag) + (SD-6) ($0.5\times10^{-4}$ M/M Ag) | Comp. |
| 111 | (II-49) ($4.6\times10^{-4}$ M/M Ag) + (II-44) ($0.5\times10^{-4}$ M/M Ag) | Pres.Inv. |
| 112 | (II-50) ($4.6\times10^{-4}$ M/M Ag) + (II-44) ($0.5\times10^{-4}$ M/M Ag) | Pres.Inv. |
| 113 | (SD-4) ($4.6\times10^{-4}$ M/M Ag) | Comp. |
| 114 | (III-7) ($4.6\times10^{-4}$ M/M Ag) | Pres.Inv. |
| 115 | (III-6) ($4.6\times10^{-4}$ M/M Ag) | Pres.Inv. |
| 116 | (III-8) ($4.6\times10^{-4}$ M/M Ag) | Pres.Inv. |
| 117 | (SD-5) ($4.6\times10^{-4}$ M/M Ag) | Comp. |
| 118 | (IV-1) ($4.6\times10^{-4}$ M/M Ag) | Pres.Inv. |
| 119 | (IV-3) ($4.6\times10^{-4}$ M/M Ag) | Pres.Inv. |
| 120 | (IV-4) ($4.6\times10^{-4}$ M/M Ag) | Pres.Inv. |
| 121 | (IV-2) ($4.6\times10^{-4}$ M/M Ag) | Pres.Inv. |

TABLE 2-continued

| Emulsions Prepared | | |
|---|---|---|
| Emulsion No. | Sensitizing Dye | Remark (non-reduced) |
| 122 | (SD-3) (4.6 × $10^{-4}$ M/M Ag) | Comp. |
| 123 | (SD-7) (4.6 × $10^{-4}$ M/M Ag) | Comp. |
| 124 | (II-49) (4.6 × $10^{-4}$ M/M Ag) | Pres.Inv. |
| 125 | (II-50) (4.6 × $10^{-4}$ M/M Ag) | Pres.Inv. |

TABLE 3

| Emulsions Prepared | | |
|---|---|---|
| Emulsion No. | Sensitizing Dye | Remark (reduction) |
| 151 | (SD-1) (4.6 × $10^{-4}$ mole/mole Ag(M/M Ag)) | Comp. |
| 152 | (II-1) (4.6 × $10^{-4}$ M/M Ag) | Pres. Inv. |
| 153 | (II-26) (4.6 × $10^{-4}$ M/M Ag) | Pres. Inv. |
| 154 | (II-4) (4.6 × $10^{-4}$ M/M Ag) | Pres. Inv. |
| 155 | (II-3) (4.6 × $10^{-4}$ M/M Ag) | Pres. Inv. |
| 156 | (II-2) (4.6 × $10^{-4}$ M/M Ag) | Pres. Inv. |
| 157 | (SD-2) (4.6 × $10^{-4}$ M/M Ag) | Comp. |
| 158 | (II-8) (4.6 × $10^{-4}$ M/M Ag) | Pres. Inv. |
| 159 | (II-9) (4.6 × $10^{-4}$ M/M Ag) | Pres. Inv. |
| 160 | (SD-3) (4.6 × $10^{-4}$ M/M Ag) + (SD-6)(0.5 × $10^{-4}$ M/M Ag) | Comp. |
| 161 | (II-49) (4.6 × $10^{-4}$ M/M Ag) + (II-44) (0.5 × $10^{-4}$ M/M Ag) | Pres. Inv. |
| 162 | (II-50) (4.6 × $10^{-4}$ M/M Ag) + (II-44) (0.5 × $10^{-4}$ M/M Ag) | Pres. Inv. |
| 163 | (SD-4) (4.6 × $10^{-4}$ M/M Ag) | Comp. |
| 164 | (III-7) (4.6 × $10^{-4}$ M/M Ag) | Pres. Inv. |
| 165 | (III-6) (4.6 × $10^{-4}$ M/M Ag) | Pres. Inv. |
| 166 | (III-8) (4.6 × $10^{-4}$ M/M Ag) | Pres. Inv. |
| 167 | (SD-5) (4.6 × $10^{-4}$ M/M Ag) | Comp. |
| 168 | (IV-1) (4.6 × $10^{-4}$ M/M Ag) | Pres. Inv. |
| 169 | (IV-3) (4.6 × $10^{-4}$ M/M Ag) | Pres. Inv. |
| 170 | (IV-4) (4.6 × $10^{-4}$ M/M Ag) | Pres. Inv. |
| 171 | (IV-2) (4.6 × $10^{-4}$ M/M Ag) | Pres. Inv. |
| 172 | (SD-3) (4.6 × $10^{-4}$ M/M Ag) | Comp. |
| 173 | (SD-7) (4.6 × $10^{-4}$ M/M Ag) | Comp. |
| 174 | (II-49) (4.6 × $10^{-4}$ M/M Ag) | Pres. Inv. |
| 175 | (II-50) (4.6 × $10^{-4}$ M/M Ag) | Pres. Inv. |

SD-1

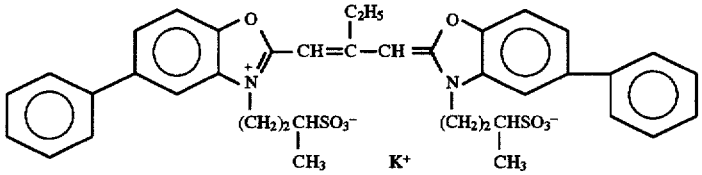

SD-2

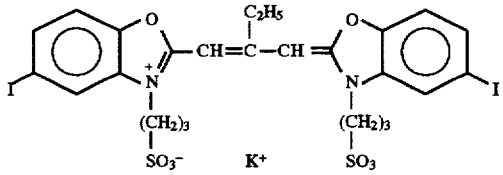

TABLE 3-continued
| Emulsions Prepared | | |
|---|---|---|
| Emulsion No. | Sensitizing Dye | Remark (reduction) |
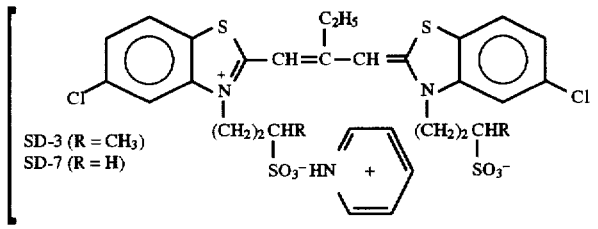
SD-4
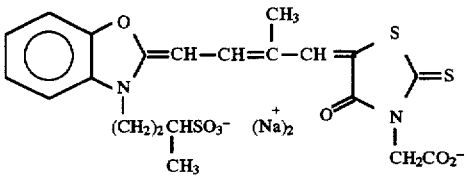
SD-5
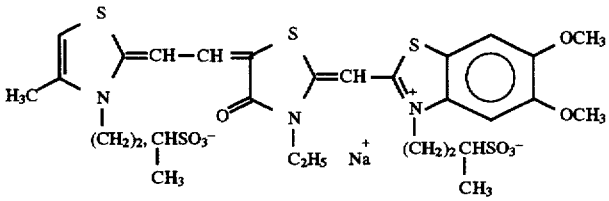
SD-6
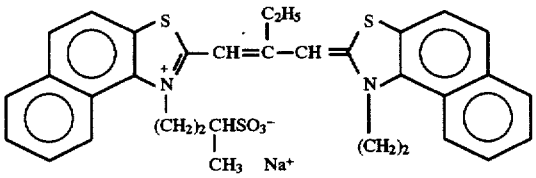
TABLE 4
| Conditions for Application of Emulsions | |
|---|---|
| (1) Emulsion Layer | |
| ○ Emulsion: Emulsion Nos. 101 to 125, 151 to 175 | (Ag: $2.1 \times 10^{-3}$ mole/m$^2$) |
| ○ Coupler | ($1.5 \times 10^{-3}$ mole/m$^2$) |
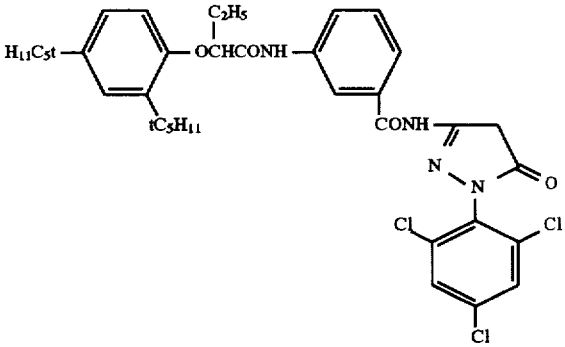

TABLE 4-continued

| Conditions for Application of Emulsions | |
|---|---|
| ○ Tricresyl phosphate | (1.10 g/m²) |
| ○ Gelatin | (2.30 g/m²) |
| (2) Protective Layer | |
| ○ Sodium salt of 2,4-dichlorotriazine-6-hydroxy-s-triazine | (0.08 g/m²) |
| ○ Gelatin | (1.80 g/m²) |

These Samples each was subjected to exposure to light for sensitometry at a color temperature of 4800° K for 1/100 second through a continuous wedge and Gelatin Filter SC-50 available from Fuji Photo Film Co., Ltd. and then subjected to the following color developing treatment. The developing treatment was herein carried out under the following conditions at 38° C.

Processing Method

| Step | Processing Time | Processing T (°C.) | Amount of Replenisher (ml) | Tank Volume (l) |
|---|---|---|---|---|
| Color Develoment | 2 min, 45 sec | 38 | 33 | 20 |
| Bleaching | 6 min, 30 sec | 38 | 25 | 40 |
| Water-Washing | 2 min, 10 sec | 24 | 1200 | 20 |
| Fixing | 4 min, 20 sec | 38 | 25 | 30 |
| Water-Washing(1) | 1 min, 05 sec | 24 | Countercurrent Piping System from (2) to (1) | 10 |
| Water-Washing(2) | 1 min, 00 sec | 24 | 1200 | 10 |
| Stabilization(3) | 1 min, 05 sec | 38 | 25 | 10 |
| Drying | 4 min, 20 sec | 55 | | |

*: The amount of the replenisher is expressed in terms of the amount thereof per unit area of each film (35 mm wide, 1 m long).

The compositions of the processing solutions used were as follows:

| | Mother Liq. (g) | Replenisher (g) |
|---|---|---|
| (Color Developing Solution) | | |
| diethylenetriaminepentaacetic acid | 1.0 | 1.1 |
| 1-hydroxyethylidene-1,1-diphosphonic acid | 3.0 | 3.2 |
| sodium sulfite | 4.0 | 4.4 |
| potassium carbonate | 30.0 | 37.0 |
| potassium bromide | 1.4 | 0.7 |
| potassium iodide | 1.5 (mg) | — |
| hydroxylamine sulfate | 2.4 | 2.8 |
| 4-[N-ethyl-N- β-hydroxyethylamino]-2-methylaniline sulfate | 4.5 | 5.5 |
| water | ad. 1.0 l | ad. 1.0 l |
| pH | 10.05 | 10.10 |
| (Bleahing Solution) | | |
| Na Fe(II) ethylenediaminetetraacete. $3H_2O$ | 100.0 | 120.0 |
| 2Na ethylenediaminetetraacetae | 10.0 | 11.0 |
| ammonium bromide | 140.0 | 160.0 |
| ammonium nitrate | 30.0 | 35.0 |
| aqueous ammonia (27%) | 6.5 (ml) | 4.0 (ml) |
| water | ad. 1.0 l | ad. 1.0 l |
| pH | 6.0 | 5.7 |
| (Fixing Solution) | | |
| Na ethylenediaminetetraacetate | 0.5 | 0.7 |
| sodium sulfite | 7.0 | 8.0 |
| sodium bisulfite | 5.0 | 5.5 |

-continued

| | Mother Liq. (g) | Replenisher (g) |
|---|---|---|
| ammonium thiosulfate ag. soln.(70%) | 170.0 (ml) | 200.0 (ml) |
| water | ad. 1.0 l | ad. 1.0 l |
| pH | 6.7 | 6.6 |
| (Stabilization Solution) | | |
| formalin (37%) | 2.0 (ml) | 3.0 (ml) |
| polyoxyethylene-p-monononylphenyl ether (average degree of polymerization: 10) | 0.3 | 0.45 |
| disodium ethylenediaminetetraacetate | 0.05 | 0.08 |
| water | ad. 1.0 l | ad. 1.0 l |
| pH | 5.8–8.0 | 5.8–8.0 |

The processed Samples were inspected for the optical density.

The sensitivity of each Sample was evaluated in terms of fresh sensitivity-fogging (fogging observed immediately after the processing) which was defined to be a relative reciprocal of the exposure value required for achieving an optical density of 0.2 higher than the fog. Separately, each un-exposed film was allowed to stand at a relative humidity of 30% and 50 ° C. for 3 days and then exposed to light and developed in the same manner used above. Thereafter each film was inspected for the sensitivity and fog by the same procedures used above.

The results thus obtained are summarized in the following Tables 5 and 6. In this respect, Sample No. 1001 was used as the reference (100) for the sensitivity evaluation.

TABLE 5

| | Emul- | Fresh | | After Storage | | |
|---|---|---|---|---|---|---|
| Sample No. | sion Used | Relative Sensitivity | Fog | Relative Sensitivity | Fog | (Non-reduced) Remarks |
| 1001 | 101 | 100 (Reference) | 0.51 | 45 | 0.72 | Comp. Ex. |
| 1002 | 102 | 125 | 0.31 | 101 | 0.33 | Pres. Inv. |
| 1003 | 103 | 128 | 0.31 | 106 | 0.32 | Pres. Inv. |
| 1004 | 104 | 145 | 0.31 | 130 | 0.32 | Pres. Inv. |
| 1005 | 105 | 145 | 0.31 | 131 | 0.31 | Pres. Inv. |
| 1006 | 106 | 155 | 0.30 | 145 | 0.30 | Pres. Inv. |
| 1007 | 107 | 96 | 0.52 | 42 | 0.82 | Comp. Ex. |
| 1008 | 108 | 120 | 0.33 | 102 | 0.35 | Pres. Inv. |
| 1009 | 109 | 150 | 0.32 | 140 | 0.33 | Pres. Inv. |
| 1010 | 110 | 95 | 0.70 | 43 | 0.81 | Comp. Ex. |
| 1011 | 111 | 121 | 0.35 | 102 | 0.36 | Pres. Inv. |
| 1012 | 112 | 148 | 0.35 | 137 | 0.35 | Pres. Inv. |
| 1013 | 113 | 91 | 0.42 | 43 | 0.51 | Comp. Ex. |
| 1014 | 114 | 118 | 0.34 | 100 | 0.35 | Pres. Inv. |
| 1015 | 115 | 138 | 0.33 | 125 | 0.34 | Pres. Inv. |
| 1016 | 116 | 138 | 0.33 | 124 | 0.33 | Pres. Inv. |
| 1017 | 117 | 92 | 0.61 | 38 | 0.72 | Comp. Ex. |
| 1018 | 118 | 118 | 0.35 | 100 | 0.37 | Pres. Inv. |
| 1019 | 119 | 125 | 0.34 | 110 | 0.35 | Pres. Inv. |

TABLE 5-continued

| Sample No. | Emulsion Used | Fresh Relative Sensitivity | Fresh Fog | After Storage Relative Sensitivity | After Storage Fog | (Non-reduced) Remarks |
|---|---|---|---|---|---|---|
| 1020 | 120 | 125 | 0.34 | 111 | 0.35 | Pres. Inv. |
| 1021 | 121 | 140 | 0.34 | 128 | 0.35 | Pres. Inv. |
| 1022 | 122 | 90 | 0.71 | 35 | 0.85 | Comp. Ex. |
| 1023 | 123 | 92 | 0.71 | 36 | 0.85 | Comp. Ex. |
| 1024 | 124 | 113 | 0.35 | 93 | 0.35 | Pres. Inv. |
| 1025 | 125 | 141 | 0.35 | 128 | 0.35 | Pres. Inv. |

TABLE 6

| Sample No. | Emulsion Used | Fresh Relative Sensitivity | Fresh Fog | After Storage Relative Sensitivity | After Storage Fog | Reduction Sensitization Remarks |
|---|---|---|---|---|---|---|
| 1051 | 151 | 105 | 0.71 | 50 | 1.53 | Comp. Ex. |
| 1052 | 152 | 150 | 0.32 | 132 | 0.38 | Pres. Inv. |
| 1053 | 153 | 158 | 0.32 | 140 | 0.37 | Pres. Inv. |
| 1054 | 154 | 178 | 0.31 | 168 | 0.33 | Pres. Inv. |
| 1055 | 155 | 179 | 0.31 | 169 | 0.32 | Pres. Inv. |
| 1056 | 156 | 200 | 0.30 | 195 | 0.30 | Pres. Inv. |
| 1057 | 157 | 100 | 0.62 | 45 | 1.19 | Comp. Ex. |
| 1058 | 158 | 145 | 0.35 | 130 | 0.41 | Pres. Inv. |
| 1059 | 159 | 191 | 0.32 | 184 | 0.34 | Pres. Inv. |
| 1060 | 160 | 99 | 0.83 | 44 | 1.43 | Comp. Ex. |
| 1061 | 161 | 151 | 0.37 | 136 | 0.42 | Pres. Inv. |
| 1062 | 162 | 198 | 0.36 | 192 | 0.38 | Pres. Inv. |
| 1063 | 163 | 93 | 0.71 | 45 | 1.26 | Comp. Ex. |
| 1064 | 164 | 130 | 0.38 | 114 | 0.47 | Pres. Inv. |
| 1065 | 165 | 153 | 0.34 | 143 | 0.38 | Pres. Inv. |
| 1066 | 166 | 153 | 0.34 | 143 | 0.38 | Pres. Inv. |
| 1067 | 167 | 92 | 0.68 | 36 | 1.03 | Comp. Ex. |
| 1068 | 168 | 136 | 0.37 | 120 | 0.47 | Pres. Inv. |
| 1069 | 169 | 148 | 0.35 | 137 | 0.38 | Pres. Inv. |
| 1070 | 170 | 149 | 0.35 | 139 | 0.38 | Pres. Inv. |
| 1071 | 171 | 168 | 0.34 | 158 | 0.36 | Pres. Inv. |
| 1072 | 172 | 93 | 0.81 | 33 | 1.18 | Comp. Ex. |
| 1073 | 173 | 107 | 0.81 | 34 | 1.27 | Comp. Ex. |
| 1074 | 174 | 144 | 0.38 | 128 | 0.41 | Pres. Inv. |
| 1075 | 175 | 192 | 0.35 | 185 | 0.39 | Pres. Inv. |

The results listed in Table 5 clearly indicate that the light-sensitive materials containing the novel dyes each carrying a sulfoalkyl group according to the present invention have substantially high sensitivity and low fog and are excellent in storage stability as compared with those containing the comparative dyes each carrying a 3-sulfobutyl or 3-sulfoalkyl group. In particular, it was surprisingly found that the dyes (II-1), (II-8), (II-49), (III-7) and (IV-1) each carrying a 3-sulfopentyl group permitted considerable improvement of the photographic quality although the 3-sulfopentyl group simply has a carbon atom number greater than 3-sulfobutyl and 3-sulfopropyl groups by one and two respectively. Moreover, the dyes (II-26), (II-4), (II-3) and (II-2) permit marked improvement of the photographic quality as compared with the dye (II-1). The dye (II-2) carrying a phenyl group exhibits particularly high quality. Regarding the samples listed in Table 6 which made use of the reduction-sensitized emulsion, unlike those listed in Table 5 (wherein non-reduced emulsions were used), comparative dyes does not improve the sensitivity of the resulting light-sensitive materials so much, but increased the fog thereof, while the dyes of the present invention permit substantial improvement in the sensitivity without increasing any fog and also ensure improvement in the storage stability.

EXAMPLE 2

Layers each having the following composition were applied, in layers, onto a substrate of a cellulose triacetate film to which an underlying layer had been applied to give multi-layered color light-sensitive materials.

(Composition of Light-Sensitive Layer)

Principal ingredients used in these layers are divided into the following groups:

ExC: cyan coupler;

UV: UV absorber;

ExM: magenta coupler;

HBS: high-boiling organic solvent;

ExY: yellow coupler;

H: gelatin-hardener;

ExS: sensitizing dye.

The numerical value corresponding to each ingredient is the coated amount thereof expressed in g/m$^2$ unit and that for a silver halide means the coated amount thereof expressed in terms of the amount of silver, provided that the numerical value for a sensitizing dye is the coated amount thereof expressed in terms of the molar amount per mole of the silver halide present in the same layer.

| | | |
|---|---|---|
| 1st Layer (Antihalation Layer) | | |
| black colloidal silver | Ag | 0.09 |
| gelatin | | 1.60 |
| ExM-1 | | 0.12 |
| EXF-1 | | $2.0 \times 10^{-3}$ |
| solid disperse dye ExF-2 | | 0.030 |
| solid disperse dye ExF-3 | | 0.040 |
| HBS-1 | | 0.15 |
| HBS-2 | | 0.02 |
| 2nd Layer (Intermediate Layer) | | |
| silver iodobromide emulsion M | Ag | 0.065 |
| ExC-2 | | 0.04 |
| poly(ethyl acrylate) latex | | 0.02 |
| gelatin | | 1.04 |
| 3rd Layer (Low Sensitive, Blue-Sensitive Emulsion Layer) | | |
| silver iodobromide emulsion A | Ag | 0.25 |
| silver iodobromide emulsion B | Ag | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| gelatin | | 0.87 |
| 4th Layer (Medium Sensitive Red-Sensitive Emulsion Layer) | | |
| silver iodobromide emulsion C | Ag | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| gelatin | | 0.75 |
| 5th Layer (High Sensitive Red-Sensitive Emulsion Layer) | | |
| silver iodobromide emulsion D | Ag | 1.40 |

(As shown in Table 8, there was used dyes of Emulsion 110

-continued

| | | |
|---|---|---|
| [(SD-3) ($4.6 \times 10^{-4}$) + (SD-6) ($0.5 \times 10^{-4}$)], dyes of Emulsion 111 [(II-49) ($4.6 \times 10^{-4}$) + (II-44) ($0.5 \times 10^{-4}$)] or dyes of Emulsion 112 [(II-50) ($4.6 \times 10^{-4}$) + (II-44) ($0.5 \times 10^{-4}$)]) | | |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| gelatin | | 1.10 |
| 6th Layer (Intermediate Layer) | | |
| Cpd-1 | | 0.090 |
| solid disperse dye ExF-4 | | 0.030 |
| HBS-1 | | 0.050 |
| poly(ethyl acrylate) latex | | 0.15 |
| gelatin | | 1.10 |
| 7th Layer (Low Sensitive Green-Sensitive Emulsion Layer) | | |
| silver iodobromide emulsion E | Ag | 0.15 |
| silver iodobromide emulsion F | Ag | 0.10 |
| silver iodobromide emulsion G | Ag | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| gelatin | | 0.73 |
| 8th Layer (Medium Sensitive Green-Sensitive Emulsion Layer) | | |
| silver iodobromide emulsion H | Ag | 0.80 |
| ExS-4 | | $3.2 \times 10^{-4}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| gelatin | | 0.80 |
| 9th Layer (High Sensitive Green-Sensitive Emulsion Layer) | | |
| silver iodobromide emulsion I | Ag | 1.25 |
| (as shown in Table 8, there was used dye (SD-1) of Emulsion 101, dye (II-1) of Emulsion 102, dye (II-26) of Emulsion 103, dye (II-4) of Emulsion 104, dye (II-3) of Emulsion 105, dye (II-2) of Emulsion 106, dye (SD-2) of Emulsion 107, dye (II-8) of Emulsion 108 or dye (II-9) of Emulsion 109 each in an amount of $4.6 \times 10^{-4}$) | | |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| poly(ethyl acrylate) latex | | 0.15 |
| gelatin | | 1.33 |
| 10th Layer (Yellow Filter Layer) | | |
| yellow colloidal silver | Ag | 0.015 |
| Cpd-1 | | 0.16 |
| solid disperse dye ExF-5 | | 0.060 |
| solid disperse dye ExF-6 | | 0.060 |
| oil-soluble dye ExF-7 | | 0.010 |
| HBS-1 | | 0.60 |
| gelatin | | 0.60 |
| 11th Layer (Low Sensitive Blue-Sensitive Emulsion Layer) | | |
| silver iodobromide emulsion J | Ag | 0.09 |
| silver iodobromide emulsion K | Ag | 0.09 |
| ExS-7 | | $8.6 \times 10^{-4}$ |
| ExC-8 | | $7.0 \times 10^{-3}$ |
| ExY-1 | | 0.050 |

-continued

| | | |
|---|---|---|
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| gelatin | | 1.20 |
| 12th Layer (High Sensitive Blue-Sensitive Emulsion Layer) | | |
| silver iodobromide emulsion L | Ag | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| gelatin | | 0.70 |
| 13th Layer (First Protective Layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| gelatin | | 1.8 |
| 14th Layer (Second Protective Layer) | | |
| silver iodobromide emulsion M | Ag | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| gelatin | | 0.70 |

Moreover, each layer, if necessary, comprised W-1 to W-3, B-4 to B-6, F-1 to F-17, iron salts, lead salts, gold salts, platinum salts, palladium salts, iridium salts and/or rhodium salts for the improvement of the storability, processability, pressure resistance, antifungal-antibacterial properties, antistatic properties and coating ability thereof.

TABLE 7

| Emulsion | Av. AgI Content (%) | Coef. of Var.[1)] (%) | Av. Grain Size[2)] (μm) | Coef. of Var.[3)] (%) | Diameter of Projected Plane[4)] (μm) | Diameter/Thickness Ratio |
|---|---|---|---|---|---|---|
| A | 1.7 | 10 | 0.46 | 15 | 0.56 | 5.5 |
| B | 3.5 | 7 | 0.57 | 20 | 0.78 | 4.0 |
| C | 8.9 | 18 | 0.66 | 17 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 13 | 0.78 | 4.0 |
| G | 8.8 | 13 | 0.61 | 17 | 0.77 | 4.4 |
| H | 8.8 | 25 | 0.61 | 23 | 0.77 | 4.4 |
| I | 8.9 | 18 | 0.84 | 18 | 1.03 | 3.7 |
| J | 1.7 | 10 | 0.46 | 15 | 0.50 | 4.2 |
| K | 8.8 | 15 | 0.64 | 19 | 0.85 | 5.2 |
| L | 14.0 | 18 | 1.28 | 19 | 1.46 | 3.5 |
| M | 1.0 | — | 0.07 | 15 | — | 1 |

[1)]Coefficient of variation observed between AgI contents of particles.
[2)]Average grain size of grains approximated to spheres.
[3)]Coefficient of variation concerning the grain size.
[4)]Diameter of projected images approximated to circles.

In Table 7, (1) The emulsions D and I to L were subjected to reduction sensitization using thiourea dioxide and thiosulfonic acid according to the procedures disclosed in Examples of J.P. KOKAI No. Hei 2-191938;

(2) The emulsions A to L were subjected to gold sensitization, sulfur sensitization and selenium sensitization in the presence of the spectral sensitizing dye specified above for each light-sensitive layer and sodium thiocyanate, according to the procedures disclosed in Examples of J.P. KOKAI No. Hei 3-237450;

(3) In the preparation of the plate-like grains, gelatin having a low molecular weight was used while taking into consideration the teaching of J.P. KOKAI No. Hei 1-158426;

(4) The plate-like grains each has dislocation lines such as those disclosed in J.P. KOKAI No. Hei 3-237450 when they are observed by a high pressure electron microscope;

(5) The emulsion L comprises grains having a double structure which has a core comprising an internal portion having a high iodine content.

Preparation of Dispersion of Organic Solid Disperse Dye

The following dye ExF-2 was dispersed by the method detailed below. To a 700 ml pot mill, there were added 21.7 ml of water, 3 ml of a 5% aqueous solution of sodium p-octylphenoxy-ethoxyethanesulfonate and 0.5 g of a 5% aqueous solution of p-octylphenoxy polyoxyethylene ether (degree of polymerization: 10), then 5.0 g of the dye ExF-2 and 500 ml of zirconium oxide beads (diameter: 1 mm) were added to the pot mill and thus the content of the pot mill was dispersed for 2 hours. The dispersing operation was carried out using a BO type vibrational ball mill available from Chuo Koki Co., Ltd. After the dispersion, the content was removed from the mill, followed by addition of 8 g of a 12.5% aqueous solution of gelatin and removal of the beads through filtration to give a dispersion of the dye in gelatin. The average particle size of fine dye particles present therein was found to be 0.44 μm.

In the same manner, solid dispersions of dyes ExF-3, ExF-4 and ExF-6 were prepared. The average particle sizes of fine dye particles present therein were found to be 0.24μm, 0.45 μm and 0.52 μm. The solid dispersion of the dye ExF-5 was prepared using the Microprecipitation method disclosed in Example 1 of EP 549,489A. The average particle size thereof was found to be 0.06 μm.

ExC-1

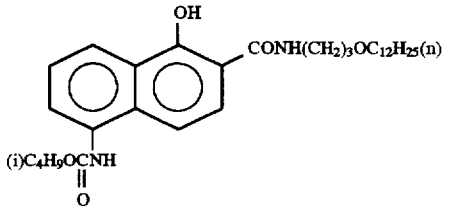

ExC-2

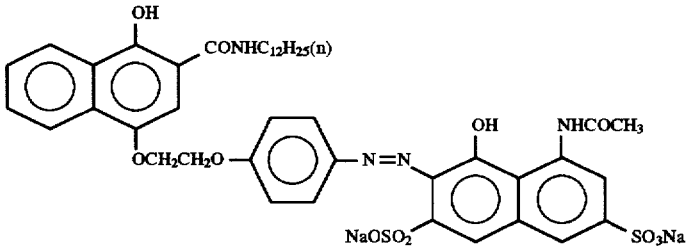

ExC-3

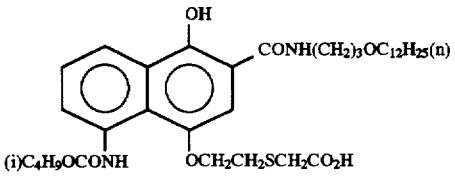

ExC-4

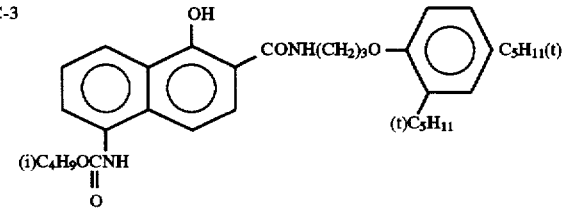

ExC-5

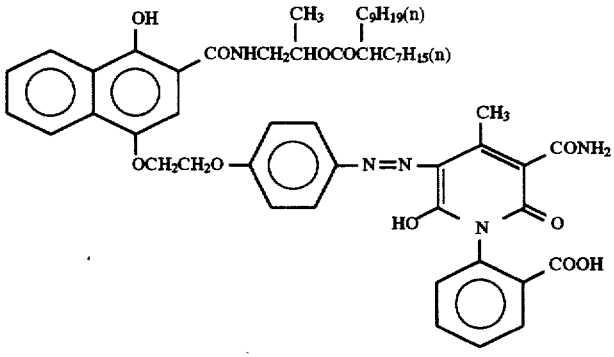

-continued
ExC-6
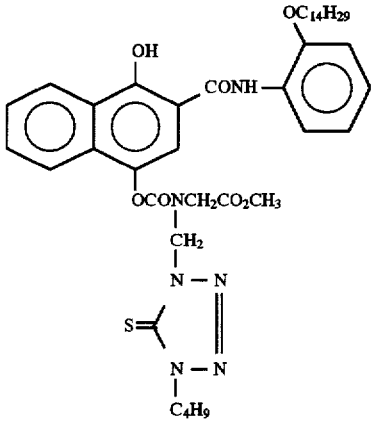
ExC-7
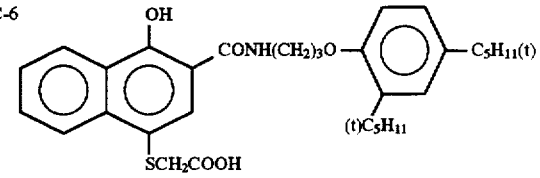
ExC-8
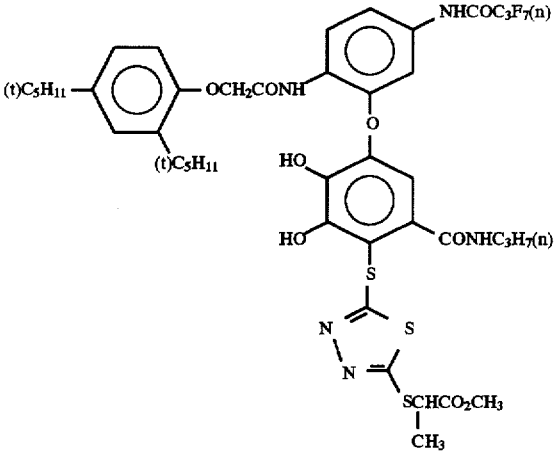
ExM-1
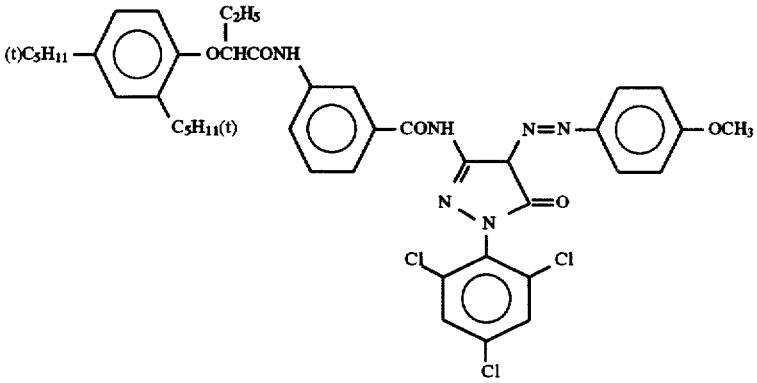
ExM-2
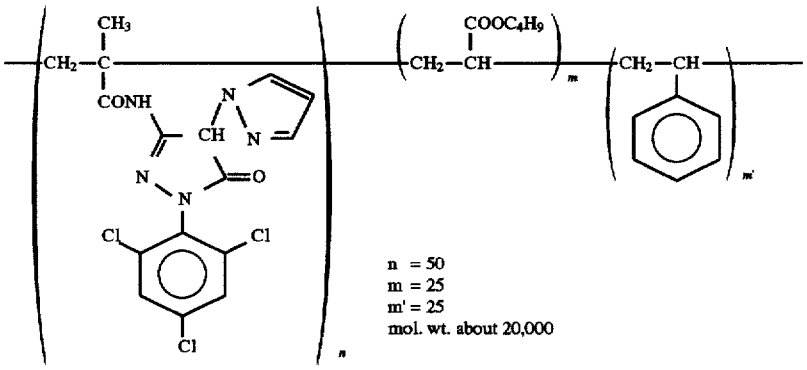
n = 50
m = 25
m' = 25
mol. wt. about 20,000

-continued
ExM-3
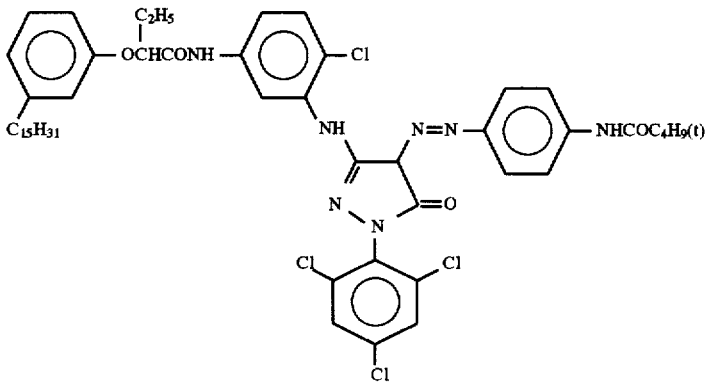
ExM-4
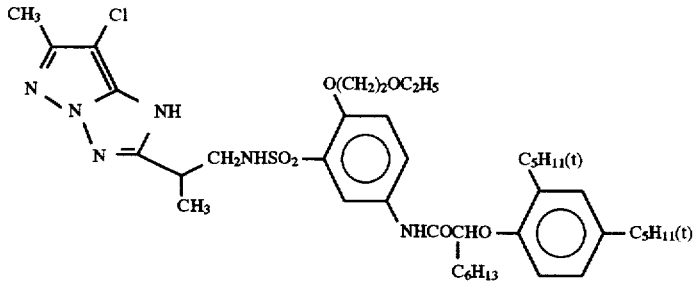
ExM-5
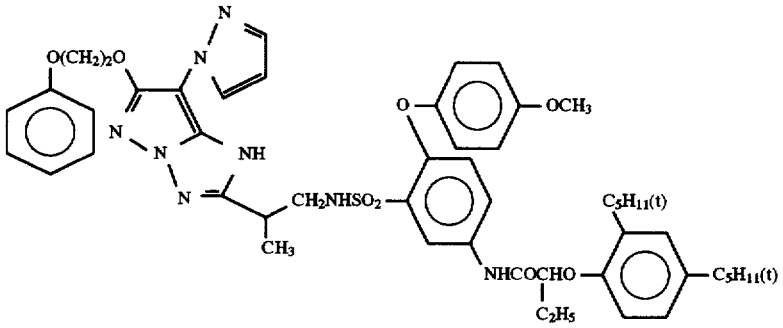
ExY-1
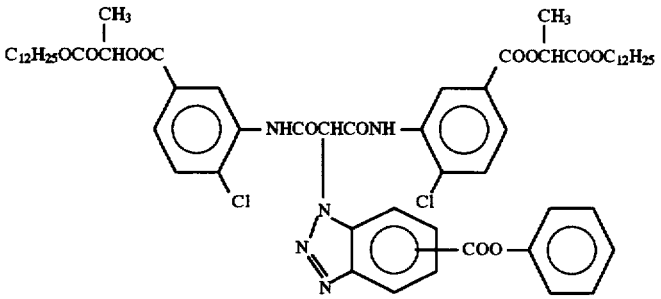
ExY-2
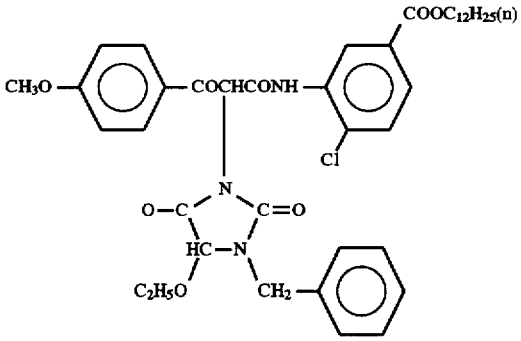
ExY-3
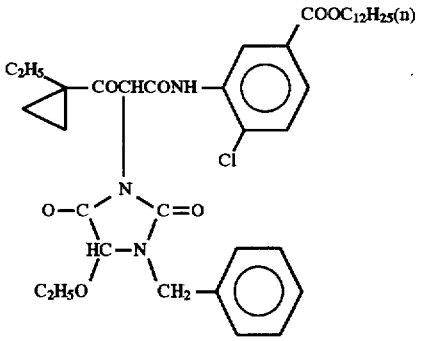

-continued
ExY-4
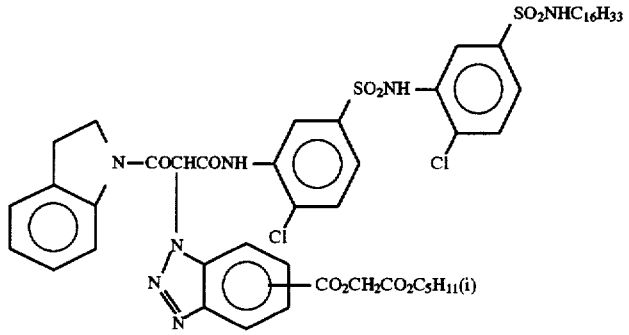
ExY-5
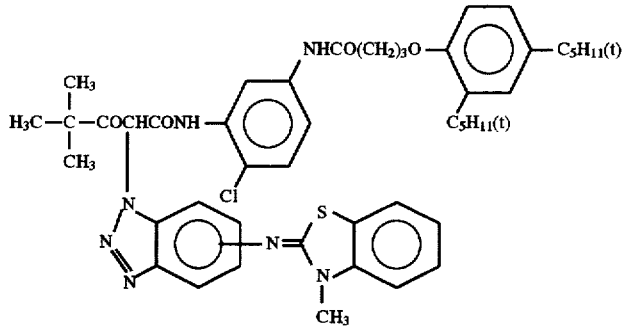
ExF-1
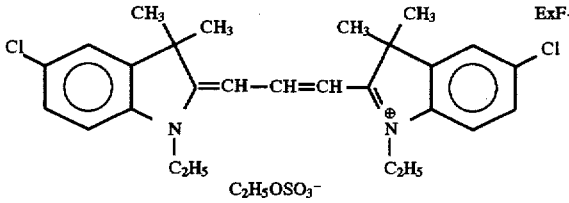
ExF-2
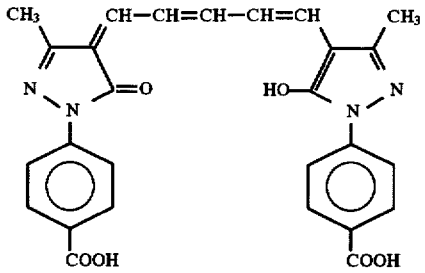
ExF-3
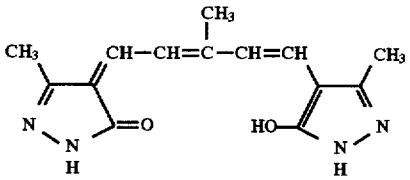
ExF-4
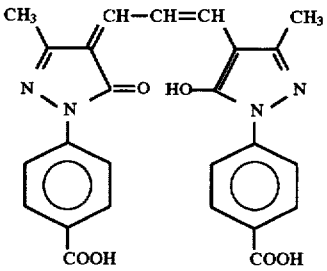
ExF-5
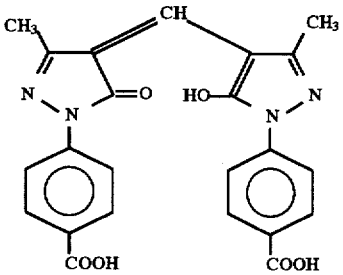
ExF-6
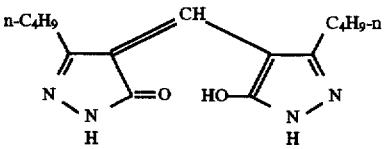

-continued
ExF-7
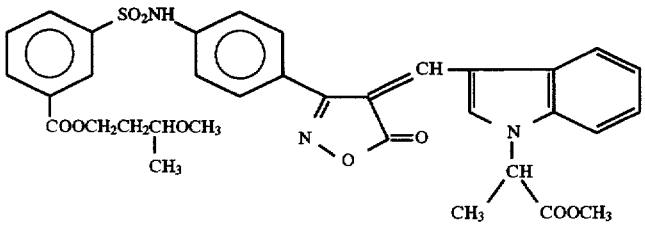
Cpd-1
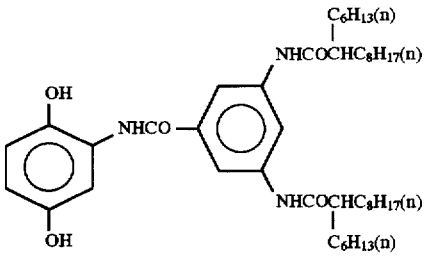
Cpd-2
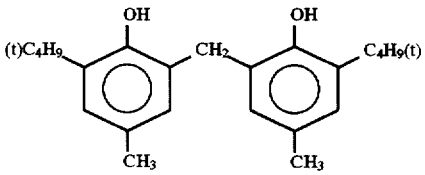
Cpd-3
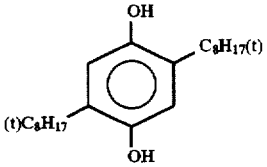
UV-1
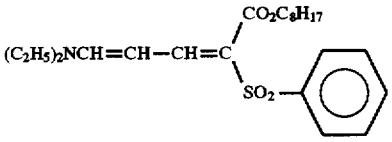
UV-2
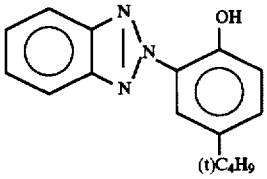
UV-3
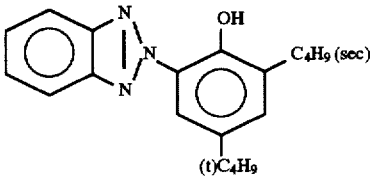
Tricresyl Phosphate HBS-1
Di-n-Butyl Phthalate HBS-2
HBS-3
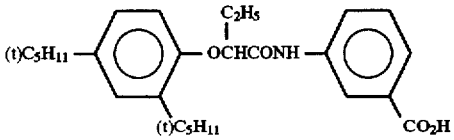
Tri (2-ethylhexyl) phosphate HBS-4
ExS-1
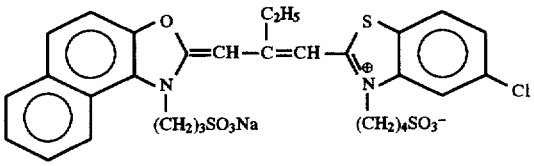
ExS-2
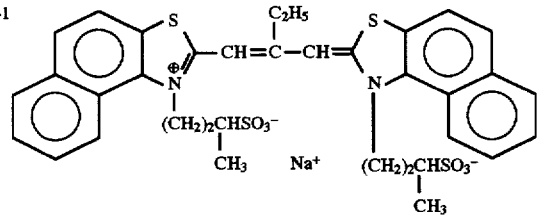
ExS-3
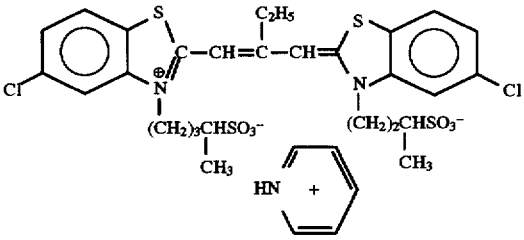

-continued
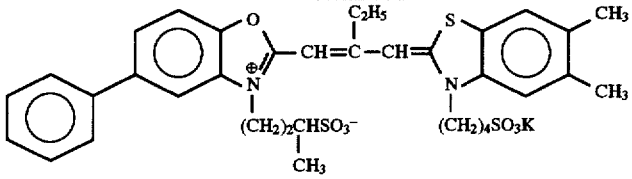
ExS-4
ExS-5
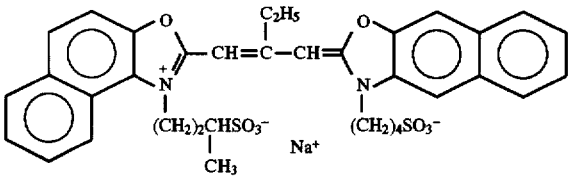
ExS-6
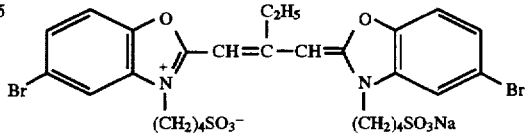
ExS-7
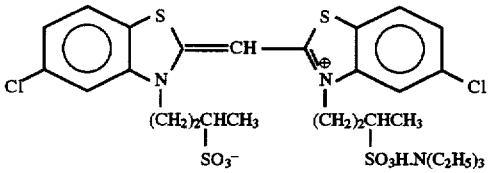
S-1
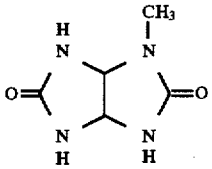
H-1
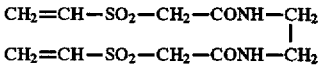
B-1
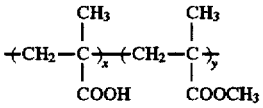
x/y = 10/90 (weight ratio)
Av. Mol. Wt.: about 35,000
B-2
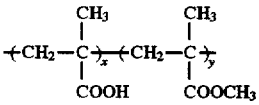
x/y = 40/60 (weight ratio)
Av. Mol. Wt.: about 20,000
B-3
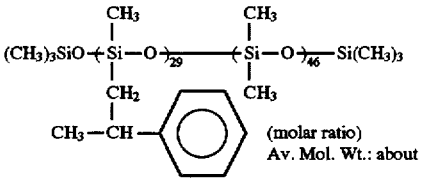
(molar ratio)
Av. Mol. Wt.: about 8,000
B-4
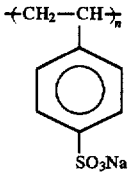
Av. Mol. Wt.: about 750,000
B-5
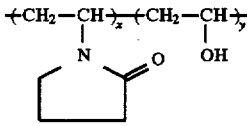
x/y = 70/30 (weight ratio)
Av. Mol. Wt.: about 17,000
B-6
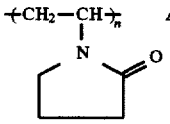
Av. Mol. Wt.: about 10,000
W-1
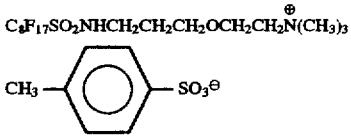
W-2
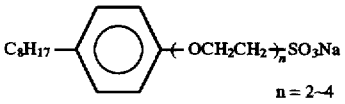
n = 2~4
W-3
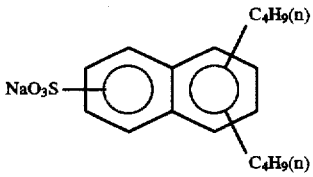
F-1
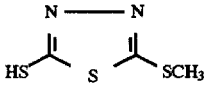
F-2
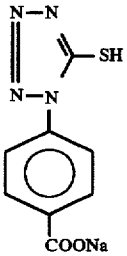

-continued

F-3

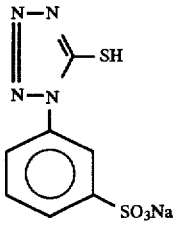

F-4

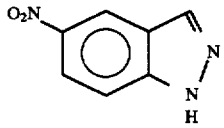

F-5

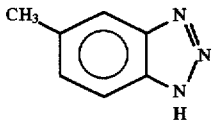

F-6

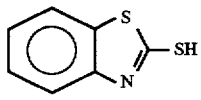

F-7

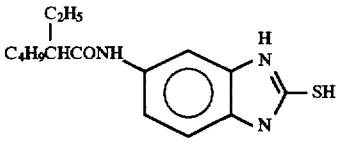

F-8

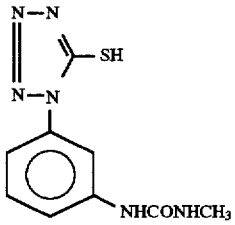

F-9

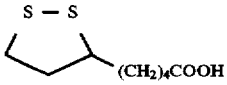

F-10

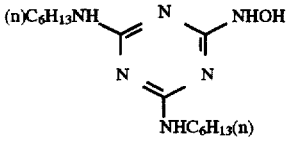

F-11

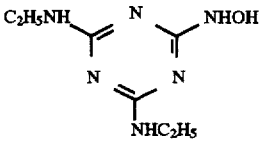

F-12

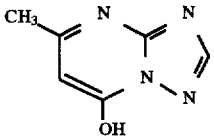

F-13

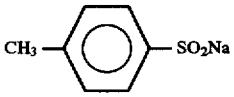

F-14

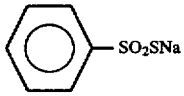

F-15

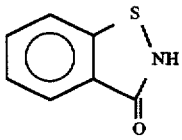

F-16

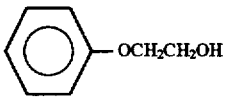

F-17

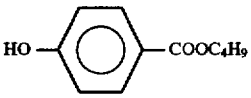

As shown in Table 8 given below, Sample Nos. 2001 to 2011 (as light-sensitive materials) were prepared by repeating the procedures described above except that the dyes used in the emulsions 110 to 112 prepared in Example 1 were substituted for the dye used in the 5th layer and that the dyes used in the emulsuions 101 to 109 were substituted for the dye used in the 9th layer and the resulting light-sensitive materials each was exposed to light in the same manner used in Example 1 except that the use of the SC50 filter was omitted.

The sensitivity was expressed in terms of the relative value of the reciprocal light exposure value required for achieving an optical density greater than the fog by 0.1.

With regard to the multi-layered color films, the results listed in Table 8 also clearly indicate that the samples prepared using the dyes employed in the emulsions 102 to 109, 111 and 112 had high sensitivity and low fog as compared with those prepared using the dyes employed in the emulsions 101 and 110.

TABLE 8

| Sample No. | 5th Layer[1)] | 9th Layer[1)] | Relative Cyan Sensitivity | Relative Magenta Sensitivity | Cyan Fogging | Magenta Fogging | Remarks |
|---|---|---|---|---|---|---|---|
| 2001 | 110 | 101 | 100(Ref.) | 100(Ref.) | 0.25 | 0.35 | Comp. Ex. |
| 2002 | 110 | 102 | — | 165 | — | 0.15 | Pres.Inv. |
| 2003 | 110 | 103 | — | 173 | — | 0.14 | Pres.Inv. |
| 2004 | 110 | 104 | — | 194 | — | 0.13 | Pres.Inv. |
| 2005 | 110 | 105 | — | 195 | — | 0.13 | Pres.Inv. |

TABLE 8-continued

| Sample No. | 5th Layer[1)] | 9th Layer[1)] | Relative Cyan Sensitivity | Relative Magenta Sensitivity | Cyan Fogging | Magenta Fogging | Remarks |
|---|---|---|---|---|---|---|---|
| 2006 | 110 | 106 | — | 216 | — | 0.12 | Pres.Inv. |
| 2007 | 110 | 107 | — | 95 | — | 0.33 | Comp. Ex. |
| 2008 | 110 | 108 | — | 160 | — | 0.13 | Pres.Inv. |
| 2009 | 110 | 109 | — | 206 | — | 0.11 | Pres.Inv. |
| 2010 | 111 | 101 | 163 | — | 0.10 | — | Pres.Inv. |
| 2011 | 112 | 101 | 211 | — | 0.09 | — | Pres.Inv. |

[1)]The dyes of the emulsions used in Example 1 whose numbers are specified in Table 8 were substituted for the dyes used in the 5th Layer" and "9th layer". Samples 2001 to 2009 were compared to one another on the basis of the 9th layer, while Samples 2010 and 2011 were compared to one another on the basis of the 5th layer.

EXAMPLE 3

1) Substrate

The substrate used in this Example was prepared by the following method.

A mixture of 100 parts by weight of polyethylene-2,6-naphthalate polymer and 2 parts by weight of Tinuvin P.326 (available from Ciba Geigy Corporation) as a UV absorber was dried, then melted at 300° C., extruded through a T type die, longitudinally oriented to 3.3 times the original length at 140° C., then oriented in the widthwise direction to 3.3 times the original width at 130° C. and further set by heating to give a PEN film having a thickness of 90 μm. In this respect, there were added, to this PEN film, a blue dye, a magenta dye and a yellow dye (the dyes I-1, I-4, I-6, I-24, I-26, I-27 and/or II-5 disclosed in KOKAI GIHO: KOGI No. 94-6023) in appropriate amounts. Moreover, the film was wound on a take-up reel having a diameter of 20 cm and then heated at 110° C. for 48 hours to impart heat history to the film and to thus give a substrate almost free of winding habit.

2) Application of Undercoating Layer

After subjecting the both sides of the foregoing substrate to a corona discharge treatment, a UV discharge treatment and a glow discharge treatment, each side thereof was coated with a solution for forming an undercoating layer, which comprised 0.1 g/m$^2$ of gelatin, 0.01 g/m$^2$ of sodium α-sulfo-di-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide-epichlorohydrin polycondensate (10 cc/M$^2$; a bar coater was used for the application of this solution) to thus form undercoating layers on the side which was subjected to a high temperature during the orientation. The undercoating layers were dried at 115° C. for 6 minutes (all of the rollers and conveying devices in the drying zone were maintained at 115° C.).

3) Application of Backing Layer

Antistatic, magnetic recording and slipping layers having the following compositions respectively were applied onto one side of the substrate, to which the undercoating layer had been applied, as a backing layer.

3-1) Application of Antistatic Layer

An antistatic layer was formed by coating one side of the substrate with 0.2 g/m$^2$ of a dispersion, which comprised fine particulate powder of tin oxide-antimony oxide composite material having an average particle size of 0.005 μm (diameter of secondary aggregate particles: about 0.08 μm) and a specific resistance of 5 Ω·cm, 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene (degree of polymerization: 10)-p-nonylphenol and resorcin.

3-2) Application of Magnetic Recording Layer

A magnetic recording layer having a thickness of 1.2 μm was formed on the antistatic layer of the substrate by coating thereon a dispersion comprising 0.06 g/m$^2$ of cobalt- γ-iron oxide (having a specific surface area of 43 m$^2$/g, a major axis of 0.14 μm, a minor axis of 0.03 μm, saturation magnetization of 89 emu/g and a ratio $Fe^{+2}/Fe^{+3}$ of 6/94; the surface had been treated with aluminum oxide-silicon oxide in an amount of 2% by weight based on the iron oxide) coated with 3-polyoxyethylene (degree of polymerization: 15)-propyloxytrimethoxysilane (15% by weight), 1.2 g/m$^2$ of diacetyl cellulose (the iron oxide was dispersed using an open kneader and a sand mill), 0.3 g/m$^2$ of $C_2H_5C(CH_2OCONH\text{-}C_6H_3(CH_3)NCO)_3$ as a hardening agent in a solvent comprising acetone, methyl ethyl ketone and cyclohexanone, using a bar coater. There were added, to the magnetic recording layer, silica particles (0.3 μm) as a matting agent and aluminum oxide particles (0.15 μm), as an abrasive, which had been coated with 3-polyoxyethylene (degree of polymerization: 15)-propyloxytrimethoxysilane (15% by weight), in amounts of 10 mg/m$^2$ respectively. The magnetic recording layer was dried at 115° C. for 6 minutes (all of the rollers and conveying devices in the drying zone were maintained at 115° C. ). The resulting magnetic recording layer showed an increase in the color density $D^B$, as determined using X-Light (blue filter), of about 0.1 and had a saturation magnetization moment of 4.2 emu/g, a coercive force of $7.3\times10^4$ A/m and a squareness ratio of 65%.

3-3) Formation of Slipping Layer

A slipping layer was formed on the magnetic recording layer by coating thereon diacetyl cellulose (25 mg/M$^2$) and a mixture: $C_6H_{13}CH(OH)C_{10}H_{20}COOC_{40}H_{81}$ (Compound a; 6 mg/m$^2$ )/$C_{50}H_{101}O(CH_2CH_2O)_{16}H$ (Compound b; 9 mg/m$^2$). In this regard, the mixture was melted in a 1/1 xylene/propylene monomethyl ether mixture at 105° C. , then the resulting melt was poured into 10 volumes of propylene monomethyl ether maintained at ordinary temperature to give a dispersion, dispersed in acetone (average particle size: 0.01 μm) and then added to diacetyl cellulose. There were added, to the slipping layer, silica particles (0.3 μm) as a matting agent and aluminum oxide particles (0.15 μm), as an abrasive, which had been coated with 3-polyoxyethylene (degree of polymerization: 15)-propyloxytrimethoxysilane (15% by weight) in amounts of 15 mg/m$^2$, respectively. The slipping layer was dried at 115° C. for 6 minutes (all of the rollers and conveying devices in the drying zone were maintained at 115° C.). The resulting slipping layer showed excellent characteristic properties, i.e., the layer had a coefficient of dynamic friction of 0.06 (as determined at a load of 100 g and a speed of 6 cm/min using a stainless steel hard sphere of 5 mm ϕ), a coefficient of static friction of 0.07 (clipping method) and a coefficient of dynamic friction observed between the emulsion layer detailed below and the slipping layer of 0.12.

4) Application of Light-Sensitive Layer

Layers having the same compositions used in Example 2 were applied, in layers, onto the side of the substrate opposite to the side to which the foregoing backing layer had been applied except that the dyes listed in the following Table 9 were substituted for the dyes used in the 5th and 9th layers to give Sample Nos. 3001 to 3002 listed in Table 10.

Each light-sensitive material thus prepared was cut into films having a width of 24 mm and a length of 160 cm and each film was perforated so that two holes of 2 mm square were formed at the longitudinal periphery thereof (a distance of 0.7 mm apart from the edge) in an interval of 5.8 mm. Such sets of holes were formed on each film at intervals of 32 mm and the resulting perforated film was accommodated in a plastic film cartridge as detailed in FIGS. 1 to 7 of U.S. Pat. No. 5,296,887.

FM signals were recorded on each Sample, from the side to which the magnetic recording layer had been applied, at positions between the foregoing perforations at a feed rate of 1,000/s using a head capable of input-output at a head gap of 5 μm and a turn number of 2,000.

After the recording of the FM signals, the whole surface of the emulsion layers were exposed to light at 1,000 cms, then the exposed light-sensitive materials were subjected to the following treatments and thereafter again accommodated in the original plastic film cartridge.

These Sample Nos. 3001 and 3002 each was exposed to light in the same manner used in Example 1 (except that the use of the SC50 filter was omitted), then subjected to the following treatment (running treatment) and inspected for various properties in the same manner used in Example 2.

In this respect, each treatment was carried out using an automatic developing machine FP-360B available from Fuji Photo Film Co., Ltd. under the following conditions, provided that the machine was modified in such a manner that the overflow liquid originated from the bleaching bath was not recycled to the subsequent baths, but discharged to a waste liquid tank. The machine FP360B was provided with a means for compensating evaporation as disclosed in HATSUMEI KYOKAI, KOKAI GIHO No. 94-4992.

The processing steps and the compositions of the processing solutions used herein were as follows.

(Processing Steps)

| Step | Processing Time | Processing Temp. | Amount of Replenisher* | Volume of Tank(l) |
|---|---|---|---|---|
| Color Development | 3 min, 5 sec | 37.8° C. | 20 ml | 11.5 |
| Bleaching | 50 sec | 38.0° C. | 5 ml | 5 |
| Fixing (1) | 50 sec | 38.0° C. | — | 5 |
| Fixing (2) | 50 sec | 38.0° C. | 8 ml | 5 |
| Water Washing | 30 sec | 38.0° C. | 17 ml | 3 |
| Stabilization (1) | 20 sec | 38.0° C. | — | 3 |
| Stabilization (2) | 20 sec | 38.0° C. | 15 ml | 3 |
| Drying | 1 min, 30 sec | 60° C. | | |

*The amount of the replenisher is expressed in terms of the amount thereof per unit amount of the light-sensitive material (a width of 35 mm and a length of 1.1 m; corresponding to one sheet of 24 Ex. film).

The stabilization solutions and the fixing solutions were countercurrently fed from (2) to (1), respectively and all of the overflow liquid originated from the washing water was introduced into the fixing bath (2). The amount of the developer carried over to the bleaching step, that of the bleaching solution carried over to the fixing step and that of the fixing solution carried over to the water washing step were found to be 2.5 ml, 2.0 ml and 2.0 ml, respectively, per unit amount of the light-sensitive material (35 mm wide and 1.1 m long). The crossover times each was found to be 6 seconds and each of them was included in the processing time required for the preceding step.

The areas of openings of the processing machine were 100 $cm^2$ for the color developer, 120 $cm^2$ for the bleaching solution and about 100 $cm^2$ for other processing solutions.

The composition of each processing solution will be detailed below.

| Component | Tank Soln. (g) | Replenisher (g) |
|---|---|---|
| (Color Developer) | | |
| diethylenetriaminepenta-acetic acid | 3.0 | 3.0 |
| 2 Na catechol-3,5-disulfonate | 0.3 | 0.3 |
| sodium sulfite | 3.9 | 5.3 |
| potassium carbonate | 39.0 | 39.0 |
| 2 Na N,N-bis(2-sulfonate-ethyl)-hydroxylamine | 1.5 | 2.0 |
| potassium bromide | 1.3 | 0.3 |
| potassium iodide | 1.3 (mg) | — |
| 4-hydroxy-6-methyl-1,3,3a,7-tetra-zaindene | 0.05 | — |
| hydroxylamine sulfate | 2.4 | 3.3 |
| 2-methyl-4-[N-ethyl-N-(β-hydroxy-ethyl)amino]aniline sulfate | 4.5 | 6.5 |
| water | ad. 1.0 l | ad. 1.0 l |
| pH (controlled by the addition of potassium hydroxide and sulfuric acid) | 10.05 | 10.18 |
| (Bleaching Solution) | | |
| Fe(II) ammonium 1,3-diaminopropane-tetraacetate monohydrate | 113 | 170 |
| ammonium bromide | 70 | 105 |
| ammonium nitrate | 14 | 21 |
| succinic acid | 34 | 51 |
| maleic acid | 28 | 42 |
| water | ad. 1.0 l | ad. 1.0 l |
| pH (controlled by the addition of aqueous ammonia) | 4.6 | 4.0 |

(Fixing Solution (1); Tank Solution)

A 5:95 (volume ratio) mixed solution of the foregoing tank solution for bleaching and the following tank solution for fixing (pH 6.8).

(Fixing Solution (2))

| Component | Tank Soln.(g) | Replenisher(g) |
|---|---|---|
| aqueous ammonium thiosulfate solution (750 g/l) | 240 ml | 720 ml |
| imidazole | 7 | 21 |
| ammonium methanethiosulfonate | 5 | 15 |
| ammonium methanesulfinate | 10 | 30 |
| ethylenediaminetetraacetic acid | 13 | 39 |
| water | ad. 1.0 l | ad. 1.0 l |
| pH (controlled by the addition of aqueous ammonia and acetic acid) | 7.4 | 7.45 |

(Washing Water)

Tap water was passed through a mixed bed column packed with an H-type strongly acidic cation exchange resin (Amberlite IR-120B available from Rohm & Haas Co.) and an OH-type strongly basic anion exchange resin (Amberlite IR-400 available from Rohm & Haas Co.) to reduce the concentrations of calcium and magnesium ions to not more than 3 mg/l respectively and then 20 mg/l of sodium dichloroisocyanurate and 150 mg/l of sodium sulfate were added to the resulting deionized water. The pH value of the solution fell within the range of from 6.5 to 7.5.

(Stabilization Solution, common to Tank Soln. and Replenisher)

| Component | Amount (g) |
|---|---|
| sodium p-toluenesulfinate | 0.03 |
| polyoxyethylene-p-monononyl phenyl ether (average degree of polymerization: 10) | 0.2 |

-continued

| (Stabilization Solution, common to Tank Soln. and Replenisher) | |
|---|---|
| Component | Amount (g) |
| sodium 1,2-benzoisothiazolin-3-one | 0.10 |
| 2Na ethylenediaminetetraacetate | 0.05 |
| 1,2,4-triazole | 1.3 |
| 1,4-bis(1,2,4-triazol-1-yl-methyl)piperazine | 0.75 |
| water | ad. 1.0 l |
| pH | 8.5 |

The results of the foregoing evaluation are listed in the following Table 10. As seen from the results listed in Table 10, Sample No. 3002 of the present invention was highly sensitive to light and exhibited low fogging as compared with Comparative Sample No. 3001.

TABLE 9

| Sample No. | Layer | Sensitizing Dye |
|---|---|---|
| (1) | 9th layer | ExS-4 $3.7 \times 10^{-5}$ mole/mole Ag<br>ExS-5 $8.1 \times 10^{-5}$ mole/mole Ag<br>ExS-6 $3.2 \times 10^{-4}$ mole/mole Ag |
| (2) | 9th layer | (II-39) $3.7 \times 10^{-5}$ mole/mole Ag<br>(II-41) $8.1 \times 10^{-5}$ mole/mole Ag<br>(II-7) $3.2 \times 10^{-4}$ mole/mole Ag |
| (3) | 5th layer | ExS-1 $2.4 \times 10^{-4}$ mole/mole Ag<br>ExS-2 $1.0 \times 10^{-4}$ mole/mole Ag<br>ExS-3 $3.4 \times 10^{-4}$ mole/mole Ag |
| (4) | 5th layer | (II-42) $2.4 \times 10^{-4}$ mole/mole Ag<br>(II-44) $1.0 \times 10^{-4}$ mole/mole Ag<br>(II-50) $3.4 \times 10^{-4}$ mole/mole Ag |

ExS-1 to ExS-6 are already explained above.

TABLE 10

| Sample No. | 4th Layer | 9th Layer | Relative Cyan Sensitivity | Relative Magenta Sensitivity | Cyan Fogging | Magenta Fogging | Remarks |
|---|---|---|---|---|---|---|---|
| 3001 | (3) | (1) | 100 (Ref.) | 100 (Ref.) | 0.28 | 0.31 | Comp. Ex. |
| 3002 | (4) | (2) | 155 | 161 | 0.10 | 0.13 | Pres. Inv. |

As has been described above in detail, the present invention permits the production of silver halide photographic light-sensitive materials whose fogging is prevented, which has high sensitivity and is excellent in storage stability and which can provide images of high quality.

What is claimed is:

1. A silver halide photographic light-sensitive material comprising a substrate provided thereon with at least one silver halide emulsion layer, wherein said emulsion layer comprises at least one compound represented by the following Formula (I):

Formula (I)

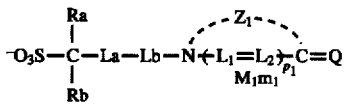

in Formula (I), Ra and Rb each represents a hydrogen atom, an alkyl group having at least two carbon atoms, an aryl group or a heterocyclic group, provided that at least one of Ra and Rb is an alkyl group having at least two carbon atoms, an aryl group or a heterocyclic group; La and Lb each represents a methylene group; $L_1$ and $L_2$ each represents a methine group; $p_1$ represents 0 or 1; $Z_1$ represents an atomic group required for forming a 5- or 6-membered nitrogen atom-containing heterocyclic ring; $M_1$ represents a counterion required for balancing the electrical charge; $m_1$ represents a numerical value of not less than 0 required for neutralizing the charge of the molecule; and Q represents a methine or polymethine group required for forming a methine dye.

2. The silver halide photographic light-sensitive material of claim 1, wherein the silver halide grains included in said emulsion layer comprising said compound represented by Formula (I) are subjected to reduction sensitization.

3. The silver halide photographic light-sensitive material of claim 1, wherein said compound of Formula (I) is selected from the group consisting of compounds represented by the following Formulae (II), (III) and (IV):

Formula (II):

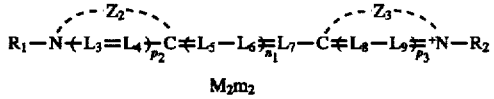

in Formula (II), $L_3$, $L_4$, $L_5$, $L_6$, $L_7$, $L_8$ and $L_9$ each represents a methine group; $p_2$ and $p_3$ each represents 0 or 1; $n_1$ represents 0, 1, 2 or 3; $Z_2$ and $Z_3$ each represents an atomic group required for forming a 5- or 6-membered nitrogen atom-containing heterocyclic ring; $M_2$ represents a counterion required for balancing the electrical charge; $m_2$ represents a numerical value of not less than 0 required for neutralizing the charge of the molecule; $R_1$ and $R_2$ each represents an alkyl group, provided that at least one of $R_1$ and $R_2$ is an alkyl group represented by the following Rz:

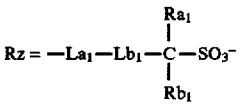

in Rz, $Ra_1$ and $Rb_1$ are identical to Ra and Rb defined above, respectively, and $La_1$ and $L_b$ are identical to La and Lb defined above, respectively;

Formula (III):

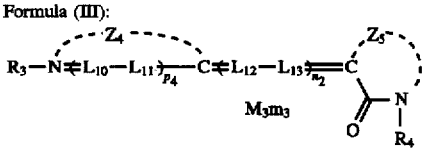

in Formula (III), $L_{10}$, $L_{11}$, $L_{12}$ and $L_{13}$ each represents a methine group, $p_4$ represents 0 or 1, $n_2$ represents 0, 1, 2 or 3, $Z_4$ and $Z_5$ each represents an atomic group required for forming a 5- or 6-membered nitrogen atom-containing heterocyclic ring, $M_3$ represents a counterion required for balancing the electrical charge, $m_3$ represents a numerical value of not less than 0 required for neutralizing the charge of the molecule, $R_3$ is an alkyl group represented by said Rz, and $R_4$ represents an alkyl group, an aryl group or a heterocyclic group;

Formula (IV):

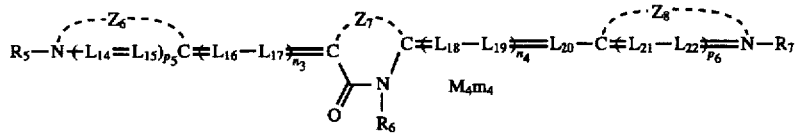

in Formula (IV), $L_{14}$, $L_{15}$, $L_{16}$, $L_{17}$, $L_{18}$, $L_{19}$, $L_{20}$, $L_{21}$ and $L_{22}$, each represents a methine group, $p_5$ and $p_6$ each represents 0 or 1, $n_3$ and $n_4$ each represents 0, 1, 2 or 3, $Z_6$, $Z_7$ and $Z_8$ each represents an atomic group required for forming a 5- or 6-membered nitrogen atom-containing heterocyclic ring, $M_4$ represents a counterion required for balancing the electrical charge, $m_4$ represents a numerical value of not less than 0 required for neutralizing the charge of the molecule, $R_5$ and $R_7$ each represents an alkyl group, provided that at least one of $R_5$ and $R_7$ is an alkyl group represented by said Rz, and $R_6$ is an alkyl group, an aryl group or a heterocyclic group.

4. The silver halide photographic light-sensitive material of claim 3, wherein said compound represented by Formula (I) is a compound selected from the group consisting of those represented by Formula (II).

5. The silver halide photographic light-sensitive material of claim 3, wherein the silver halide grains included in said emulsion layer comprising said compound represented by Formula (II), (III) or (IV) are subjected to reduction sensitization.

6. The silver halide photographic light-sensitive material of claim 1, wherein, in Formula (I), Ra is an aryl group or a heterocyclic group and Rb is a hydrogen atom.

7. The silver halide photographic light-sensitive material of claim 1 or 3, wherein said 5- or 6-membered nitrogen atom-containing heterocyclic ring formed by $Z_1$, $Z_2$, $Z_3$, $Z_4$, $Z_6$ or $Z_8$ is selected from the group consisting of thiazoline nuclei, thiazole nuclei, benzothiazole nuclei, oxazoline nuclei, oxazole nuclei, benzoxazole nuclei, selenazoline nuclei, selenazole nuclei, benzoselenazole nuclei, dialkylindolenine nuclei, imidazoline nuclei, imidazole nuclei, benzimidazole nuclei, pyridine nuclei, quinoline nuclei, isoquinoline nuclei, imidazoquinoxaline nuclei, oxadiazole nuclei, thiadiazole nuclei, tetrazole nuclei and pyrimidine nuclei.

8. The silver halide photographic light-sensitive material of claim 7, wherein said 5- or 6-membered nitrogen atom-containing heterocyclic ring is selected from the group consisting of benzoxazole nuclei, benzothiazole nuclei, benzimidazole nuclei and quinoline nuclei.

9. The silver halide photographic light-sensitive material of claim 8, wherein said 5- or 6-membered nitrogen atom-containing heterocyclic ring is selected from the group consisting of benzoxazole nuclei, benzothiazole nuclei and benzimidazole nuclei.

10. The silver halide photographic light-sensitive material of claim 3, wherein said 5- or 6-membered nitrogen atom-containing heterocyclic ring formed by $Z_2$ or $Z_3$ is benzoxazole nuclei.

11. The silver halide photographic light-sensitive material of claim 3, wherein said 5- or 6-membered nitrogen atom-containing heterocyclic ring formed by $Z_5$ is an acidic nucleus derived from the compound selected from the group consisting of 2-pyrazolin-5-one, pyrazolidin-3,5-dione, imidazolin-5-one, hydantoin, 2- or 4-thiohydantoin, 2-iminooxazolidin-4-one, 2-oxazolin-5-one, 2-thiooxazolin-2,4-dione, isooxazolin-5-one, 2-thiazolin-4-one, thiazolidin-4-one, thiazolidin-2,4-dione, rhodanine, thiazolidin-2,4-dithione, isorhodanine, indan-1,3-dione, thiophen-3-one, thiophen-3-one-1, 1-dioxide, indolin-2-one, indolin-3-one, 2-oxoindazolinium, 3-oxoindazolinium, 5,7-dioxo-6,7-dihydrothiazolo[3,2-a]pyrimidine, cyclohexan-1,3-dione, 3,4-dihydroisoquinolin-4-one, 1,3-dioxan-4,6-dione, barbituric acid, 2-thiobarbituric acid, chroman-2,4-dione, indazolin-2-one, pyrido[1,2-a]pyrimidin-1,3-dione, pyrazolo[1,5-b]quinazolone, pyrazolo[1,5-a]benzimidazole, pyrazolopyridone, 1,2,3,4-tetrahydroquinolin-2,4-dione, 3-oxo-2,3-dihydrobenzo[d]thiophen-1,1-dioxide and 3-dicyanomethin-2,3-dihydrobenzo[d]thiophen-1,1-dioxide.

12. The silver halide photographic light-sensitive material of claim 3, wherein said 5- or 6-membered nitrogen atom-containing heterocyclic ring formed by $Z_7$ is selected from the group consisting of hydantoin, 2- or 4-thiohydantoin, 2-oxazolin-5-one, 2-thiooxazolin-2,4-dione, thiazolidin-2,4-dione, rhodanine, thiazolidin-2,4-dithione, barbituric acid and 2-thiobarbituric acid, from which oxo or thioxo groups are omitted.

13. The silver halide photographic light-sensitive material of claim 1, comprising said compound represented by Formula (I) in an amount ranging from $0.5\times10^{-6}$ to $1.0\times10^{-2}$ mole per mole of silver halide present therein.

14. The silver halide photographic light-sensitive material of claim 11, comprising said compound represented by Formula (I) in an amount ranging from $1.0\times10^{-5}$ to $5.0\times10^{-3}$ mole per mole of silver halide present therein.

15. The silver halide photographic light-sensitive material of claim 2, wherein said reduction sensitization is carried out using a compound selected from the group consisting of stannous salts, amines and polyamines, hydrazine derivatives, formamidinesulfinic acid, silane compounds, borane compounds and ascorbic acid and derivatives thereof.

16. The silver halide photographic light-sensitive material of claim 15, wherein said compound is used in an amount of $10^{-7}$ to $10^{-3}$ mole per mole of silver halide.

17. The silver halide photographic light-sensitive material of claim 1, comprising at least one member selected from the group consisting of the compounds represented by the following Formulae (XX), (XXI) and (XXII):

$$R_{101}—SO_2S—M_{101} \quad (XX)$$

$$R_{101}—SO_2S—R_{102} \quad (XXI)$$

$$R_{101}—SO_2S—(E)_aSSO_2—R_{103} \quad (XXII)$$

wherein $R_{101}$, $R_{102}$ and $R_{103}$ each represents an aliphatic group, an aromatic group or a heterocyclic group; $M_{101}$ represents a cationic ion, E represents a divalent coupling group and a is 0 or 1.

18. The silver halide photographic light-sensitive material of claim 17, wherein the compound represented by Formula (XX), (XXI) or (XXII) is used in an amount ranging from $10^{-7}$ to $10^{-1}$ mole per mole of silver halide.

* * * * *